US011534043B2

(12) United States Patent
Conrad

(10) Patent No.: US 11,534,043 B2
(45) Date of Patent: Dec. 27, 2022

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 836 days.

(21) Appl. No.: 16/280,784

(22) Filed: Feb. 20, 2019

(65) Prior Publication Data

US 2019/0174986 A1 Jun. 13, 2019

Related U.S. Application Data

(63) Continuation-in-part of application No. 16/046,283, filed on Jul. 26, 2018, now Pat. No. 11,006,798, which is a continuation of application No. 15/365,118, filed on Nov. 30, 2016, now abandoned, which is a continuation of application No. 14/003,160, filed as application No. PCT/CA2012/000194 on Mar. 5, 2012, now Pat. No.

(Continued)

(51) Int. Cl.

| | |
|---|---|
| ***A47L 9/16*** | (2006.01) |
| ***A47L 5/32*** | (2006.01) |
| ***A47L 7/00*** | (2006.01) |
| ***A47L 5/24*** | (2006.01) |
| ***A47L 5/36*** | (2006.01) |
| ***A47L 5/28*** | (2006.01) |

(52) U.S. Cl.

CPC ..... *A47L 9/1608* (2013.01); *A47L 5/24* (2013.01); *A47L 5/28* (2013.01); *A47L 5/32* (2013.01); *A47L 5/362* (2013.01); *A47L 7/0023* (2013.01); *A47L 7/0038* (2013.01); *A47L 9/1666* (2013.01); *A47L 9/1683* (2013.01); *A47L 9/1691* (2013.01)

(58) Field of Classification Search

None

See application file for complete search history.

(56) References Cited

U.S. PATENT DOCUMENTS

| | | | |
|---|---|---|---|
| 4,260,401 | A | 4/1981 | Truhan et al. |
| 6,547,856 | B2 | 4/2003 | Cartellone |

(Continued)

FOREIGN PATENT DOCUMENTS

| | | | |
|---|---|---|---|
| CN | 2647434 | Y | 10/2004 |
| CN | 106551654 | Y | 4/2007 |

(Continued)

OTHER PUBLICATIONS

TotalPatent: English machine translation of KR100709418 published on Apr. 12, 2007.

(Continued)

*Primary Examiner* — Brian D Keller

(74) *Attorney, Agent, or Firm* — Philip C. Mendes da Costa; Bereskin & Parr LLP/S.E.N.C.R.L., s.r.l.

(57) ABSTRACT

A surface cleaning apparatus has a cyclone bin assembly having a cyclone chamber. The cyclone chamber with a physical filtration member defining the cyclone air outlet. The physical filtration member has an outer wall wherein at least a portion of the outer wall is porous and a plurality of ribs spaced around the outer wall. The ribs have a radial outer side that is positioned radially outwardly of the outer wall.

17 Claims, 59 Drawing Sheets

Related U.S. Application Data

9,962,052, which is a continuation-in-part of application No. 13/040,695, filed on Mar. 4, 2011, now abandoned.

(56) References Cited

U.S. PATENT DOCUMENTS

| | | | |
|---|---|---|---|
| 6,625,845 | B2 | 9/2003 | Matsumoto et al. |
| 6,647,587 | B1 | 11/2003 | Ohara et al. |
| 6,811,584 | B2 | 11/2004 | Oh |
| 6,824,580 | B2 | 11/2004 | Oh |
| 6,890,375 | B2 | 5/2005 | Huber |
| 6,928,692 | B2 | 8/2005 | Oh et al. |
| 7,070,636 | B2 | 7/2006 | McCormick et al. |
| 7,074,248 | B2 | 7/2006 | Jin et al. |
| 7,152,276 | B2 | 12/2006 | Jin et al. |
| 7,152,277 | B2 | 12/2006 | Jung et al. |
| 7,318,249 | B2 | 1/2008 | Lin |
| 7,318,848 | B2 | 1/2008 | Lee |
| 7,351,269 | B2 | 4/2008 | Yau |
| 7,370,387 | B2 * | 5/2008 | Walker ..... A47L 5/24 15/344 |
| 7,381,248 | B2 | 6/2008 | Kim et al. |
| 7,412,749 | B2 | 8/2008 | Thomas et al. |
| 7,419,520 | B2 | 9/2008 | Lee et al. |
| 7,494,520 | B2 | 2/2009 | Nam et al. |
| 7,611,553 | B2 | 11/2009 | Hato |
| 7,615,089 | B2 | 11/2009 | Oh |
| 7,645,309 | B2 | 1/2010 | Jeong et al. |
| 7,704,290 | B2 | 4/2010 | Oh |
| 7,731,769 | B2 | 6/2010 | Min |
| 7,757,344 | B2 | 7/2010 | Min et al. |
| 8,029,590 | B2 | 10/2011 | Cheng |
| 8,152,877 | B2 | 4/2012 | Greene |
| 8,167,964 | B2 | 5/2012 | Wai |
| 8,549,704 | B2 | 10/2013 | Milligan et al. |
| 8,591,615 | B2 | 11/2013 | Kim et al. |
| 8,763,201 | B2 | 7/2014 | Kim et al. |
| 8,870,988 | B2 | 10/2014 | Oh et al. |
| 8,926,723 | B2 | 1/2015 | Kim |
| 8,951,319 | B2 | 2/2015 | Kim et al. |
| 8,959,707 | B2 | 2/2015 | Maeda et al. |
| 9,034,067 | B2 | 5/2015 | Chen |
| 2003/0159235 | A1 | 8/2003 | Oh |
| 2003/0182757 | A1 | 10/2003 | Sepke |
| 2004/0163206 | A1 | 8/2004 | Oh |
| 2007/0226948 | A1 | 10/2007 | Due |
| 2008/0134460 | A1 | 6/2008 | Conrad |
| 2009/0151306 | A1 | 6/2009 | Lin |
| 2009/0183633 | A1 | 7/2009 | Schiller et al. |
| 2009/0223183 | A1 | 9/2009 | Lin |
| 2009/0229230 | A1 | 9/2009 | Cheng |
| 2014/0215751 | A1 * | 8/2014 | Kasper ..... A47L 9/104 15/347 |
| 2016/0113459 | A1 | 4/2016 | Song |
| 2017/0008014 | A1 | 1/2017 | Van Wolferen et al. |
| 2017/0209011 | A1 | 7/2017 | Robinson et al. |
| 2017/0319033 | A1 | 11/2017 | Hyun et al. |

FOREIGN PATENT DOCUMENTS

| | | | |
|---|---|---|---|
| CN | 201082150 | Y | 7/2008 |
| CN | 1679439 | B | 5/2010 |
| CN | 201719179 | U | 1/2011 |
| CN | 101984910 | A | 3/2011 |
| CN | 201840420 | U | 5/2011 |
| CN | 102125407 | A | 7/2011 |
| CN | 102670134 | B | 10/2014 |
| CN | 203852305 | U | 10/2014 |
| CN | 105078367 | B | 8/2017 |
| CN | 107468159 | A | 12/2017 |
| DE | 19704468 | A1 | 8/1998 |
| DE | 20311505 | U1 | 10/2003 |
| DE | 102007059591 | A1 | 6/2009 |
| DE | 102013108564 | A1 | 3/2015 |
| EP | 1714703 | A | 10/2006 |
| EP | 2064981 | A1 | 6/2009 |
| EP | 1535564 | B1 | 8/2009 |
| EP | 1743562 | B1 | 9/2011 |
| EP | 1959809 | B1 | 5/2014 |
| EP | 2459043 | B1 | 9/2015 |
| EP | 2225993 | B1 | 2/2016 |
| EP | 2915473 | B1 | 1/2018 |
| GB | 2375980 | A | 12/2002 |
| GB | 2449484 | B | 4/2009 |
| GB | 2459300 | B | 3/2010 |
| GB | 2487387 | B | 9/2015 |
| JP | 06072502 | B2 | 9/1994 |
| JP | 06088784 | B2 | 11/1994 |
| JP | 2003038398 | A | 2/2003 |
| JP | 2003339593 | A | 12/2003 |
| JP | 2003339594 | A | 12/2003 |
| JP | 2003339595 | A | 12/2003 |
| JP | 2003339596 | A | 12/2003 |
| JP | 2005218512 | A | 8/2005 |
| JP | 2006340935 | A | 12/2006 |
| JP | 2007089755 | A | 4/2007 |
| JP | 2008035887 | A | 2/2008 |
| JP | 2008154801 | A | 7/2008 |
| JP | 2008194177 | A | 8/2008 |
| JP | 2008246154 | A | 10/2008 |
| JP | 2011160820 | A | 8/2011 |
| JP | 5126273 | B2 | 1/2013 |
| KR | 100709418 | | 4/2007 |
| WO | 2011025071 | A1 | 3/2011 |
| WO | 2016206759 | A1 | 12/2016 |

OTHER PUBLICATIONS

TotalPatent: English machine translation of JP2011160820 published on Aug. 25, 2011.
TotalPatent: English machine translation of JP5126273 published on Jan. 23, 2013.
TotalPatent: English machine translation of CN102670134 published on Oct. 1, 2014.
TotalPatent: English machine translation of CN201082150 published on Jul. 9, 2008.
TotalPatent: English machine translation of CN2647434 published on Oct. 13, 2004.
TotalPatent: English machine translation of CN106551654 published on Apr. 5, 2017.
English machine translation of DE102013108565 published on Mar. 3, 2015.
English machine translation of DE102007059591 published on Jun. 18, 2009.
English machine translation of WO2011025071 published on Mar. 3, 2011.
English machine translation of JP2008246154 published on Oct. 16, 2008.
English machine translation of JP2008194177 published on Aug. 28, 2008.
English machine translation of JP2008154801 published on Jul. 10, 2008.
English machine translation of JP2008035887 published on Feb. 21, 2008.
English machine translation of JP2007089755 published on Apr. 12, 2007.
English machine translation of JP2006340935 published on Dec. 21, 2006.
English machine translation of JP2005218512 published on Aug. 18, 2005.
English machine translation of JP2003339596 published on Dec. 2, 2003.
English machine translation of JP2003339595 published on Dec. 2, 2003.
English machine translation of JP200339594 published on Dec. 2, 2003.
English machine translation of JP200339593 published on Dec. 2, 2003.

(56) References Cited

OTHER PUBLICATIONS

English machine translation of JP2003038398 published on Dec. 2, 2003.
English machine translation of JP6088784 published on Mar. 1, 2017.
English machine translation of JP6072502 published on Feb. 1, 2017.
English machine translation of CN203852305 published on Oct. 1, 2014.
English machine translation of CN201840420 published on May 25, 2011.
English machine translation of CN201719179 published on Jan. 26, 2011.
English machine translation of CN107468159 published on Dec. 15, 2017.
English machine translation of CN105078367 published on Aug. 25, 2017.
English machine translation of CN102125407 published on Jul. 20, 2011.
English machine translation of CN101984910 published on Mar. 16, 2011.
English machine translation of CN1679439 published on May 26, 2010.
English machine translation of DE20311505 published on Oct. 30, 2003.
English machine translation of DE19704468 published on Aug. 13, 1998.
English machine translation of EP2459043 published on Sep. 16, 2015.
English machine translation of EP2225993 published on Feb. 24, 2016.
English machine translation of EP1959809 published on May 21, 2014.
English machine translation of EP1743562 published on Sep. 28, 2011.
English machine translation of EP1535564 published on Aug. 19, 2009.

* cited by examiner

SURFACE CLEANING APPARATUS

CROSS-REFERENCE TO RELATED APPLICATIONS

This application is a continuation-in-part of U.S. patent application Ser. No. 16/046,283, filed on Jul. 26, 2018, which itself is a continuation of U.S. patent application Ser. No. 15/365,118, filed on Nov. 30, 2016, which itself is a continuation of U.S. patent application Ser. No. 14/003,160, filed on Nov. 11, 2013, now U.S. Pat. No. 9,962,052, issued on May 8, 2018, which itself claims benefit of the national stage entry date under 35 U.S.C. 371 of co-pending international application No. PCT/CA2012/000194, filed Mar. 5, 2012, which itself is a continuation-in-part of U.S. patent application Ser. No. 13/040,695, filed on Mar. 4, 2011, now abandoned, the entirety of which is incorporated herein by reference.

FIELD

The disclosure relates to surface cleaning apparatuses, such as vacuum cleaners having a suction motor that may produce a reduced air flow, such as a battery operated vacuum cleaner.

INTRODUCTION

Various constructions for surface cleaning apparatuses, such as vacuum cleaners, are known. Currently, many surface cleaning apparatuses are constructed using at least one cyclonic cleaning stage. Air is drawn into the vacuum cleaners through a dirty air inlet and conveyed to a cyclone inlet. The rotation of the air in the cyclone results in some of the particulate matter in the airflow stream being disentrained from the airflow stream. This material is then collected in a dirt bin collection chamber, which may be at the bottom of the cyclone or in a direct collection chamber exterior to the cyclone chamber (see for example WO2009/026709 and U.S. Pat. No. 5,078,761). One or more additional cyclonic cleaning stages and/or filters may be positioned downstream from the cyclone. Cyclonic vacuum cleaners include a vortex finder that extends into the interior of the cyclone chamber and defines an air exit passage for the cyclone chamber. In addition, a screen is provided around the opening of the vortex finder to prevent hair and larger dirt particles from exiting the vacuum cleaner.

SUMMARY

The following summary is provided to introduce the reader to the more detailed discussion to follow. The summary is not intended to limit or define the claims.

One of the heaviest individual components of a vacuum cleaner may be the suction motor. The suction motor is an assembly that comprises an impeller or fan and a motor to drive the impeller or fan. Typically, vacuum cleaners use a clean air motor. Accordingly, the dirty air that is drawn into the vacuum cleaner is treated (e.g., filtered, subjected to cyclonic air separation) prior to the air passing by the suction motor. The suction motor must produce sufficient suction to draw air through the air flow passage through the vacuum cleaner, including through the air treatment members.

In order to produce a lighter vacuum cleaner, a smaller suction motor may be used. However, smaller motors typically produce less suction. An important factor in the cleaning efficiency of a vacuum cleaner is the velocity of the air flow at the dirty air inlet. The greater the velocity, the greater the amount of dirt and other particulate matter that may be entrained in an air stream and drawn into the vacuum cleaner. For example, a dirty air inlet in a floor cleaning head may have a length (in the direction transverse to the forward direction of motion) of from e.g. 7 to 12 inches and preferably from 9 to 11 inches and a width (in the direction of forward motion) of from e.g., 0.5 to 4 inches and preferably 1 to 3 inches. If the size of the dirty air inlet is maintained constant and no other changes are made to the air flow path through the vacuum cleaner, then reducing the amount of suction produced by a suction motor will reduce the cleaning efficiency of a vacuum cleaner.

According to one broad aspect of this disclosure, a vacuum cleaner, or other surface cleaning apparatus, is provided wherein a screen is provided in the cyclone chamber but a vortex finder is not provided. The screen may be of any typical design that may be used to prevent hair and larger particulate matter from exiting the cyclone chamber. Accordingly, the screen may be a shroud (e.g., a molded plastic member having openings or perforations therein), or a mesh (e.g., metal or synthetic such as nylon) provided on a support frame.

It has been surprising determined that a vacuum cleaner which has an absence of a typical vortex finder may have improved performance despite the absence of the vortex finder, particularly in low air flow vacuum cleaners. It has been determined that a vortex finder produces back pressure. This back pressure provides a resistance to flow through the vacuum cleaner and, no other changes being made, reduces the velocity of the air flow at the dirty air inlet. At the same time, the absence of the vortex finder does not materially affect the efficiency of the cyclone chamber. Therefore, the cleaning performance of the surface cleaning apparatus may be improved.

According to another broad aspect of this disclosure, a vacuum cleaner, or other surface cleaning apparatus, is provided wherein a cyclone chamber is provided with a vortex finder that extends into the cyclone chamber less than the height of the cyclone air inlet. It has also been surprisingly determined that even by reducing the size of, (without making any other change) the cleaning performance of the surface cleaning apparatus may be improved.

The vacuum cleaner, or other surface cleaning apparatus is preferably an upright vacuum cleaner and the suction motor may have a power requirement of 200 Watts or less. The surface cleaning apparatus may be battery powered, or may be connectable to an external power source, or both. Preferably, the surface cleaning apparatus is battery operated.

While a battery pack having a large power capacity may be provided so as to provide a high level of current for an extended period of time, the weight of the battery pack may be excessive for use in a vacuum cleaner. However, if the weight of the battery pack is reduced, then the operating life between charges may be low or the air flow produced by the surface cleaning apparatus may result in poor cleaning performance. In such a case, reducing the size of, or eliminating the vortex finder may result in an improvement in cleaning performance.

Accordingly, the cyclone air outlet may comprise a passage that extends into the cyclone chamber less than the height of the cyclone inlet and may be an opening in an end wall of the cyclone chamber that is covered by a screen. In particular, the surface cleaning apparatus may be operable without having a traditional, non-permeable outlet conduit or vortex finder extending into the cyclone chamber. In this configuration, the screen may provide the function of a traditional vortex finder under certain air flow conditions.

In one embodiment in accordance with one broad aspect, a battery operated surface cleaning apparatus comprises an air flow path extending from a dirty air inlet to a clean air outlet and includes a suction motor. A cyclone chamber may be provided in the air flow path. The cyclone chamber may comprise a cyclone air inlet having a height, a cyclone air outlet and a screen surrounding the cyclone air outlet. The cyclone air outlet may comprise a passage that extends into the cyclone chamber less than the height of the cyclone inlet. The surface cleaning apparatus may also include at least one battery operably connected to the suction motor.

In another embodiment in accordance with this broad aspect, a surface cleaning apparatus may also comprise an air flow path extending from a dirty air inlet to a clean air outlet and includes a suction motor having a power requirement of 200 Watts or less. A cyclone chamber may be provided in the air flow path and may comprise a cyclone air inlet having a height, a cyclone air outlet and a screen surrounding the cyclone air outlet. The cyclone air outlet may comprise a passage that extends into the cyclone chamber less than the height of the cyclone inlet.

In one embodiment in accordance with another broad aspect, a surface cleaning apparatus comprises an air flow passage extending from a dirty air inlet to a clean air outlet, a cyclone chamber positioned in the air flow passage and having an end wall, a cyclone air inlet and a cyclone air outlet, the cyclone air outlet comprising an opening in the end wall of cyclone chamber, a screen positioned in the cyclone chamber upstream of the cyclone air outlet, the screen having an outlet end, the outlet end of the screen is open and defines an airflow passage which is at least the same size as an airflow passage defined by the cyclone air outlet and, a suction motor positioned in the air flow passage.

In another embodiment in accordance with this other broad aspect, a surface cleaning apparatus may also comprise an air flow passage extending from a dirty air inlet to a clean air outlet, a cyclone chamber positioned in the air flow passage and having a cyclone air inlet and an end wall having a cyclone air outlet, a screen positioned in the cyclone chamber upstream of the cyclone air outlet, the screen having an outlet end and an absence of a centrally positioned vortex finder and, a suction motor positioned in the air flow passage Any of the embodiments described herein may have one or more of the following features.

The screen may have an interior volume that is fully open.

The screen may include a solid wall facing the cyclone air inlet. The solid wall may have a height that is greater than a height of the cyclone air inlet. Alternately or in addition, the solid wall ma have a distal end spaced from an end wall of the cyclone chamber by a first distance and the cyclone air inlet may have a distal end spaced from an end wall of the cyclone chamber by a second distance and the first distance may be greater than the second distance. Alternately or in addition, the air may rotate may in the cyclone chamber in a direction and the height of the solid wall may decrease in the direction. Alternately or in addition, the air entering the cyclone chamber may rotate around the screen in a direction and the air rotating in the direction adjacent the screen may have a height and the height of the solid may be greater than the height of the air.

The cyclone air outlet may include a collar positioned adjacent the screen extending inwardly into the screen a distance up to the height of the air inlet and preferably less than half the height of the cyclone air inlet.

The cyclone air outlet may be provided in the end wall and the outlet end of the screen may be positioned adjacent the end wall.

The cyclone air outlet may have a diameter and the screen adjacent the cyclone air outlet may have an open end having a diameter proximate the diameter of the cyclone air outlet.

The outlet end of the screen may be open and define an airflow passage, which is at least the same size as an airflow passage defined by the cyclone air outlet.

The at least one battery or surface cleaning apparatus may produce less than 50 air watts and an air flow rate less than 1.3 $m^3$/minute.

The at least one battery or surface cleaning apparatus may produce less than 40 air watts and an air flow rate less than 1.2 $m^3$/minute.

The at least one battery or surface cleaning apparatus may produce less than 30 air watts and an air flow rate less than 1.1 $m^3$/minute.

The passage may be provided in a wall of the cyclone chamber and may have a thickness proximate a thickness of the wall.

The cyclone air inlet and the cyclone air outlet may be provided at a first end of the cyclone chamber.

The cyclone chamber may comprise a dirt outlet and the dirt outlet may be at a second end of the cyclone chamber opposed to the first end.

The screen may have a plurality of openings that are less than 8 mm in size, preferably less than 6 mm in size, more preferably less than 4 mm in size, and still more preferably less than 2 mm in size.

The screen may be cylindrical in shape.

The screen may be frusto-conical in shape.

The screen may have a height that is from 0.5 to 4 times the height of the cyclone air inlet.

The screen may have a height that is from 1 to 3 times the height of the cyclone air inlet.

The screen may have a height that is about twice the height of the cyclone air inlet.

In accordance with another broad aspect of this invention, which may be used by itself or any other aspect set out herein, there is provided a physical filtration member and hair wrap member construction, wherein the hair wrap members are configured such that elongate material (e.g., hair) which is entrained in air flow cycling around the filtration member (e.g., inside a cyclone chamber) is collected at a location spaced from the porous portion of the physical filtration member. For example, the physical filtration member may be a screen, which may be conical or frusto-conical. Accordingly, the hair wrap members may be positioned and spaced around at least a porous section of the physical filtration member. In this configuration, hair may be wrapped around the hair wrap members due to cyclone flow inside the cyclone chamber. However, the wrapped hair may be spaced from the openings of the screen and thereby not block part of all of the screen. An advantage of this design is that the collection of hair around the screen may not materially affect the flow of air from the cyclone chamber through the screen. In addition, if the screen is conical or frusto-conical, the hair may be easily removed from the hair wrap members by sliding any wrapped hair along the conical section of the screen to the tip of the screen.

In accordance with this aspect, there is provided a surface cleaning apparatus comprising:

(a) an air flow passage extending from a dirty air inlet to a clean air outlet;

(b) the cyclone chamber positioned in the air flow passage, the cyclone chamber having a longitudinal axis defining a longitudinal direction, an air inlet at a cyclone air inlet end of the cyclone chamber, an opposed end longitudinally spaced from the air inlet end and a cyclone air outlet comprising a cyclone chamber outlet port, the cyclone having a direction of rotation of air in the cyclone chamber;

(c) a physical filtration member positioned in the cyclone chamber upstream from the cyclone chamber outlet port, the physical filtration member having a longitudinal axis, an outer wall wherein at least a portion of the outer wall is porous, and a plurality of ribs spaced around the outer wall, the ribs having a radial inner side, a radial outer side, an upstream side based on the direction of rotation, a downstream side based on the direction of rotation and first and second longitudinally spaced apart ends, wherein the radial outer side is positioned radially outwardly of the outer wall; and, (d) a suction motor positioned in the air flow passage downstream from the cyclone chamber.

In some embodiments, at least a radial outer portion of the upstream side of the ribs may extend in the direction of rotation.

In some embodiments, the radial outer portion of the upstream side of the ribs may be planar.

In some embodiments, the radial outer portion of the upstream side of the ribs may be curved in the direction of rotation.

In some embodiments, at least a radial outer portion of the downstream side of the ribs may extend radially.

In some embodiments, at least a radial outer portion of the downstream side of the ribs may extend in the direction of rotation.

In some embodiments, the radial outer portion of the downstream side of the ribs may be planar.

In some embodiments, the radial outer portion of the downstream side of the ribs may be curved in the direction of rotation.

In some embodiments, the ribs may comprises an elastomeric material.

In some embodiments, the ribs may be moveable with respect to the outer wall.

In some embodiments, the ribs may be retractable.

In some embodiments, the ribs may be longitudinally moveable with respect to the physical filtration member.

In some embodiments, the first end of the ribs may be positioned closer to inlet end and second end of the ribs may be positioned closer to the opposed end.

In some embodiments, the ribs may extend generally longitudinally.

In some embodiments, the at least a portion of the outer wall that is porous may comprise a screen.

In some embodiments, the outer wall may comprise a screen.

In some embodiments, the physical filtration member may comprise a conical section and the ribs are provided on the conical section.

In some embodiments, the cyclone air outlet may comprise the physical filtration member.

In some embodiments, the physical filtration member may extend from the cyclone air inlet end of the cyclone chamber towards the opposed end of the cyclone chamber.

In some embodiments, the opposed end may be openable.

In some embodiments, a portion of the downstream side may be spaced from and face towards the outer wall.

In some embodiments, the radial inner side of the ribs may be positioned outwardly from the outer wall.

In some embodiments, the radial inner side of the ribs may be spaced from and faces the outer wall.

In some embodiments, the ribs may comprise elongate members that extends outwardly from the outer wall in the direction of rotation.

In some embodiments, at least a portion of the downstream side of the ribs may be radially spaced from the portion of the outer wall that is porous.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1A:
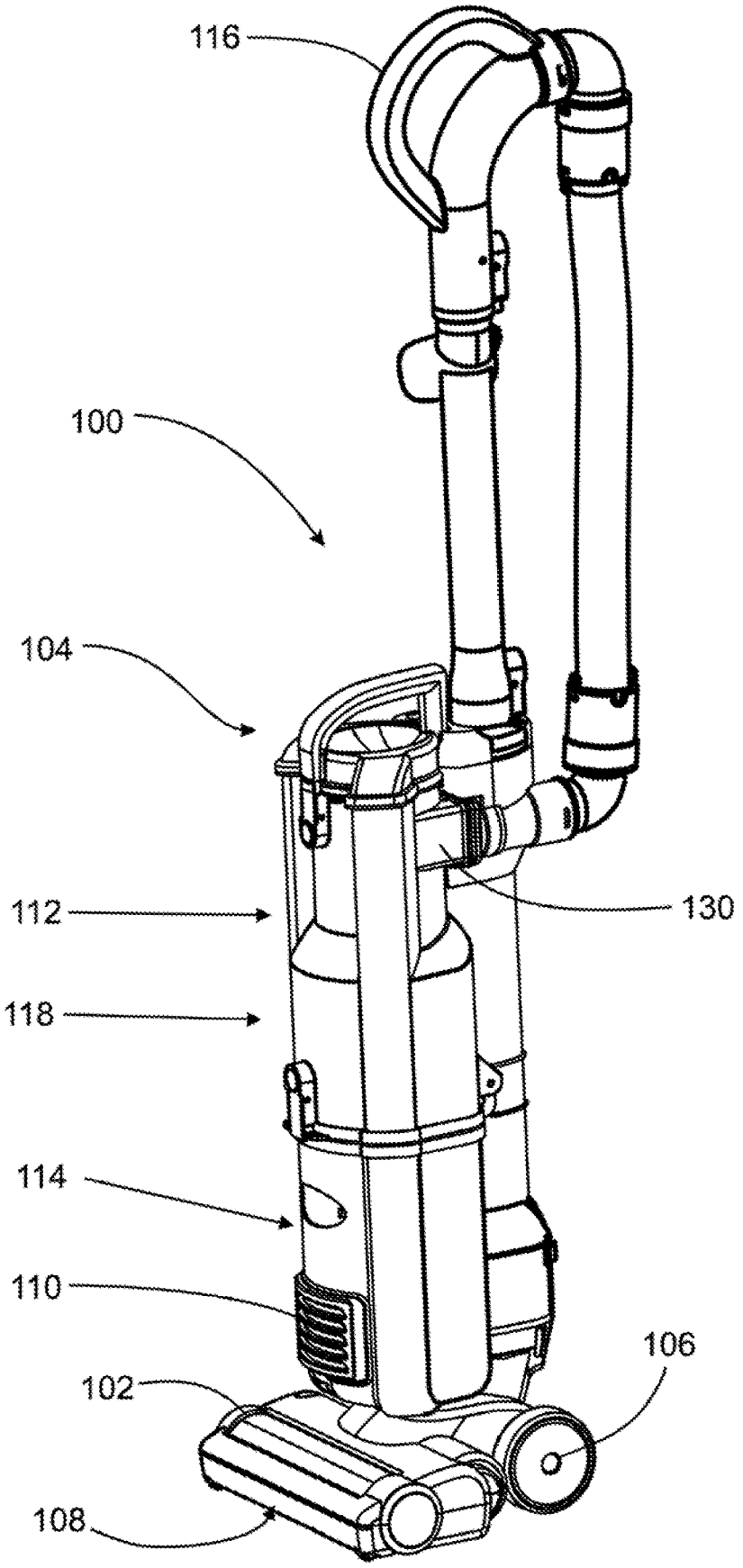
FIG. 1A is a perspective view of an embodiment of a surface cleaning apparatus.

The drawings included herewith are for illustrating various examples of articles, methods, and apparatuses of the teaching of the present specification and are not intended to limit the scope of what is taught in any way.

DETAILED DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Surface Cleaning Apparatus

Figure 1B:
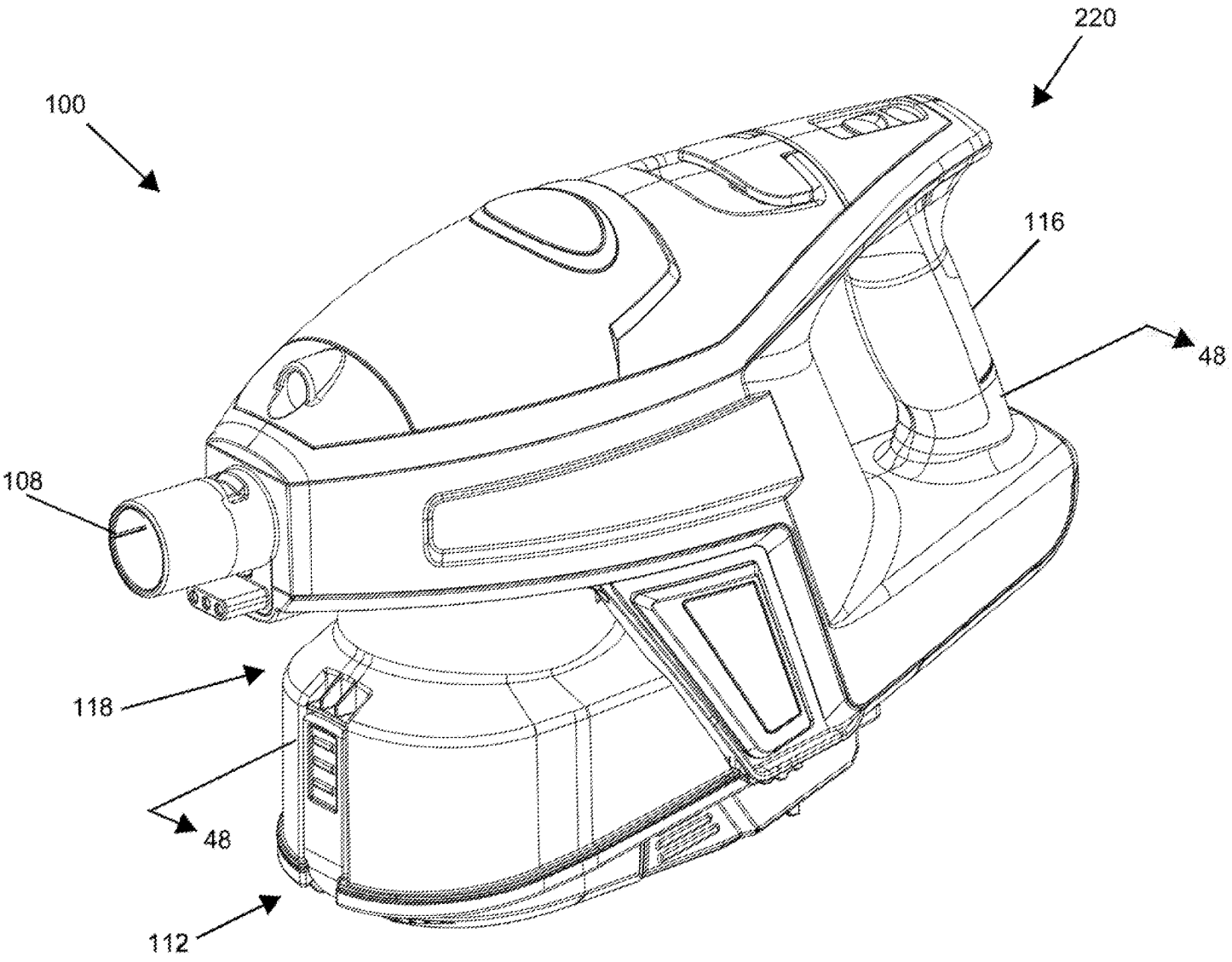
FIG. 1B is a perspective of an alternative embodiment of the surface cleaning apparatus.
Figure 2:
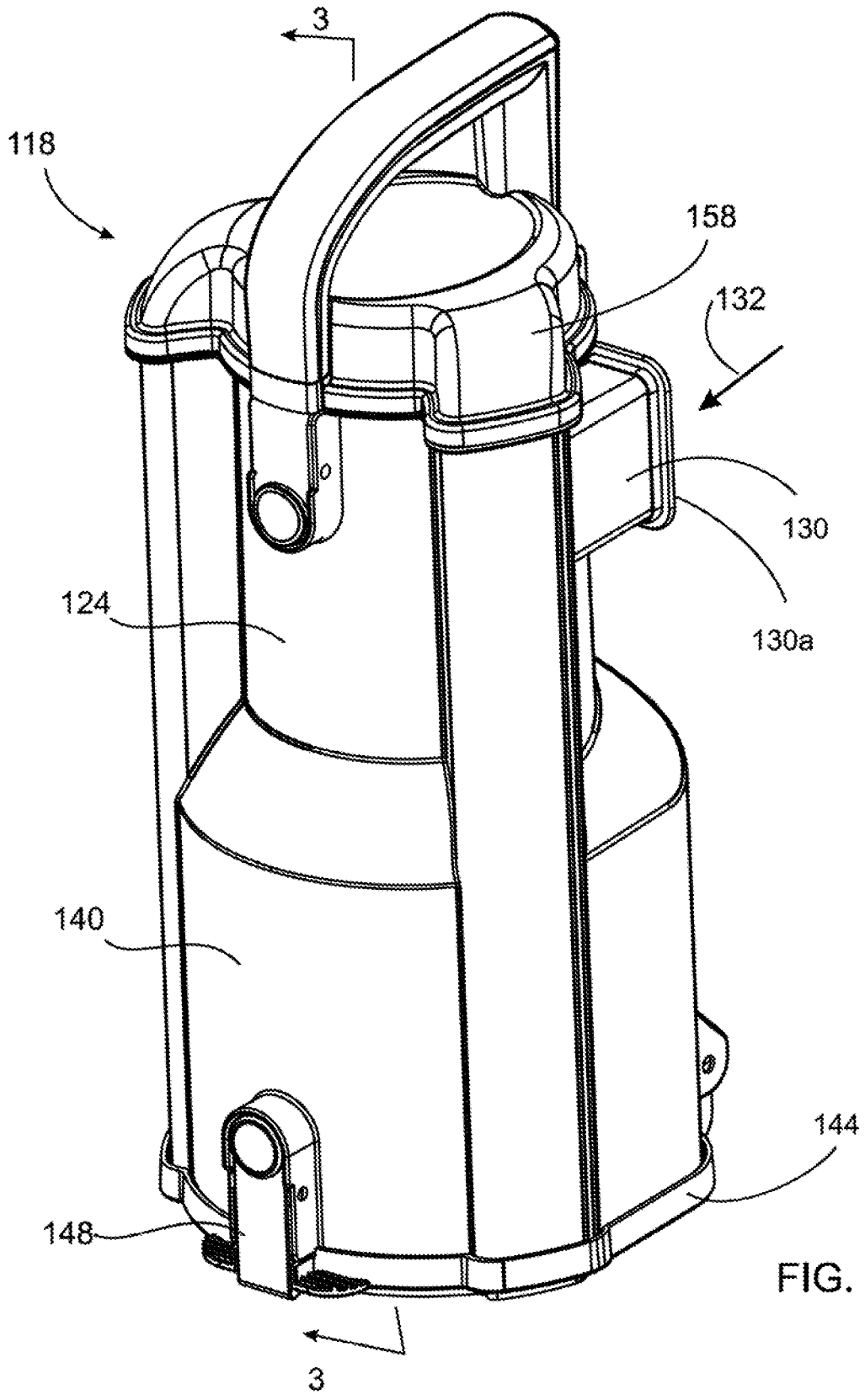
FIG. 2 is a perspective view of a cyclone bin assembly useable with the surface cleaning apparatus of FIG. 1.

Referring to FIG. 1A, an embodiment of a surface cleaning apparatus 100 is shown. In the embodiment illustrated, the surface cleaning apparatus 100 is a full size upright vacuum cleaner. In alternate embodiments, the surface cleaning apparatus may be another suitable type of surface cleaning apparatus, including, for example, a hand vacuum cleaner, a canister vacuum cleaner, a stick vac, a wet-dry vacuum cleaner and a carpet extractor. For instance, FIG. 1B shows an alternative embodiment of the surface cleaning apparatus 100, which comprises a hand vacuum cleaner.

The surface cleaning apparatus 100 may comprise an electrical cord to connect to an external power source, including, for example, a standard electrical outlet. Alternatively, or in addition to being connectable to an external power source, the surface cleaning apparatus 100 may comprise an onboard power source, including, for example one or more batteries. Optionally, the on board battery may be rechargeable, preferably while mounted to the surface cleaning apparatus 100.

As exemplified in FIG. 1A, the surface cleaning apparatus 100 includes a surface cleaning head 102 and an upper section 104. The surface cleaning head 102 preferably includes a pair of rear wheels 106 and a pair of front wheels (not shown) for rolling across a surface and a dirty air inlet 108 towards the front. The upper section 104 is moveably connected to the surface cleaning head 102 (e.g., pivotally mounted) between an upright storage position and an inclined in use position. It will be appreciated that the cleaning head and upright section may be of any design known in the art.

An air flow passage extends from the dirty air inlet 108 to a clean air outlet 110, which is preferably provided on the upper section 104. A handle 116, which is preferably connected to the upper section 104, is provided for manipulating the surface cleaning apparatus 100.

Preferably, as exemplified, the upper section 104 comprises an air treatment housing 112 and a suction motor housing 114. The air treatment housing 112 houses an air treatment member, which is positioned in the air flow passage downstream from the dirty air inlet 108, to remove dirt particles and other debris from the air flowing through the air flow passage. In the illustrated example, the air treatment member comprises a cyclone bin assembly 118 comprising a cyclone chamber 120 and a dirt collection chamber 122. The air treatment member may also comprise one or other air treatment members such as one or more cyclones or filters.

A hose 119 may be positioned in the air flow passage upstream of the cyclone bin assembly 118. As shown, the hose 119 may have a round cross-sectional shape.

The suction motor housing 114 is configured to house a suction motor (not shown). Preferably, as exemplified, the suction motor is in air flow communication with the air flow passage, downstream from the cyclone bin assembly 118. Air exiting the cyclone bin assembly 118 may flow into a suction motor and exit the surface cleaning apparatus via the clean air outlet 110. The suction motor is preferably provided below the cyclone air outlet.

As exemplified in FIGS. 2-5, the cyclone bin assembly 118 comprises a cyclonic chamber 120 and a separate dirt collection chamber 122 exterior to the cyclone chamber. The cyclone chamber and the dirt collection chamber may be of any configuration and may be in any orientation.

Air circulating within the cyclone chamber 120 enters via a cyclone or tangential air inlet 130 (which has an inlet end 130*a* and an outlet end 130*b*) and exits via a cyclone air outlet. As exemplified, cyclone chamber 120 is an upright cyclone chamber (e.g., the air enters and exits at the upper end of the cyclone chamber and the separated dirt exits at the lower end). In an alternate embodiment, the cyclone may be an inverted cyclone chamber (e.g., the air enters and exits at the lower end of the cyclone chamber and the separated dirt exits at the upper end). It will be appreciated that the air inlets and air outlets may be of various known designs.

As exemplified, the cyclone chamber 120 comprises a sidewall 124, a first (e.g., upper) end wall 126, an opposed second (lower) end wall or floor 128 and a longitudinal axis 138. A tangential or cyclone air inlet 130, in air flow communication with the dirty air inlet 108, is provided, preferably in the sidewall 124 for receiving a particle laden fluid stream, represented by arrow 132. As the fluid stream 132 circulates within the cyclone chamber 120, dirt particles and other debris may be disentrained from the fluid stream 132. Dirt particles and other debris separated from the fluid stream 132 may exit the cyclone chamber 120 through a dirt outlet 134, and are collected in the dirt collection chamber 122. The cyclone chamber 120 is exemplified in an upright configuration (e.g., e.g., the cyclone axis 138 extends generally vertically). However, it will be appreciated that the cyclone chamber may be provided in various orientations.

Preferably, the dirt outlet 134 comprises a gap provided between the sidewall 124 of the cyclone chamber 120 and the second (lower) end wall 128. The gap may extend part way or all the way around sidewall 124. Preferably, as exemplified, the dirt outlet comprises a slot 136 that extends part way around sidewall 122 between the end of sidewall 124 facing second end wall 128 and the second end wall 128. Debris separated from the air flow in the cyclone chamber 120 may travel from the cyclone chamber 120, through the dirt outlet 158 to the dirt collection chamber 122. Alternately, for example, the dirt outlet may be an opening in the second end wall or floor 128 and a plate may be provided at or facing the opening.

As exemplified, the dirt collection chamber 122 is separate from and positioned below the cyclone chamber 120. It will be appreciated that, in alternate designs, the dirt collection chamber may be internal to the cyclone chamber (e.g., it may comprise the bottom section of a cyclone chamber) or it may be positioned beside the cyclone chamber.

As exemplified, the dirt collection chamber 122 comprises a sidewall 140, a first end wall 144 and an opposed second end wall or floor 144. The dirt collection chamber may be emptyable by any means known in the art. For example, an end wall may be openable (e.g., moveable to an open position or removably mounted). Preferably, the floor 144 is pivotally connected to the dirt collection chamber 122, such as by hinges 146, and may be rotated between a closed position (FIG. 2) and an open position (not shown). The floor 144 can be held in the closed position by any means known in the art, such as a releasable latch 148, or other suitable closure mechanism.

The cyclone chamber may be openable concurrently with the dirt collection chamber. As exemplified, the floor 128 of the cyclone chamber may be movable with the floor of the dirt collection chamber 144 to allow dirt retained in the cyclone chamber 120 to be emptied when the dirt collection chamber 122 is opened. In the illustrated example, the floor 128 of the cyclone chamber 120 is supported above the floor 144 of the dirt collection chamber 122 on a support member 150.

Figure 5:
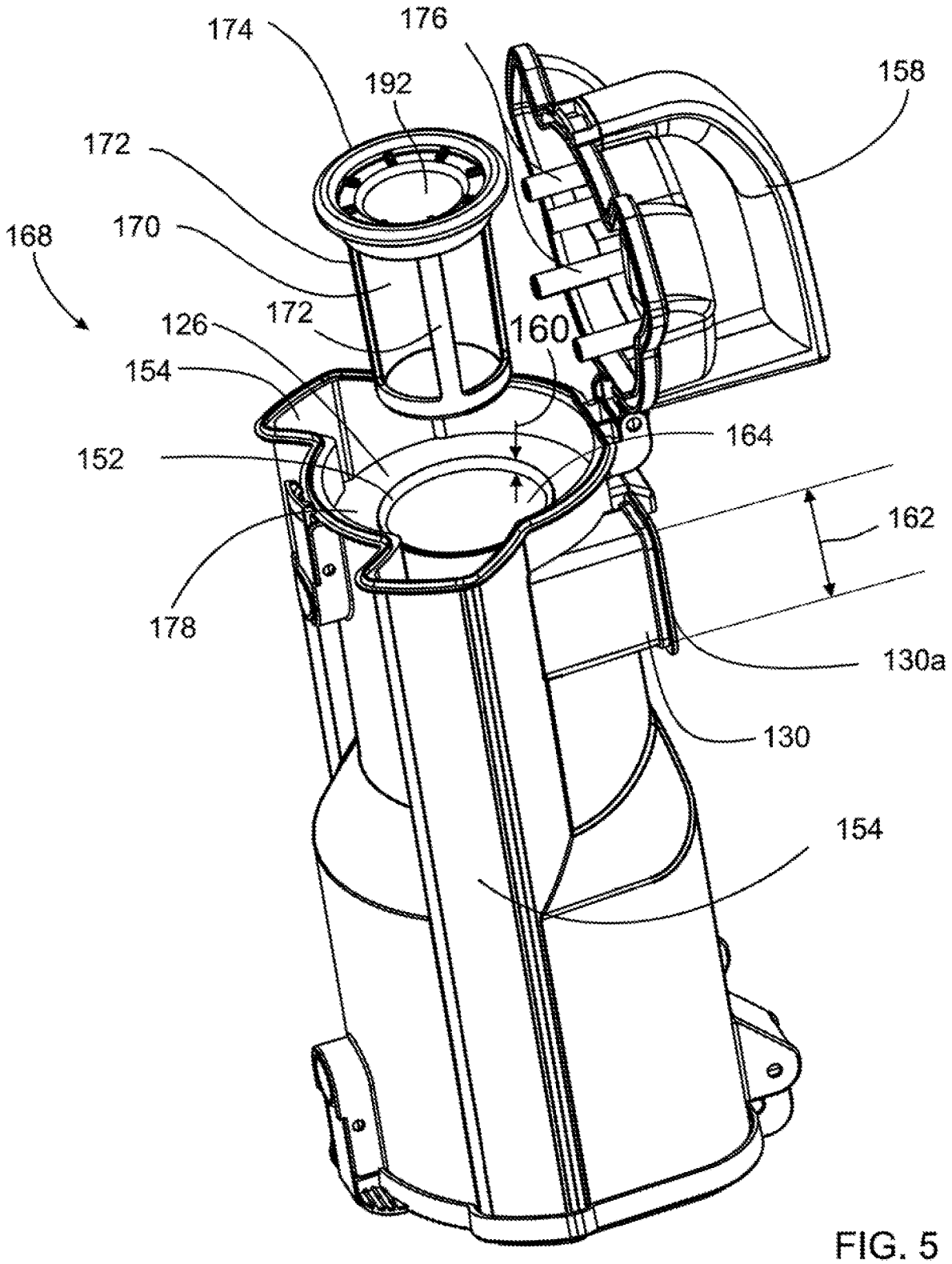
FIG. 5 is the perspective view of FIG. 4, with the screen removed and with the mesh removed.
Figure 6:
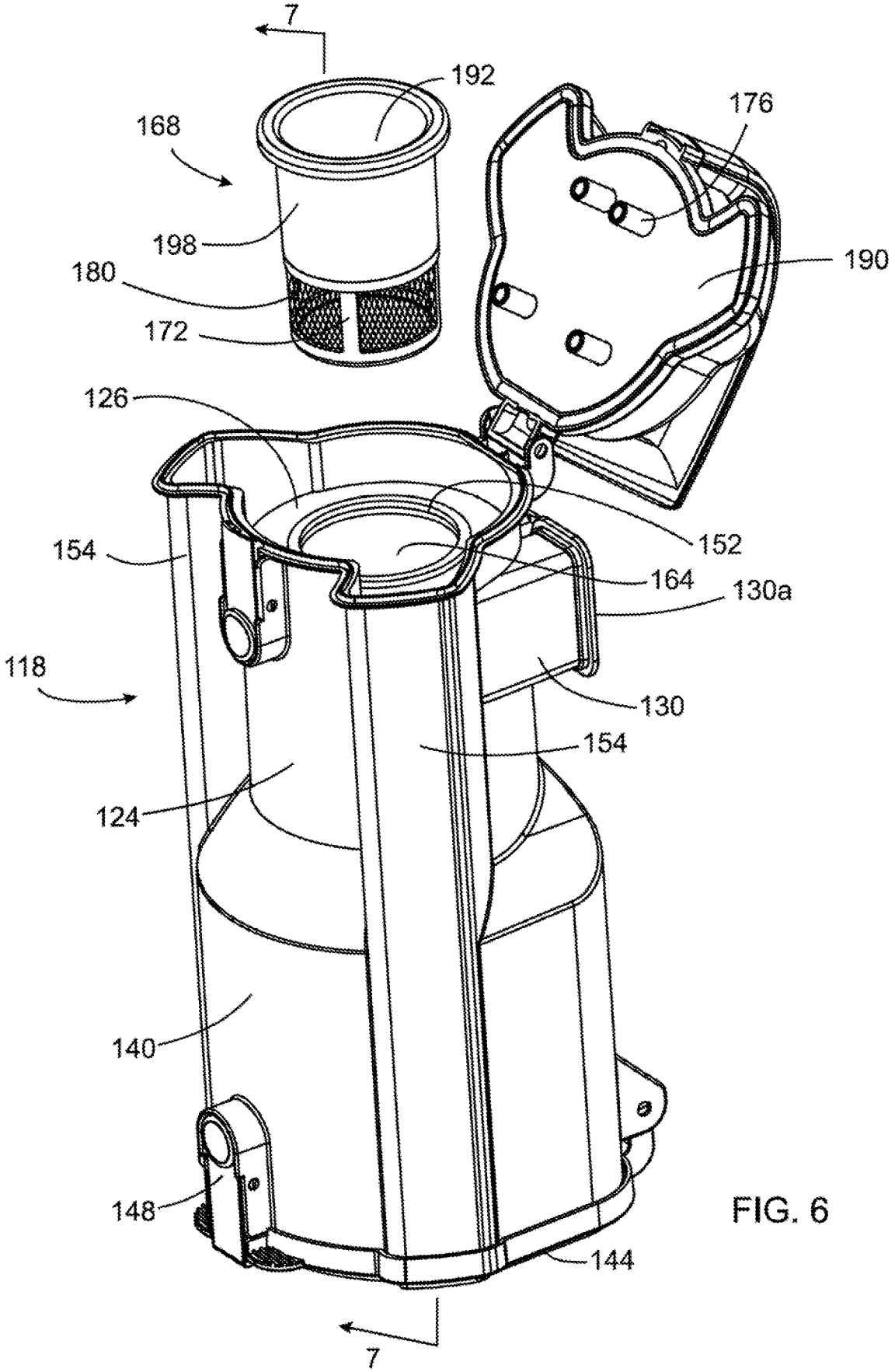
FIG. 6 is the perspective view of the cyclone bin assembly of FIG. 2, with an alternate screen removed.
Figure 7:
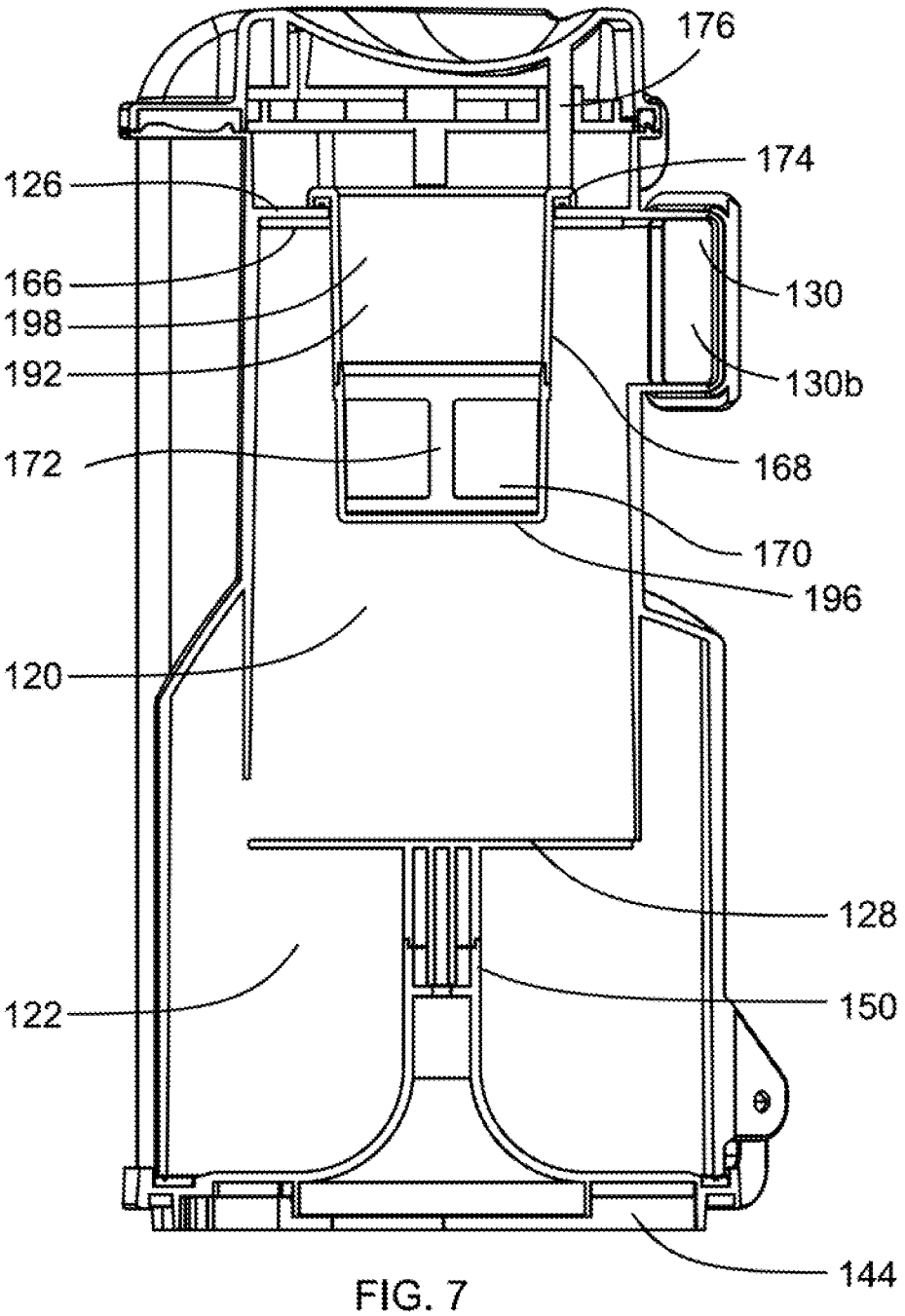
FIG. 7 is a section view of the cyclone bin assembly of FIG. 6, taken along line 7-7 in FIG. 6 with the mesh removed from the screen.

As exemplified in FIG. 5, the cyclone air outlet comprises an opening 152 in the first end wall 126 of cyclone chamber 120, which has a thickness 160. A physical filtration member, such as a screen 168 is positioned to cover opening 152. Opening 152 is in airflow communication with, preferably, a pair of external outlet down ducts 154. In the illustrated example, the passage 152 and down ducts 154 are in airflow communication by an air outlet chamber or plenum 156 that is located between the first end wall 126 of the cyclone chamber 120 and the inner surface 190 of the lid 158. The downstream ends of the down ducts 154 are in fluid communication with the suction motor. It will be appreciated that the passage from the cyclone outlet to the clean air outlet may be of various configurations and may include one or more filters as is known in the art.

In one aspect of this disclosure, the cyclone air outlet has an absence of a vortex finder. Accordingly, the cyclone air outlet is defined by opening 152 in the first end wall 126 that is covered by screen 168. Preferably, as exemplified, the screen 168 has an interior volume 192 that is fully open. As such, the screen does not have a conduit or other structure that extends from end wall 126 downwardly into interior volume 192 of screen 168. Air with enters the interior volume 192 may flow unimpeded through opening 152.

Figure 3:
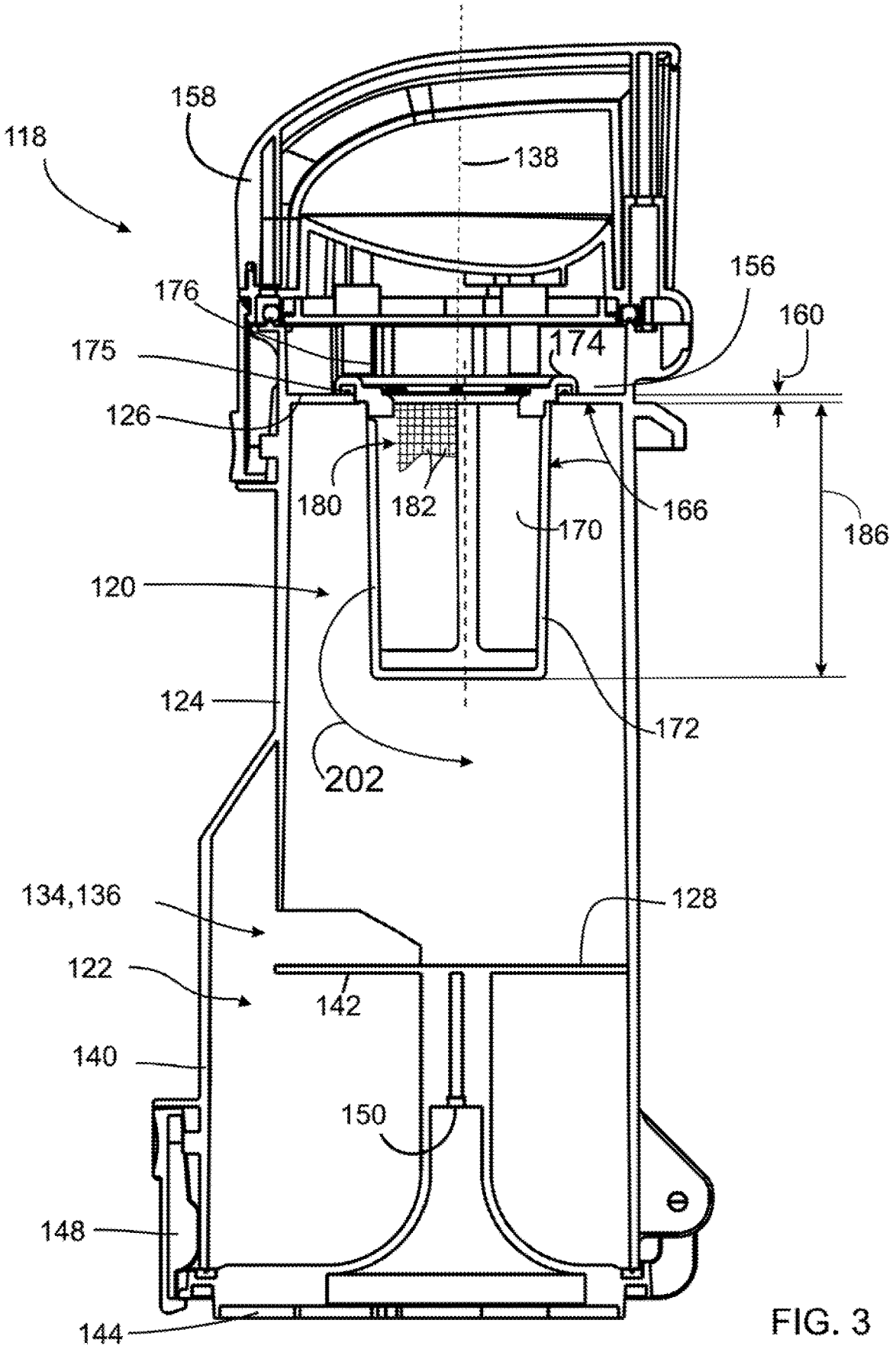
FIG. 3 is a section view of the cyclone bin assembly of FIG. 2, taken along line 3-3 in FIG. 2 with part of the mesh removed.
Figure 4:
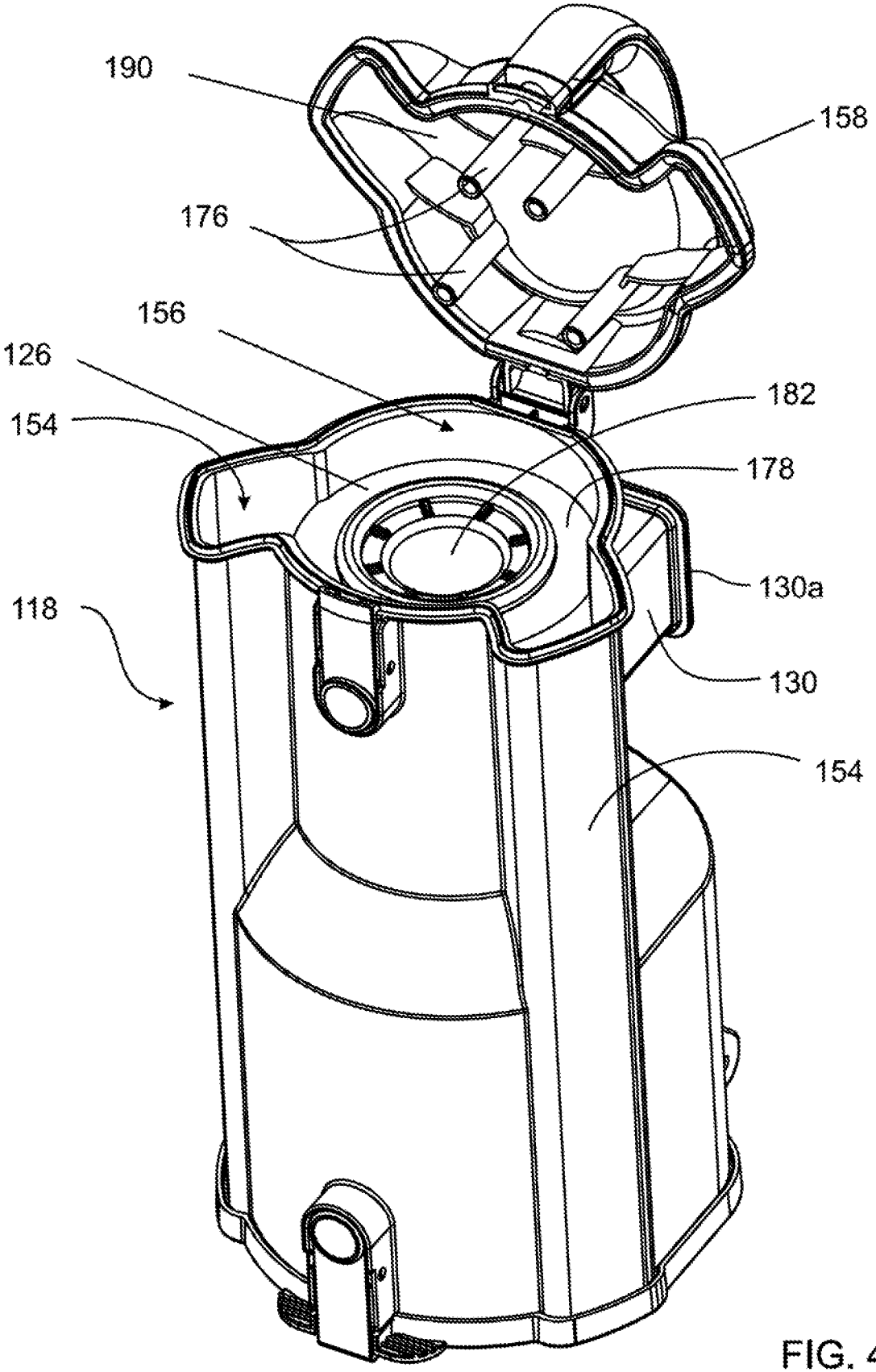
FIG. 4 is a top perspective view of the cyclone bin assembly of FIG. 2, with its lid open.

Referring to FIGS. 3 and 5, the opening 152 defines a passage 164 that has a passage height 160, measured parallel to the cyclone chamber axis 138. Conventional cyclone chamber designs include a generally elongate outlet passage that may extend into the interior of the cyclone chamber to a position substantially below the lower extent of the cyclone air inlet. Such air outlet passages have a solid, fluid impermeable wall, and are commonly referred to as vortex finders.

In accordance with another aspect of this disclosure, unlike conventional cyclone chamber designs, the height 160 of the air outlet passage 164 may be selected so that the walls of the outlet passage 164 do not substantially extend into the interior of the cyclone chamber 120. Preferably, the height 160 of outlet passage 164 may be selected to be less than the height 162 of the cyclone air inlet 130 and is preferably less than half the height 162 and more preferably less than a third of the height. As such, if a conduit extends into the screen 168 to define a longer passage 164, it may comprise a collar depending downwardly from inner surface 166 of first end wall 126.

More preferably, a collar is not provided so that outlet passage 164 does not extend beyond the inner surface 166 of the first end wall 126 (i.e., it does not extend into the interior volume 192 of screen 168). In the illustrated example, the height 160 is less than height 162, and is generally equal to the thickness 168 of the end wall 126. Reducing the height 160 of the outlet passage 164 may help reduce energy losses as air exits the cyclone chamber 120, which may help increase the efficiency of the surface cleaning apparatus 100.

Physical Filtration Member

The following is a description of a physical filtration member that may be used by itself in any surface cleaning apparatus or in any combination or sub-combination with any other feature or features described herein.

The physical filtration member (e.g., screen 168) may help prevent elongate material such as hair and larger dirt particles from exiting the cyclone chamber 120 via the opening 152. The physical filtration member 168 may be any member that includes one or more porous sections through which air flows as it exits the cyclone chamber. The physical filtration member 168 may extend any desired distance into the cyclone chamber from a mounting end (e.g. top) of the cyclone chamber.

The physical filtration member 168 may be any member that includes one or more porous sections through which air flows as it exits the cyclone chamber. The physical filtration member 168 may have a single porous region or it may have multiple porous regions. For example, physical filtration member 168 may be a shroud (e.g., a molded plastic member having a plurality of openings or perforations therein. Alternately, physical filtration member 168 may be a screen and comprise a mesh material. The mesh material may be self-supporting (e.g., a metal mesh). If the mesh material is not self-supporting, then a frame may be provided. For example, the frame may comprise a plurality of non-air-permeable, longitudinally extending frame members 172, which may be considered ribs, wherein a plurality of windows or openings are defined between adjacent frame members 172. Each opening may be covered by a screen or mesh material 180.

It has been discovered that, for example, for certain air flows having certain flow properties, the fluid permeable screen 168 can be used in place of a traditional, non-permeable vortex finder to help facilitate the cyclonic air flow pattern within the cyclone chamber 120. For example, it has been discovered that if the surface cleaning apparatus 100 operates with a given combination of operating power and air flow rate, positioning the screen 168 within the cyclone chamber 120 may be sufficient to facilitate cyclonic flow of the air, without passing directly to exit the cyclone chamber 120 via the outlet passage 152 and therefore bypassing the cyclonic cleaning stage.

For example, the use of a screen 168, as opposed to a traditional non-permeable vortex finder, is sufficient to facilitate operation of the surface cleaning apparatus 110 when the surface cleaning apparatus 100 produces approximately 50 air watts of power (or less), preferably 40 air watts of power or less and optionally 30 air watts of power or less and/or operates an air flow rate of approximately 1.3 cubic meters per minute or less, preferably 1.2 cubic meters per minute or less and optionally 1.1 cubic meters per minute or less. The suction motor used in such a surface cleaning apparatus 100 may have a power requirement of 500 watts or less, and preferably has a power requirement of less than 200 watts.

Figure 20:
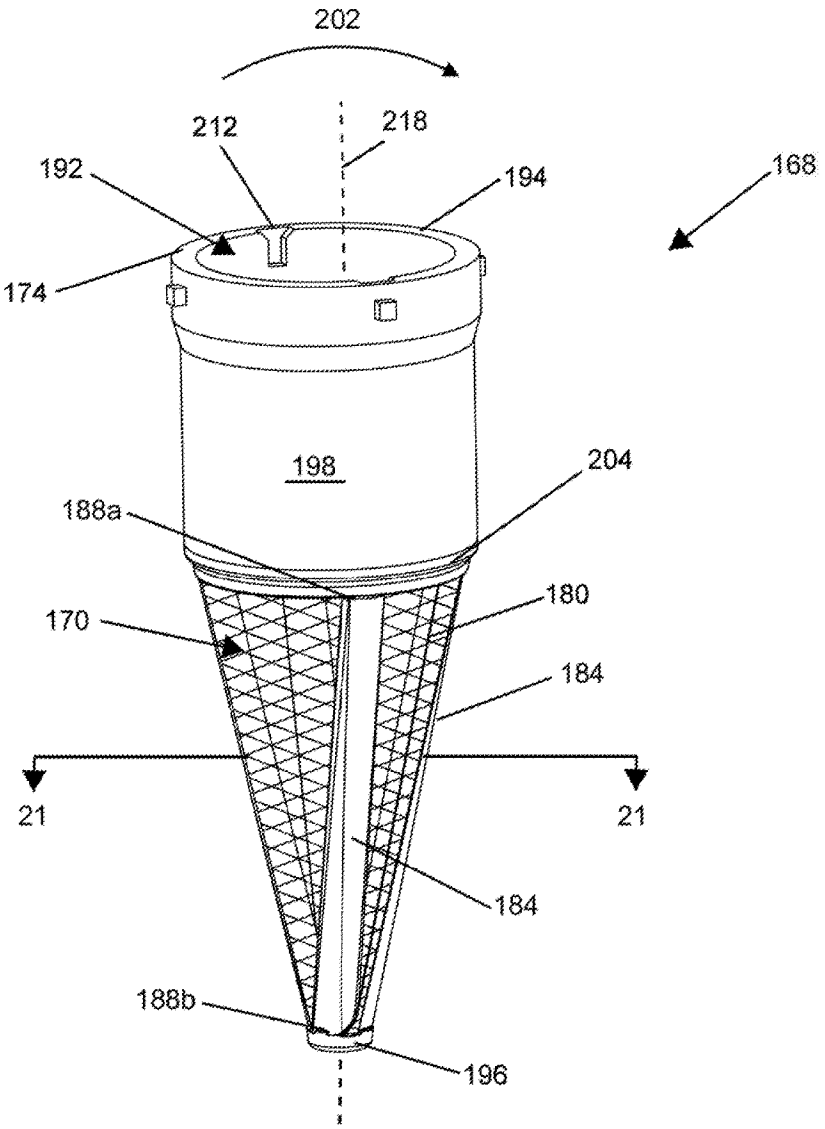
FIG. 20 is a perspective view of a further alternate screen having stationary hair wrap members.
Figure 21:
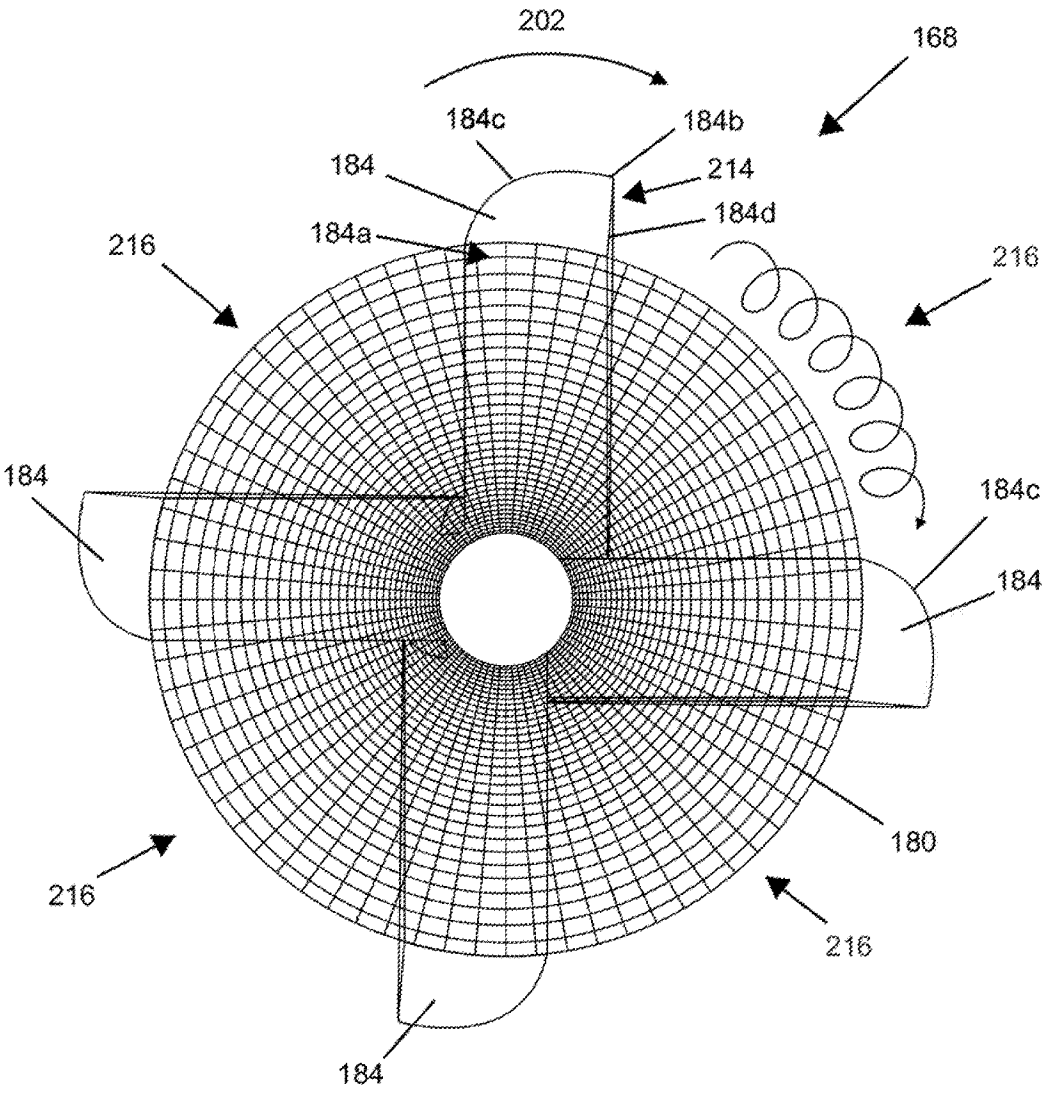
FIG. 21 is a section view of the alternate screen of FIG. 20, taken along line 21-21 in FIG. 20.
Figure 22:
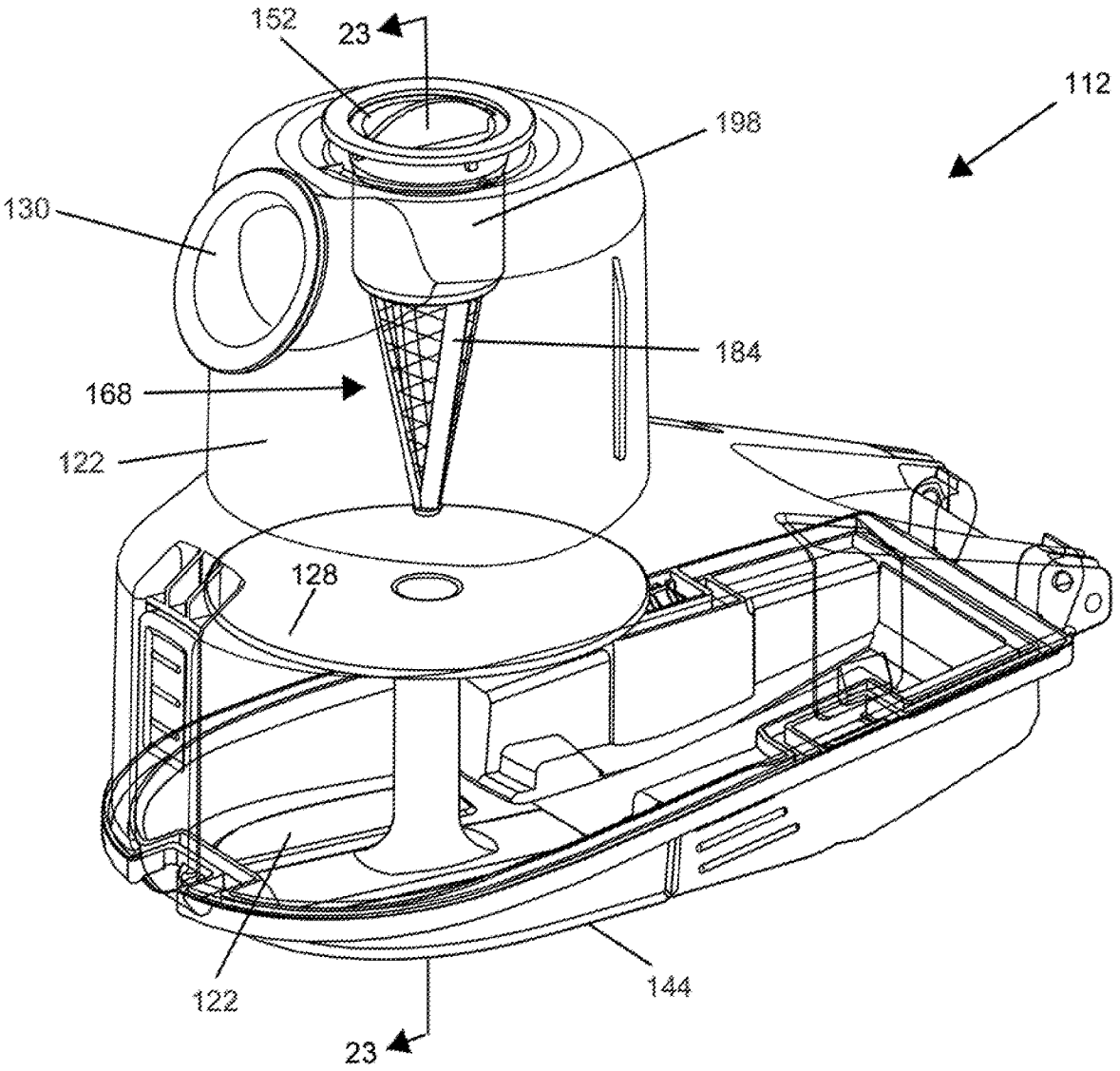
FIG. 22 is a perspective view of a cyclone bin assembly of the surface cleaning apparatus of FIG. 1B, which incorporates the screen of FIG. 20.
Figure 23:
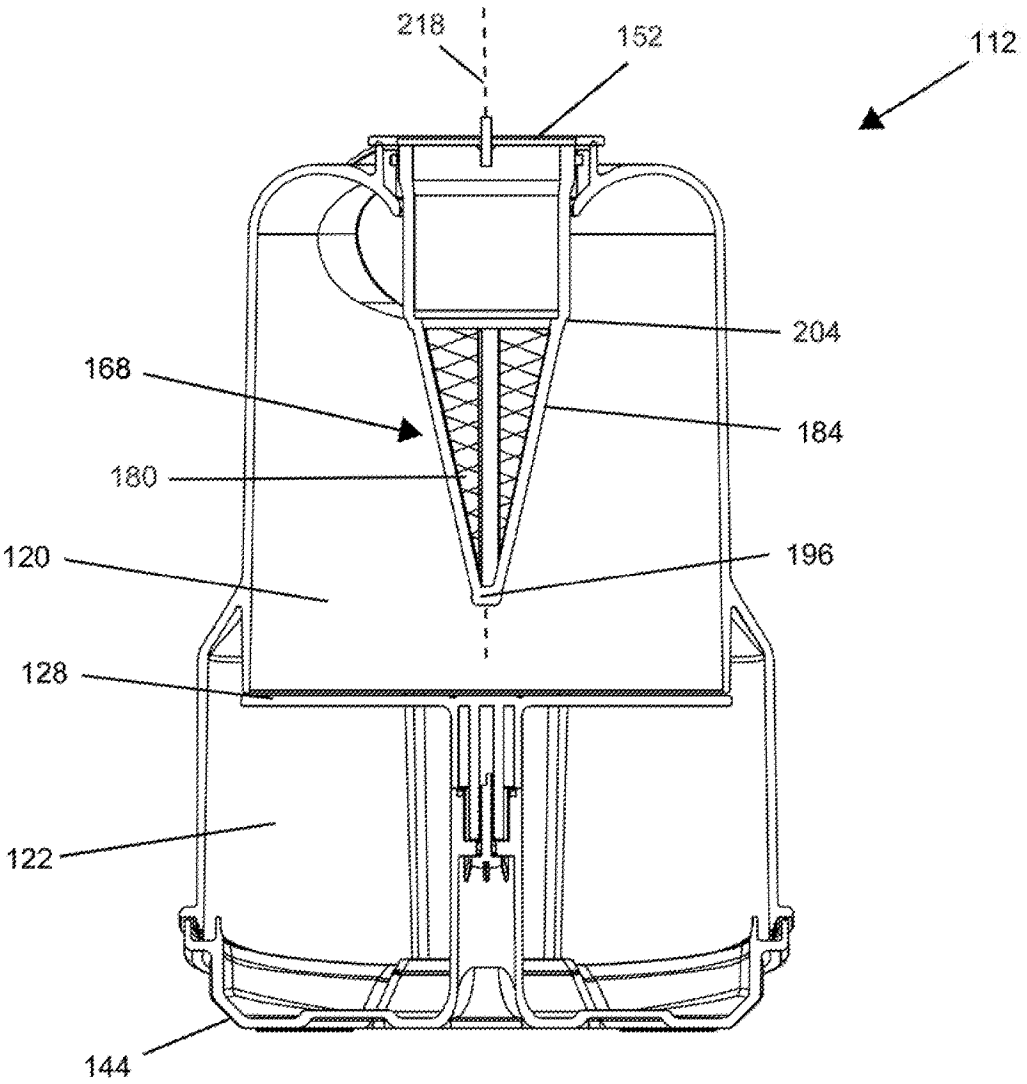
FIG. 23 is a section view of the cyclone bin assembly of FIG. 22, taken along the line 23-23 in FIG. 22.

As exemplified in FIG. 20, physical filtration member 168 comprises an outer wall 198, which may include a solid portion (e.g., a fluid non-permeable portion) and a porous portion (e.g., a fluid permeable portion). The screen 168 includes a plurality of non-permeable frame members 172 that are spaced to define the one or more fluid permeable regions, windows or openings 170 (e.g., the porous portions) of the outer wall 198. In some example embodiments, the porous portions 170 may be covered with a fluid permeable material 180 (e.g., a mesh material) extending between non-air permeable frame members 172. Preferably, as exemplified, the permeable material 180 comprises a plurality of openings 182 to allow air to flow therethrough and may be a synthetic material (e.g., plastic) or metal. The permeability of the fluid permeable regions, and the corresponding flow resistance of the screen 168, may be varied by varying the properties of the permeable material 180, including, for example the size and/or shape of the openings 182. For example, the openings 182 can be configured to have a diameter or maximum height that is less than 8 mm in size, preferably less than 6 mm, more preferably less than 4 mm and may be less than 2 mm.

Preferably, the screen 168 has a height 186, extending along a longitudinal axis 218, that is greater than the height 162 of the outlet 130*b* of the air inlet 130. Optionally, the screen 168 can be configured so that the height 186 is between about 0.5 and 4 times larger than height 162. Preferably, the height 186 is between about 1 and about 3 times the height 162 of the outlet 130*b* of the air inlet 130, and more preferably is about 2 times the height 162 of the outlet 130*b* of the air inlet 130.

Figure 8:
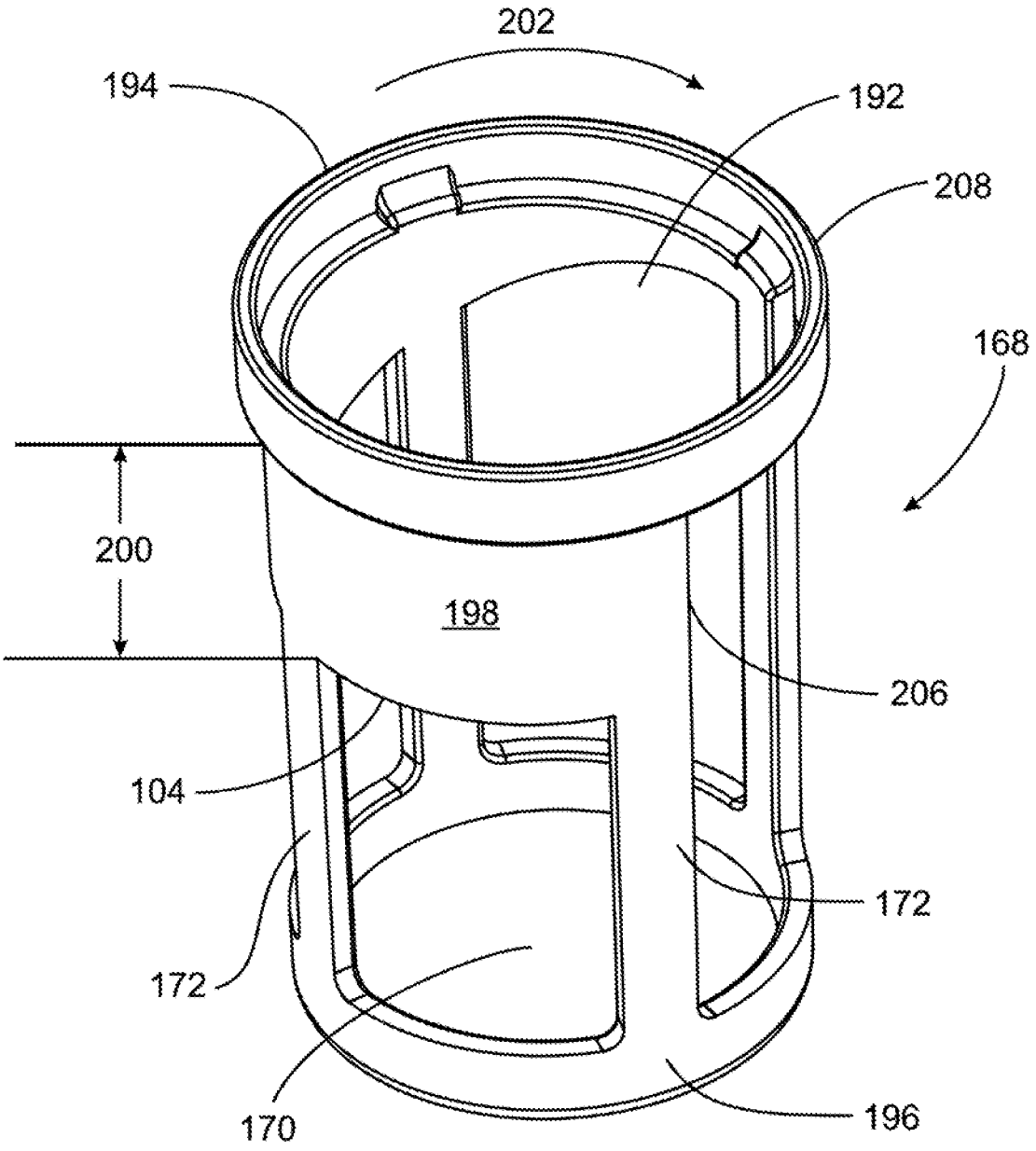
FIG. 8 is a perspective view of an alternate screen with the mesh removed from the screen.
Figure 9:
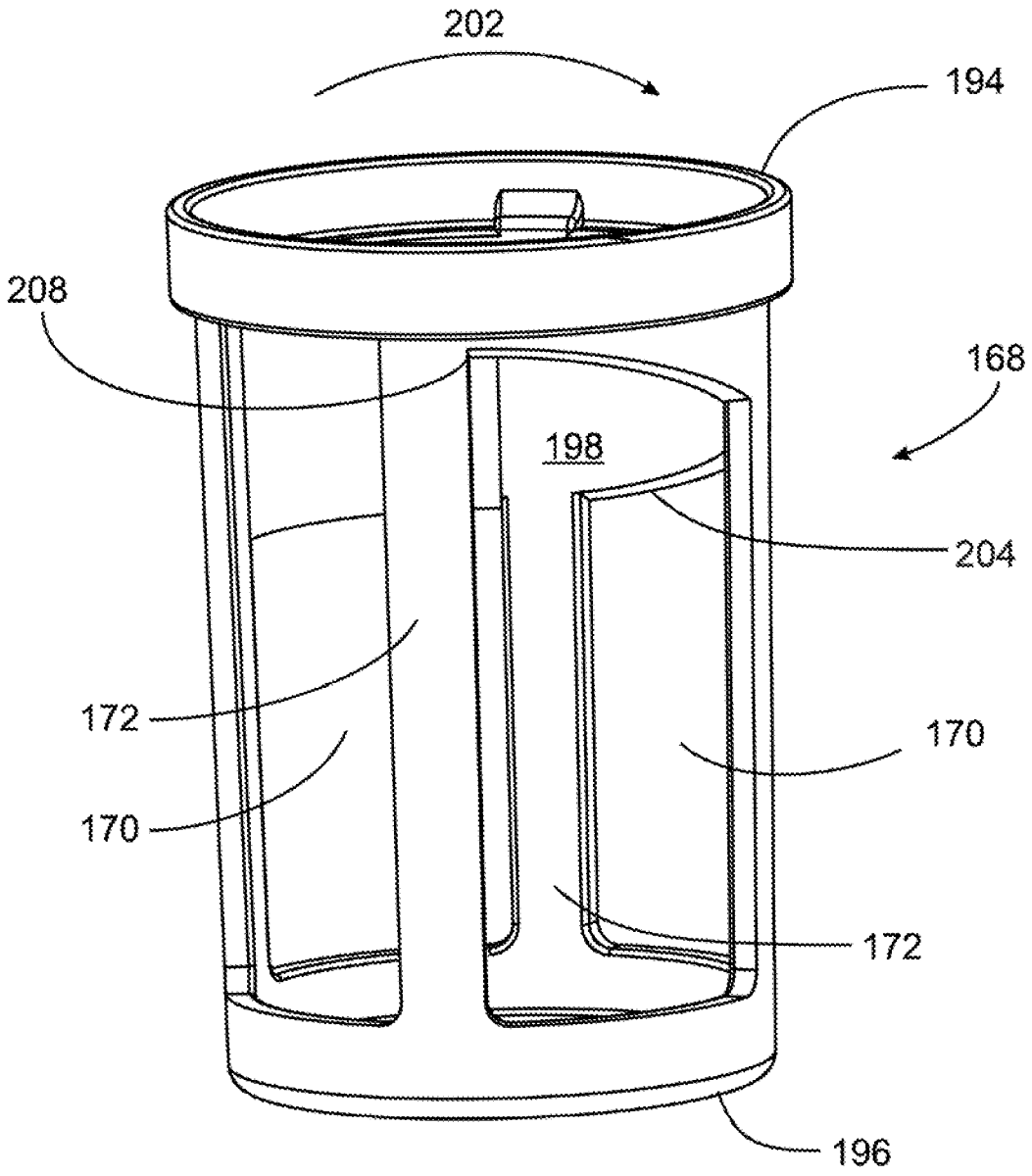
FIG. 9 is a perspective view of another side of the screen of FIG. 8 with the mesh removed from the screen.
Figure 11:
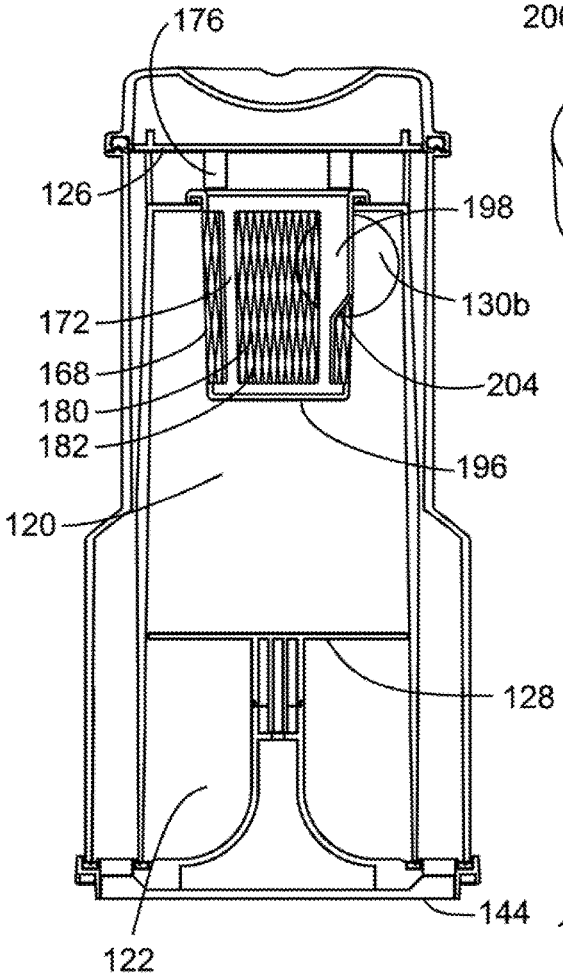
FIG. 11 is a section view of the cyclone bin assembly of FIG. 6, taken along line 7-7 in FIG. 6 and incorporating the screen of FIG. 10.
Figure 10:
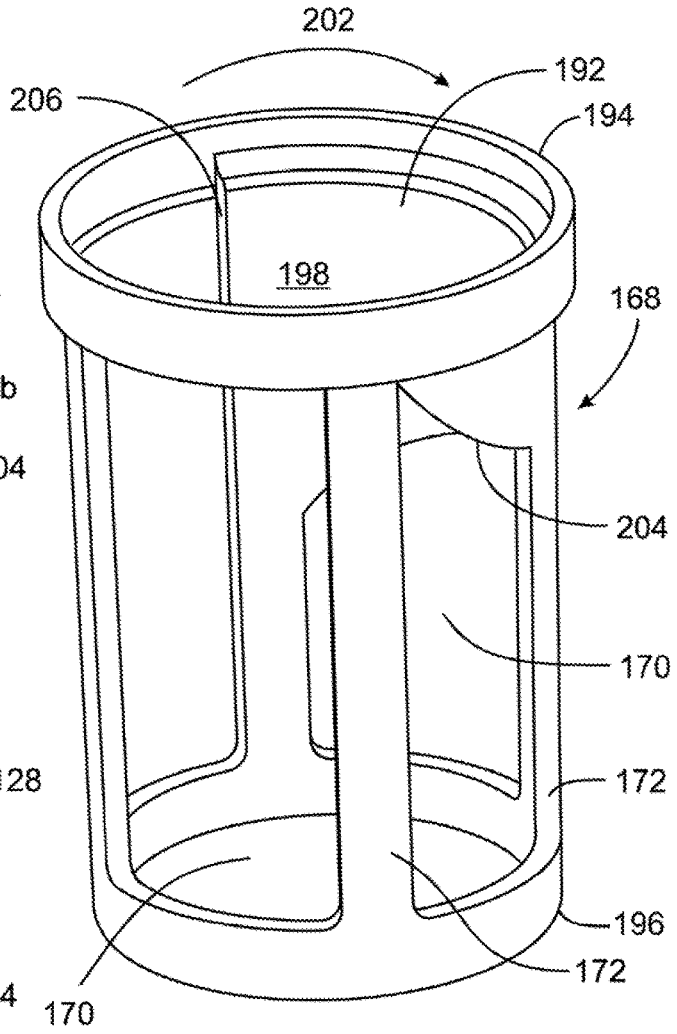
FIG. 10 is a perspective view of a further alternate screen with the mesh removed from the screen.
Figure 13:
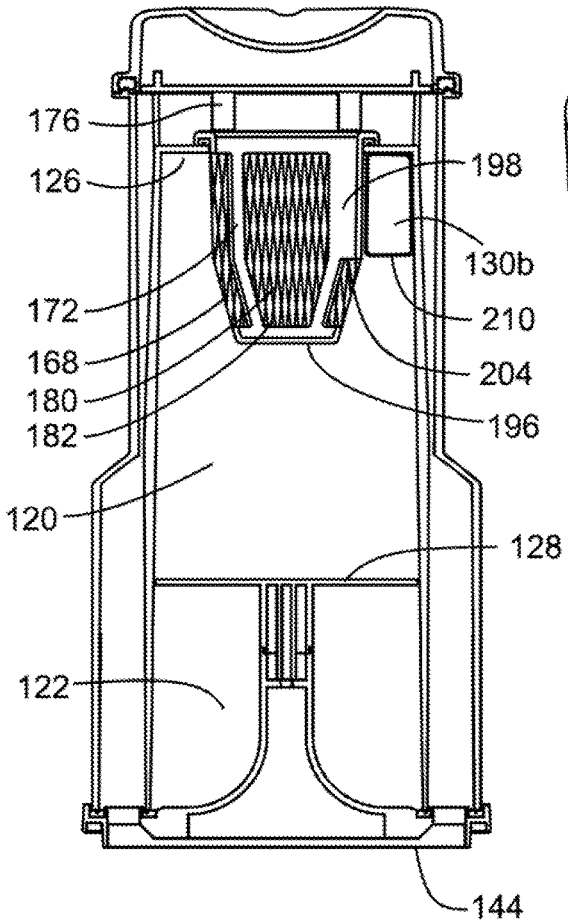
FIG. 13 is a section view of the cyclone bin assembly of FIG. 6, taken along line 7-7 in FIG. 6 and incorporating the screen of FIG. 12.
Figure 12:
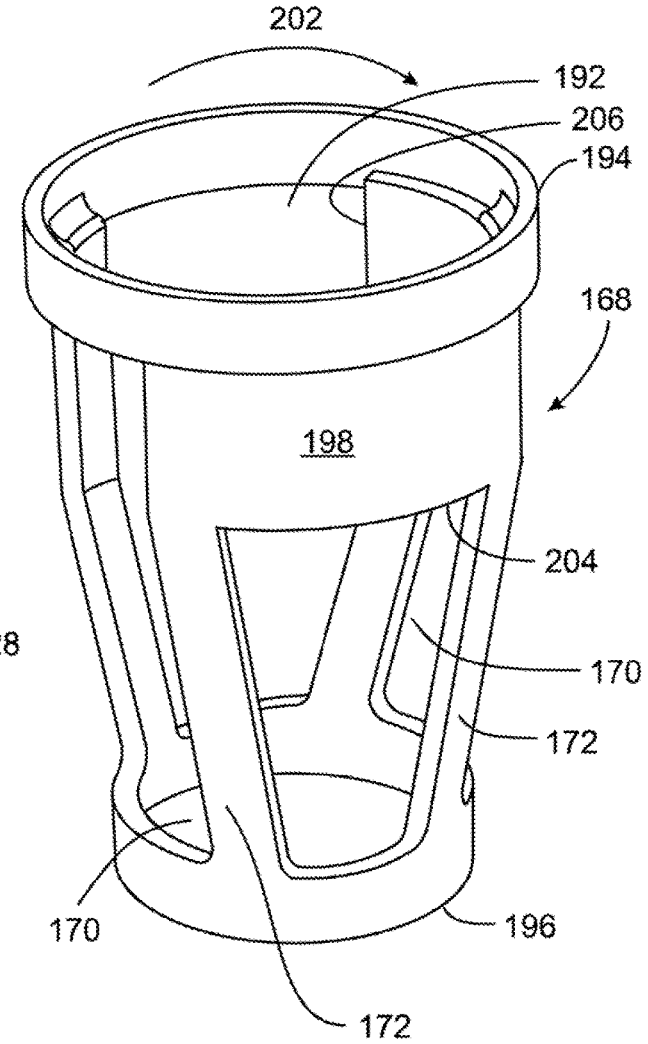
FIG. 12 is a perspective view of a further alternate screen with the mesh removed from the screen.
Figure 15:
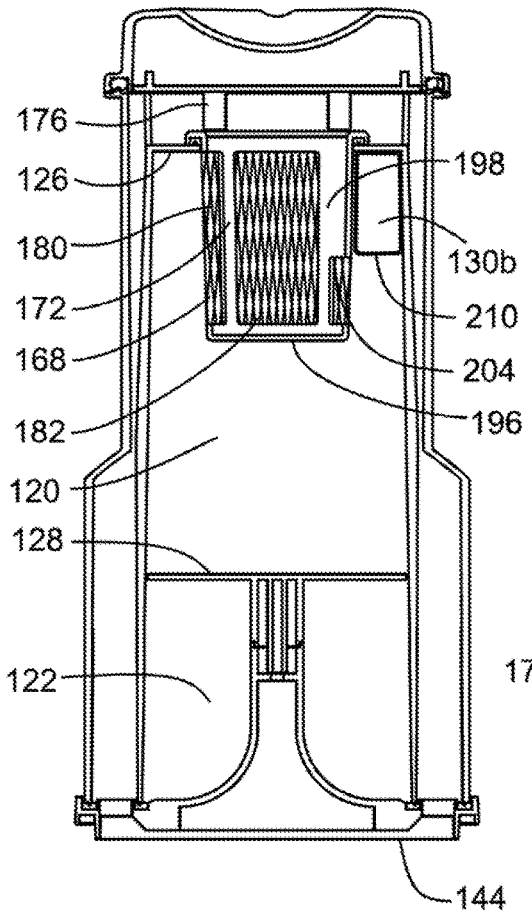
FIG. 15 is a section view of the cyclone bin assembly of FIG. 6, taken along line 7-7 in FIG. 6 and incorporating the screen of FIG. 14.
Figure 14:
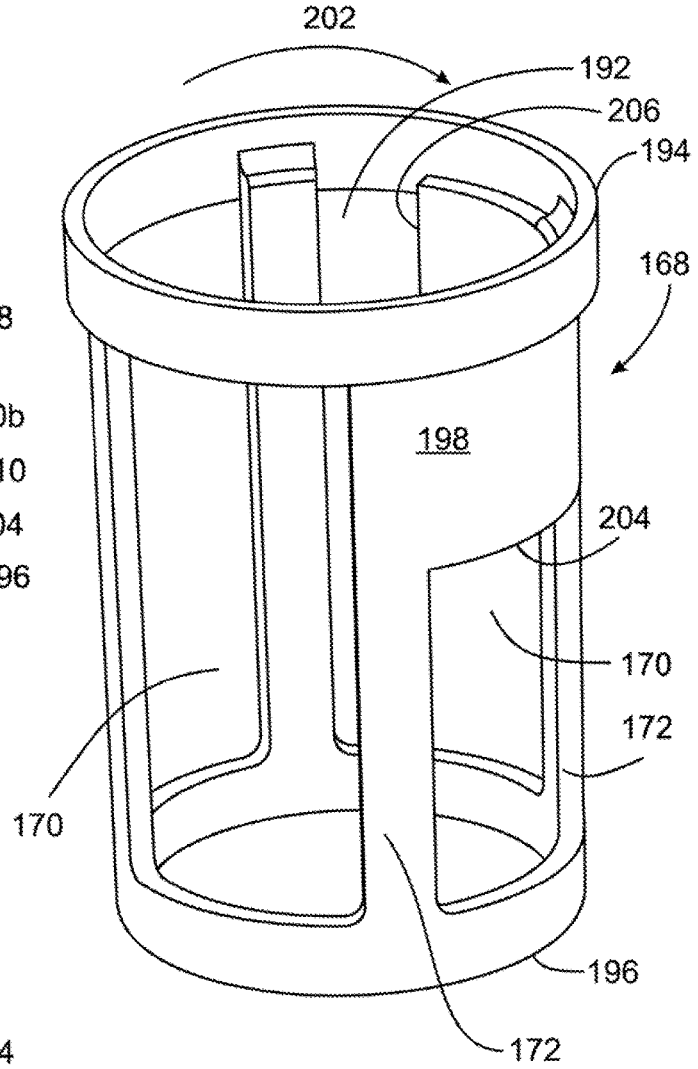
FIG. 14 is a perspective view of a further alternate screen with the mesh removed from the screen.
Figure 17:
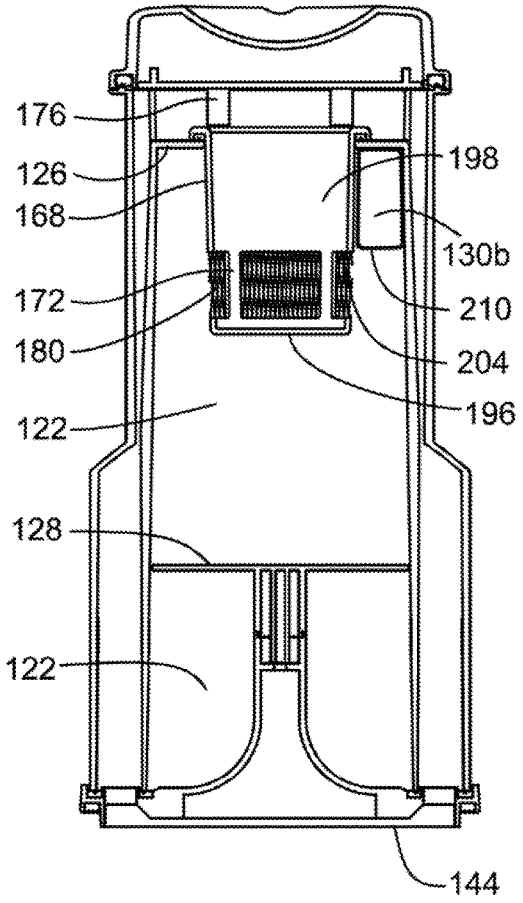
FIG. 17 is a section view of the cyclone bin assembly of FIG. 6, taken along line 7-7 in FIG. 6 and incorporating the screen of FIG. 16.
Figure 16:
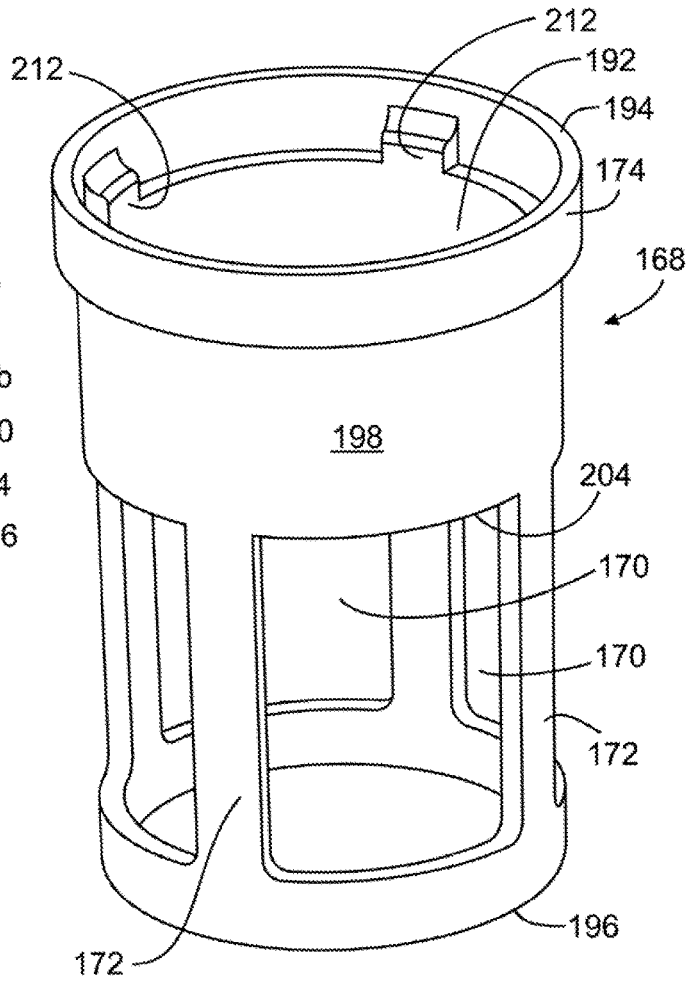
FIG. 16 is a perspective view of a further alternate screen with the mesh removed from the screen.
Figure 19:
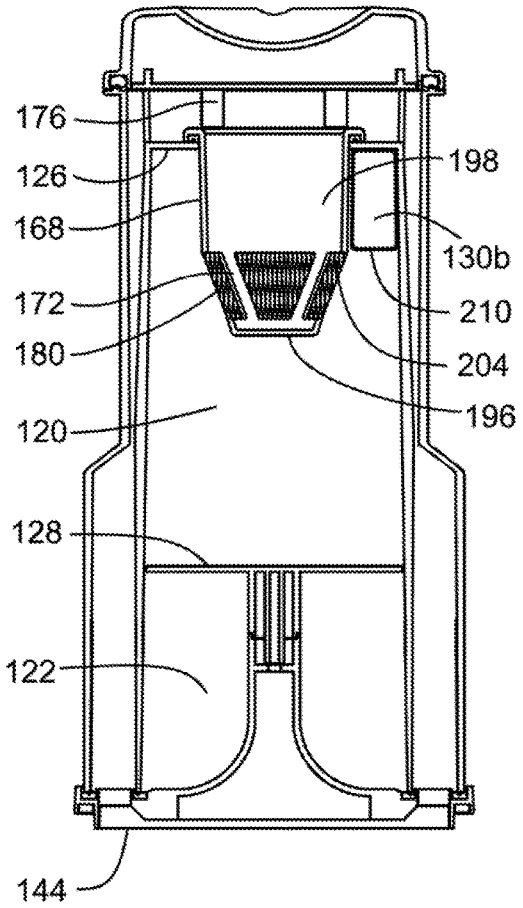
FIG. 19 is a section view of the cyclone bin assembly of FIG. 6, taken along line 7-7 in FIG. 6 and incorporating the screen of FIG. 18.
Figure 18:
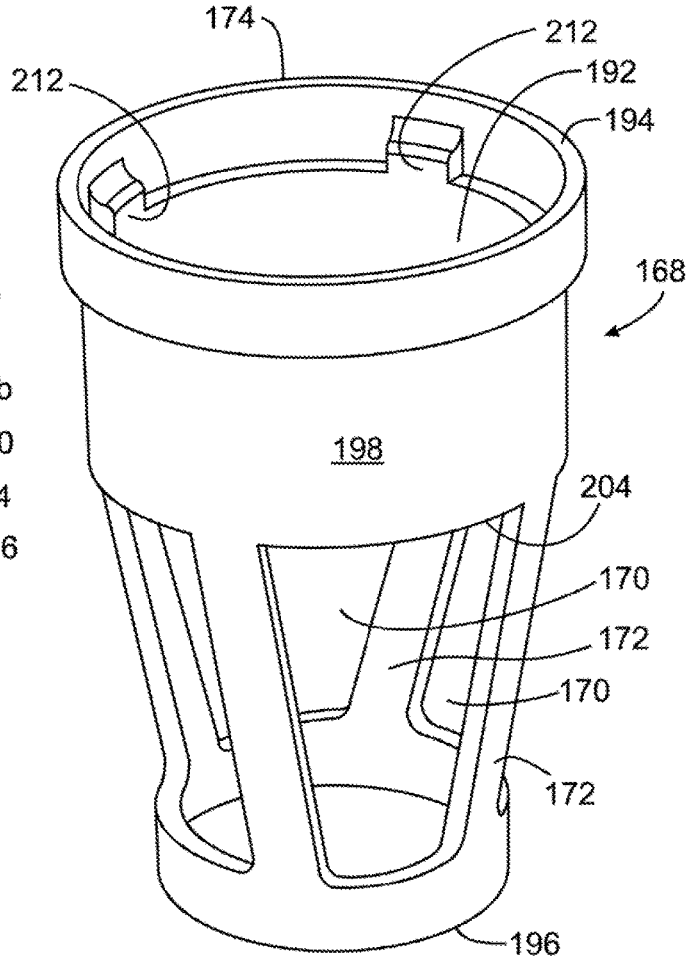
FIG. 18 is a perspective view of a further alternate screen with the mesh removed from the screen.

Referring to the screen exemplified in FIGS. 8 and 9, screen 168 is positioned in the cyclone chamber 120 upstream of the cyclone air outlet. Screen 168 has an outlet end 194 and a distal end 196 spaced from and facing the outlet end 194. The outlet end of the screen is open and defines an airflow passage, which is at least the same size as an airflow passage defined by the opening 152. For example, if the screen 168 and the outlet 152 are circular, then open end 194 may have a diameter proximate the diameter of opening 152. Therefore, the outlet end 194 of the screen 168 may be positioned adjacent the end wall 126.

Preferably, the solid portion of the outer wall 198 faces the outlet 130*b* of cyclone air inlet 130. The solid portion of the outer wall 198 may assist in preventing air bypassing cyclone chamber 120 by travelling directly to opening 152 and may assist in creating cyclonic flow in cyclone chamber 120 by defining an annular air flow passage at the upper end of cyclone chamber 120. Preferably, the solid wall 198 has a height 200 that is greater than the height 162 of the outlet 130*b* of cyclone air inlet 130.

In some embodiments, solid wall 198 may have a uniform height (see for example FIGS. 6, 7 and 12-47). In such cases, the height 200 of solid wall is preferable greater than the height of outlet 130*b* of cyclone air inlet 130. In some embodiments, solid wall 198 may extend all the way around screen 198 (see for example FIGS. 6, 7 and 16-47). In other cases, solid wall may extend only part way around screen 168 (see for example FIGS. 12-15).

In other cases, (see for example FIGS. 8-11) the height 200 of the solid wall may be variable and preferably decreases in the direction of rotation 202 of the air in cyclone chamber 120. In such a case, the height 200 of the portion of solid wall 198 facing outlet 130*b* of cyclone air inlet 130 is preferable greater than the height of outlet 130*b* of cyclone air inlet 130. For example, the height 200 of upstream end 206 of solid wall 198 is preferable greater than the height of outlet 130*b* of cyclone air inlet 130. As the air rotates in direction 202 in cyclone chamber 120, the air will move downwardly towards lower end 128 of cyclone chamber 120. Accordingly, the height of the solid wall 198 may decrease as there may not be cyclonic flow around a portion of the upper end of screen 168. For example, at a position about ½ of ¾ of the distance around screen 168 from outlet 130*b*, there may be no cyclonic flow around the upper portion of screen 168. Accordingly, solid wall 198 is not required to prevent bypass of cyclone chamber 120. Preferably, the air rotating in the direction 202 adjacent the screen has a height and the height 200 of the solid wall is greater than the height of the air. As exemplified in FIGS. 8 and 9, the height 200 of solid wall 168 decreases to 0 or essentially 0 at a position 208 which is about ¾ of the distance around screen 168 from outlet 130*b*. An advantage of this design is that mesh 180 may be provided in a region that would otherwise be occupied by solid wall 198, thereby increasing the mesh surface area and therefore increasing the surface area available for air to pass through to opening 198.

Accordingly, solid wall 198 may have a distal end 204 that is spaced from end wall 126 of the cyclone chamber 120 by a first distance or height 200 and the outlet 130*b* of the cyclone air inlet 130 may have a distal end 210 spaced from an end wall of the cyclone chamber 120 by a second distance or height 162 and the first distance is greater than the second distance.

The distal end 196 of screen 168 may be closed (e.g., a solid surface) but it is preferably open (e.g., covered by mesh 180).

Optionally, the lid 158 of the cyclone bin assembly 118 is openable to allow a user to remove the screen 168. In the illustrated example, the lid 158 is hinged and can pivot open to allow access to the removable of the screen 168. Alternatively, the lid 158 can be detachable or openable by any other means.

If screen 168 is removable and if solid wall 198 does not extend all around screen 168 or if it only has a portion with a height 200 greater than the height 162 of outlet 130*b*, then one or more alignment members may be provided to assist a user to reinsert screen in the correct orientation (e.g., with the portion of screen 168 that has a height 200 greater than the height 162 of outlet 130*b* facing outlet 130*b*). For example, as exemplified in FIGS. 16-47, alignment notches 212 may be provided in rim 174 of screen 168. These alignment notches 212 may mate with protrusions provided on the outer surface of end wall 126 on which rim 174 seats. In a particularly preferred embodiment, the notches 212 may be angularly spaced so that screen 168 may only be reinserted in the correct position. Any other alignment means or inter-engagement members may be sued.

Screen 168 may be of various shapes. In the illustrated example, outlet 152 and the screen 168 have generally round cross sectional shapes, and the screen 168 is received in the outlet 152. Optionally, the screen 168 may be configured to have a cylindrical shape (see FIGS. 4-11 and 14-17), or the distal end 196 of the physical filtration member 168 may be narrower than, e.g., the outlet end 194 of the physical filtration member 168. For example, the radial width of the physical filtration member may narrow continuously from the outlet end 194 to the distal end 196 and, optionally, the radial width may narrow at a continuous rate. For example, the physical filtration member may be frusto-conical or conical. Alternately, only a lower portion may narrow and may be generally frusto-conical in shape (see FIGS. 12, 13, 18 and 19) or conical in shape (see FIGS. 20-47). The physical filtration member may alternately be of any other suitable shape. As exemplified, the non-permeable frame members 172 may be accordingly provided on the lower portion of the screen 168.

The screen 168 may comprise an annular rim 174. When screen 168 is positioned in cyclone chamber 120, the rim 174 may be positioned above, and preferably rests on the upper wall 126 such that the screen 168 is suspended from the rim 174. A gasket 175 or other sealing member may be provided between the rim 174 and the upper wall 126 to help seal the rim 174 against the upper wall 126.

Optionally, if the screen 168 is removable, a member to secure the screen in portion may be provided. For example, as exemplified, the lid 158 may include one or more engagement member that can secure the screen 168 in position when the lid 158 is closed. In the illustrated example, the engagement member comprises four securing legs 176 extending from the inner surface 190 of lid 158. When the lid 158 is closed, the securing legs 176 rest on the rim 174 and press the rim 174 against the upper wall 126. Providing securing legs 176 to hold the rim 174 in place may eliminate the need to use additional fasteners or attachment members to hold the screen 168 in position. The legs 176 are preferably spaced apart from each other around the perimeter of the rim 174. Spacing the legs 176 apart from each other may help to provide a distributed holding force and may help facilitate airflow between the legs 176, from the outlet passage 152 to the outlet conduits 154. Optionally, a different number of legs 176, other type of holding structure, including for example a bayonet mount, male and female engagement members provided on screen 168 and end wall 126, or other type of fastening members can be used to hold the screen 168 in place.

In the illustrated example, the screen 168 may be received in the outlet 152 in a plurality of rotational alignment positions, and need not be oriented in a predetermined direction or alignment relative to the upper wall 126 of the cyclone chamber 120.

Optionally, some or all of the upper wall 126 of the cyclone chamber 120 may be removable with the screen 168. Removing a portion of the upper wall 126 may allow a user to access the interior of the cyclone chamber 120. Optionally, the removable portion of the upper wall 126 may be an annular band 178 that surrounds the outlet 152. Removing some or all of the upper wall 126 while the floors 128 and 144 are open may allow simultaneous access to both ends of the cyclone bin assembly 118, which may help a user to clean the interior of the cyclone bin assembly 118.

Physical Filtration Member With Hair Wrap Members

The following is a discussion of a physical filtration member having hair wrap members, which may be may be used by itself or with one or more other aspects of this disclosure.

Optionally, one or a plurality of hair wrap members may be positioned spaced from the porous section 170 (e.g., screen or mesh material) of the physical filtration member 168. In this configuration, the hair wrap members may collect elongate debris (e.g., hair) which is entrained in the air flow inside of the cyclone chamber 120. For instance, debris (e.g., hair) may collect by wrapping around the hair wrap members. The hair wrap members may be positioned and spaced around only one or more of the porous section 170 of the physical filtration member 168. Alternately, one or more hair wrap member may be positioned around all of physical filtration member 168.

An advantage of this configuration is that the hair wrap members may function to space the wrapped debris outwardly from the outer wall 198 (e.g., the porous section of the outer wall 198). Accordingly, debris is prevented from aggregating (e.g., wrapping) directly around the porous filtration member and thereby obstruct or inhibit air flow through the porous section 170 of the filtration member 168.

A further advantage of this configuration is that debris, which wraps around the hair wrap members, may act as an enlarged filtration surface. For instance, elongate material may form around the hair wrap members, and at least partially surround the porous section 170. The elongate material may form a layer of debris outwards of the porous section 170 and may function to collect particles of dust and dirt which are entrained in air flow as the air flow passes through the layer of debris to the porous section 170. In at least some cases, the layer of debris may further facilitate dis-entrainment of dust and dirt by reducing the flow velocity of fast moving air.

Still a further advantage of this configuration is that the hair wrap members may facilitate simplified cleaning of debris, which is wrapped around the filtration member 168. For instance, the hair wrap members may space the debris outwardly from outer wall 198 such that an object (e.g., a user's finger or a sharp object such as a knife) may be inserted in the space between the physical filtration member 168 and the material wrapped around the hair wrap members. The object may then be used for quickly removing the debris (e.g., by cutting through the debris). This avoids cases where debris tightly wraps (or is entangled) around the outer wall of filtration member 168 and is otherwise difficult to remove.

It will be appreciated that any suitable number of hair wrap members may be positioned and spaced around the filtration member 168. An advantage of using a greater number of hair wrap members is that the hair wrap members may more effectively collect debris, as well as space the debris away from the outer wall 198.

The hair wrap members may have a variable length. For example, the hair wrap members may be positioned along the entire longitudinal length of the physical filtration member 168 or only a portion thereof (e.g., only the portion having the porous section 170. An advantage of using shorter hair wrap members that cover a smaller area of the outer wall 198 (e.g., only the porous section 170), is that they will have a lesser intrusion into the cyclonic flow region in the cyclone chamber and thereby minimize any impact on the cyclonic flow in the cyclone chamber.

The hair wrap members may take any suitable form or configuration.

As exemplified in FIGS. 20 to 33, the hair wrap members comprise a plurality of stationary ribs 184, which extend radially outwardly from the porous section 170 of the outer wall 198. It will be appreciated that the hair wrap members may be provided by shaping frame members 172 or by providing a separate element. As exemplified in FIGS. 20 to 33, the ribs 184 function as the frame members 172.

As exemplified in FIGS. 21, 25, 27, 29, and 33, air will rotate in a direction (e.g., direction 202) in the cyclone chamber. Each rib 184 may generally comprise a radial inner side 184*a*—facing (e.g., abutting) the porous section 170 of outer wall 198—and a radial outer side 184*b*—positioned radially outwardly from the outer wall 198—and an upstream side 184*c* and an opposed downstream side 184*d*, each defined according to the direction of air rotation 202 (e.g., inside of the cyclone chamber 120).

As exemplified in FIGS. 21, 25, 27, 29, and 33, a region 216 is located on the downstream side of each rib 184. Region 216 is recessed inwardly from the cyclonic flow region in the cyclone chamber. An advantage of this configuration is that air, which rotates in direction 202, may, in some cases, divert into a region 216. Air flow diverted into region 216 may experience turbulence, and may swirl inside of region 216 (e.g., to generate a pseudo-eddy current). The turbulence may accordingly slow-down fast moving air, which may, in turn, facilitate separation of finer particles of dirt or debris. The separated particles may then travel, for example under the influence of gravity, into dirt collection chamber 122.

Ribs 184 may extend radially outwardly (e.g., between the radial inner side 184*a* and the radial outer side 184*b*) by any suitable distance. An advantage of using ribs 184 having a greater radial extension is that the ribs may space the wrapped debris further outwardly from the porous section of outer wall 198. In this manner, the debris is less likely to obstruct air flow through the recessed mesh material 180.

The width of each rib 184 in the direction of rotation (e.g., the lateral extension of the radial inner or outer sides 184*a*, 184*b*) may also be variably configured. An advantage of using wider ribs is that the ribs may function more effectively to collect debris (see for example FIGS. 21, 25, 27 and 29 using wider ribs 184). An advantage of using narrower ribs is that the ribs may cover over a smaller portion of the outer wall 198 thereby permitting a larger region for the recessed mesh material 180. Accordingly, a greater surface area of the porous section may be available for air flow (see e.g., FIG. 33 using narrower ribs 184).

The ribs 184 may be supported around the porous section 170 in any suitable manner. For instance, the ribs 184 may be attached to (e.g., integrally formed with) non-permeable frame members 172. In other cases, a first end 188*a* of ribs 184 may be connected (e.g., welded to, or secured using an adhesive) to distal end 204 of the solid portion of outer wall 198. Alternatively, or in addition, a second end 188*b* of rib 184 may be connected to the distal end 196 of filtration member 168.

Ribs 184 may extend longitudinally between the first end 188*a* and second end 188*b* by any suitable distance. In the exemplified embodiments, each rib 184 extends only along the length of the porous section 170 (e.g., between end 204 and distal end 196 of filtration member 168). An advantage of this configuration is that longer ribs may function to collect debris, and space the debris outwardly from all of the porous section 170. In alternative embodiments, shorter ribs 184 may be provided. For instance, ribs 184 may extend only partially between the end 204 and the distal end 196 of porous section 170. For example, the ribs 184 may be supported on non-permeable frame members 172 and may extend along only a portion of the length of the non-permeable frame members 172. In still other alternative embodiments, different ribs 184 may have different longitudinal extensions (e.g., some ribs may be longer, or shorter, than other ribs).

While ribs 184 are illustrated as being generally "unangled" (e.g., the ribs extend longitudinally along a linear plane), in alternative embodiments, different portions of ribs 184 may be oriented at different angles (e.g., a zigzag configuration) or they may be curved in the direction of air rotation 202.

The ribs 184 may extend in a plane extending through the axis 218. In other embodiments, as exemplified in FIGS. 20 and 24, some or all of ribs 184 may be oriented at slight angles (e.g., tilted) around the outer wall 198 (e.g., the ends 188*a* and 188*b* may not be located in the same plane). So as to have a twisted configuration (e.g., between the proximal ends 188*a* and 188*b*).

The stationary ribs 184 may be configured to have any one of a number of suitable shapes.

FIGS. 20 to 23 exemplify one embodiment of the static rib configuration. In this embodiment, the upstream side 184*c* of ribs 184 is configured to extend in the direction of air rotation 202, while the downstream side 184*d* may be generally planar, and may extend radially outwardly (e.g., from the radial inner side 184*a* to the radial outer side 184*b*). In the exemplified embodiment, the upstream side 184*c* is curved in the direction of air rotation, however, in other cases, the upstream side 184*c* may extend in any other manner in the direction of air rotation (e.g., the upstream side may be planar).

An advantage of this configuration is that the upstream side 184*c*—which extends in the direction of air rotation 202—may assist in directing air to flow over the rib 184 with reduced turbulence being created. Accordingly, the upstream side 184*c* may ensure continuity of air flow around the physical filtration member.

Figure 24:
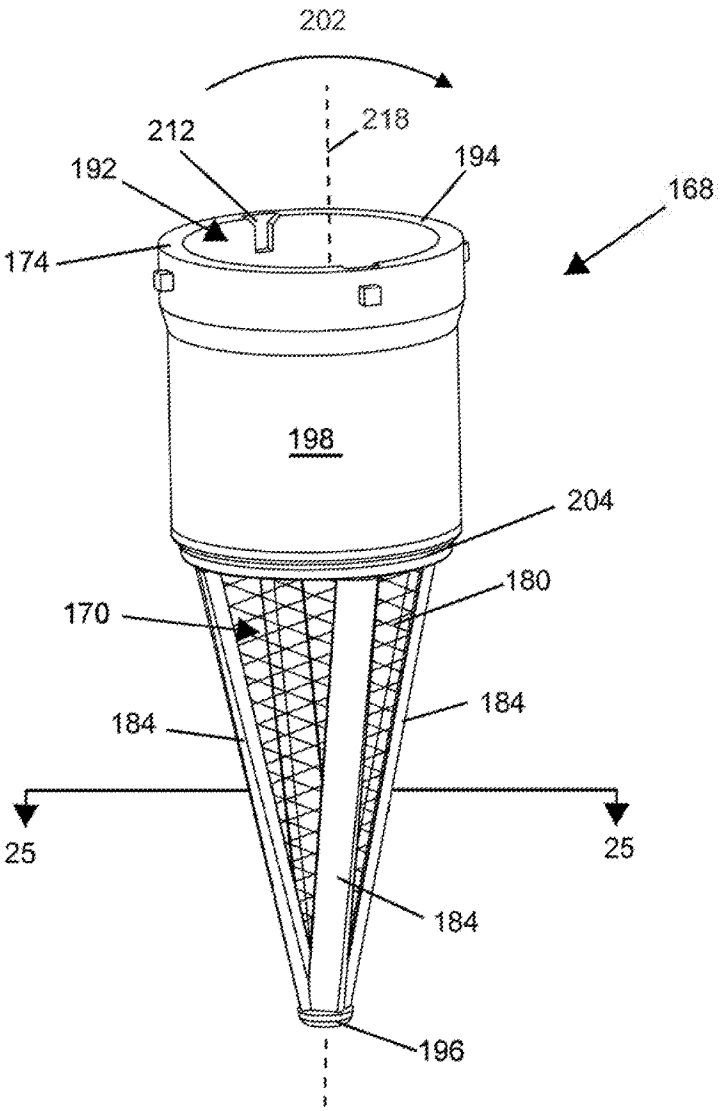
FIG. 24 is a perspective view of a further alternate screen having stationary hair wrap members.
Figure 25:
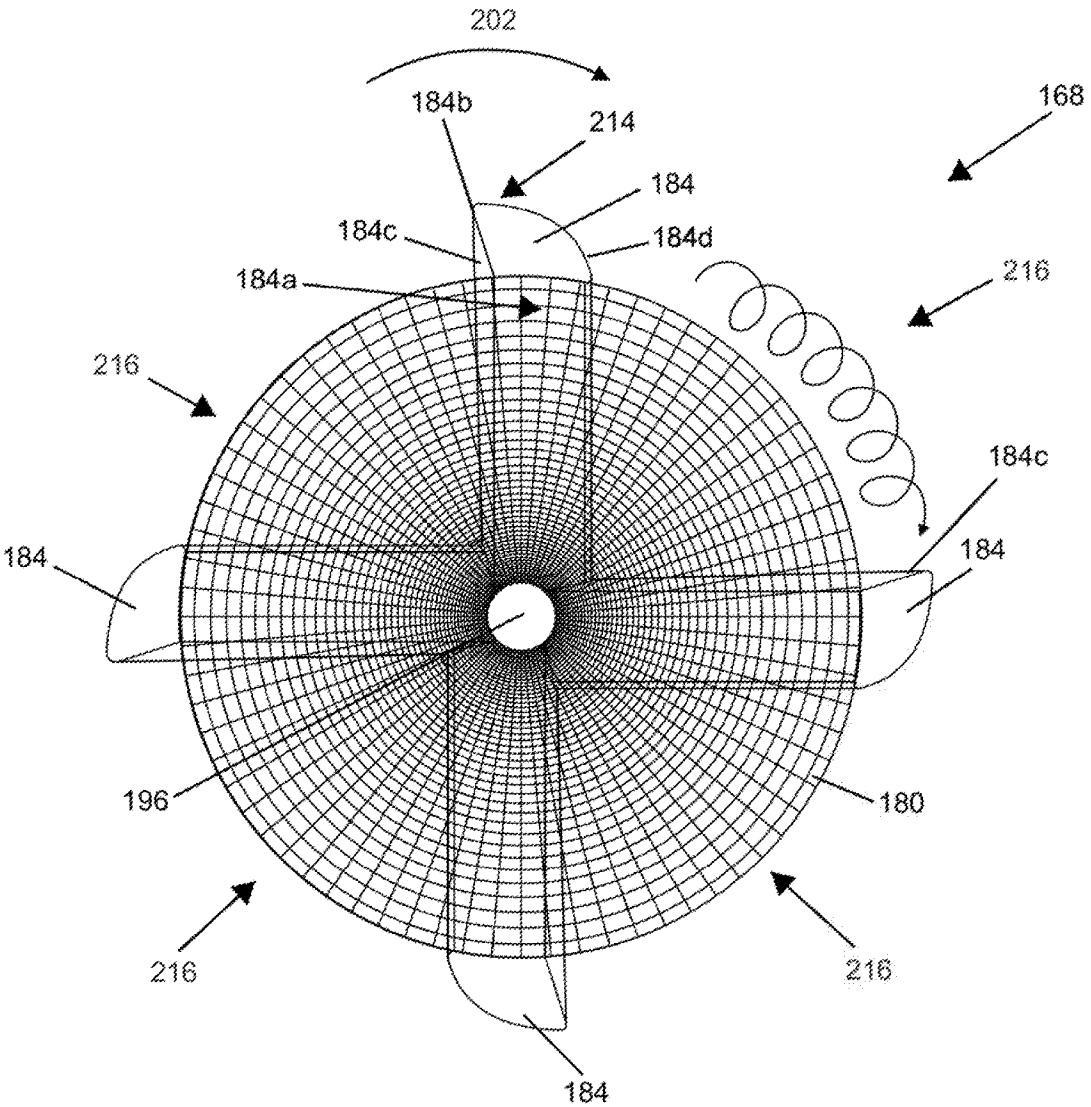
FIG. 25 is a section view of the alternate screen of FIG. 24, taken along line 25-25 in FIG. 24.
Figure 26:
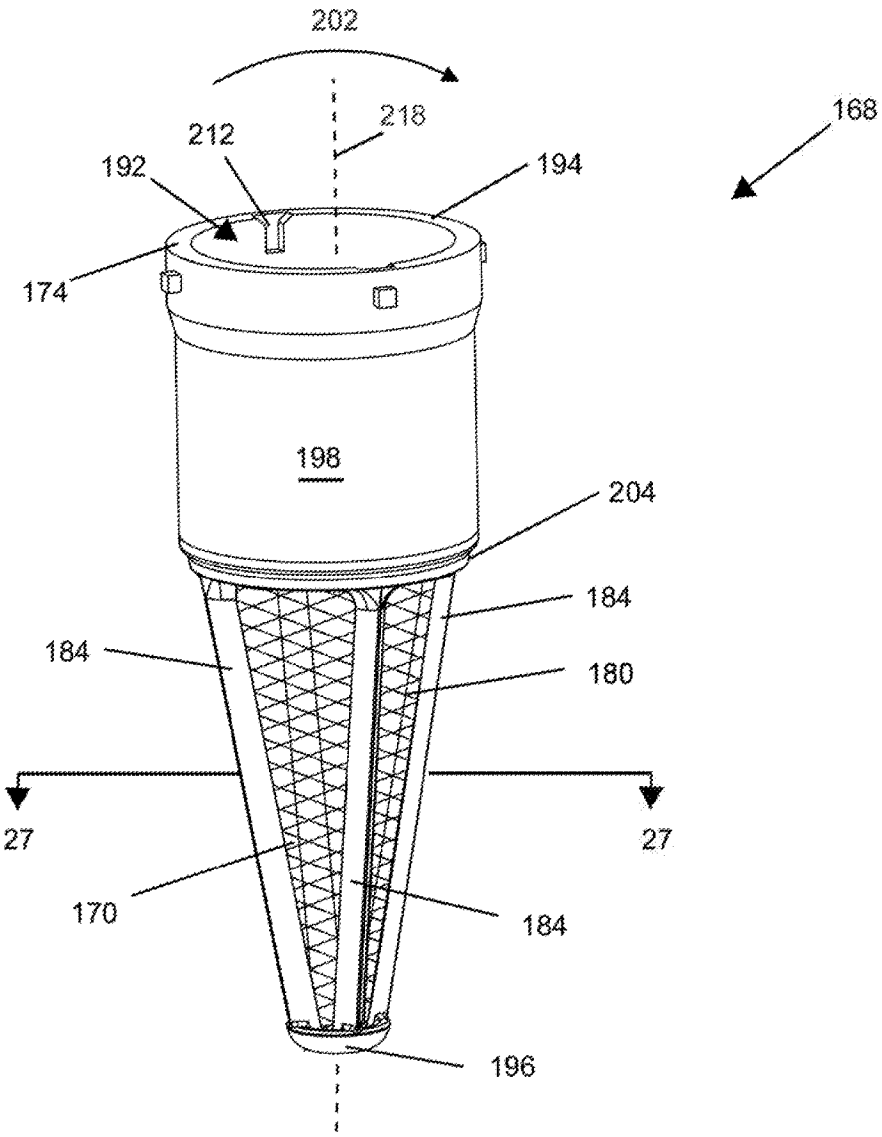
FIG. 26 is a perspective view of a further alternate screen having stationary hair wrap members.
Figure 27:
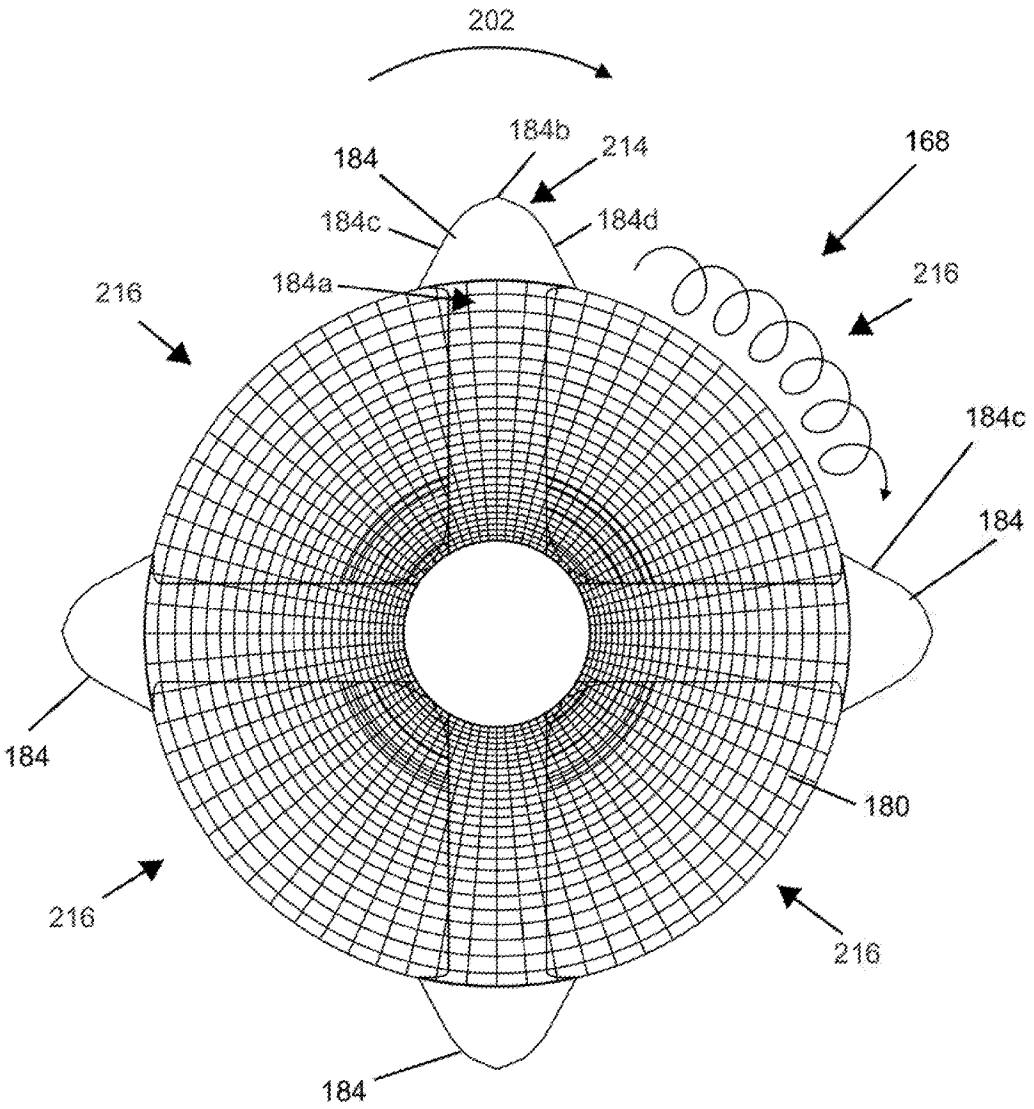
FIG. 27 is a section view of the alternate screen of FIG. 26, taken along line 27-27 in FIG. 26.
Figure 28:
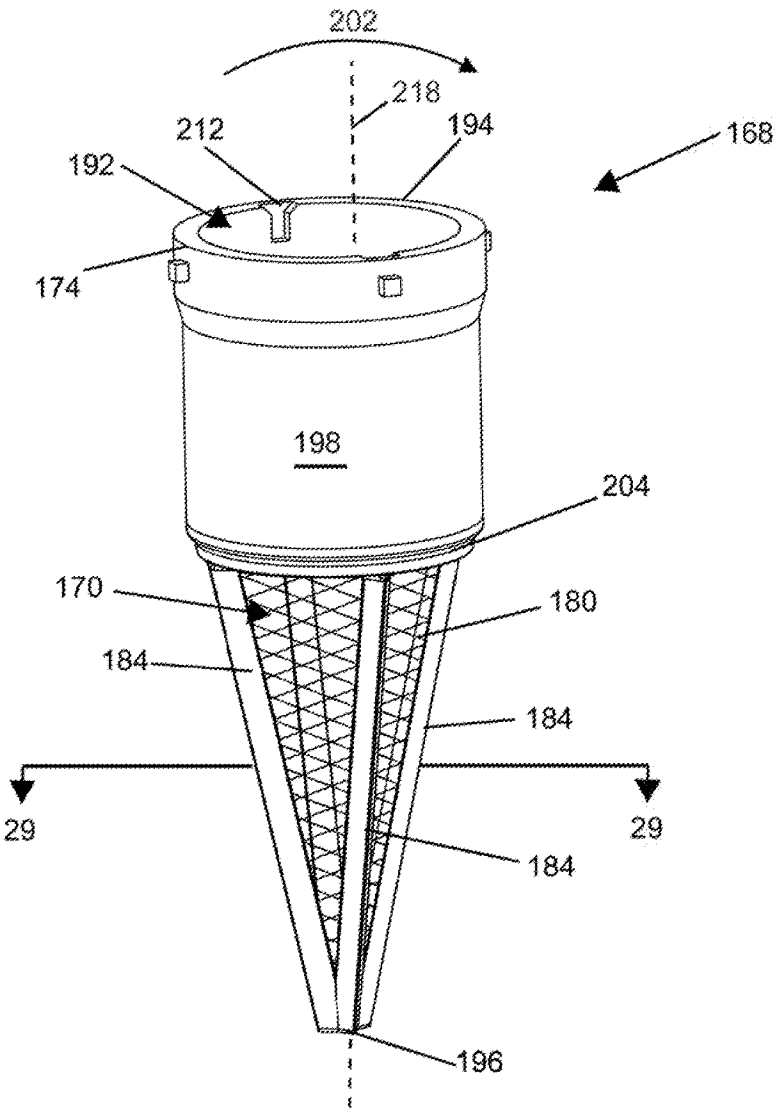
FIG. 28 is a perspective view of a further alternate screen having stationary hair wrap members.
Figure 29:
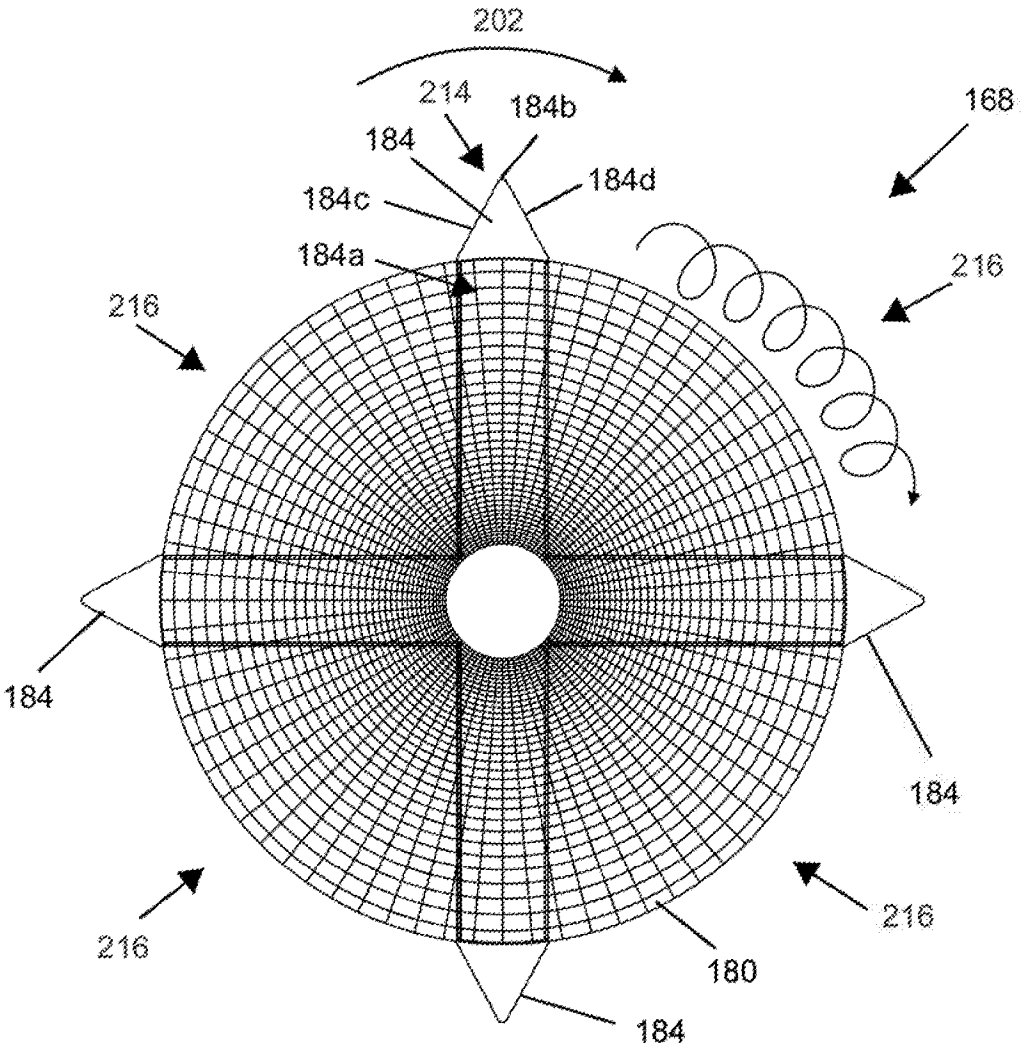
FIG. 29 is a section view of the alternate screen of FIG. 28, taken along line 29-29 in FIG. 28.
Figure 30:
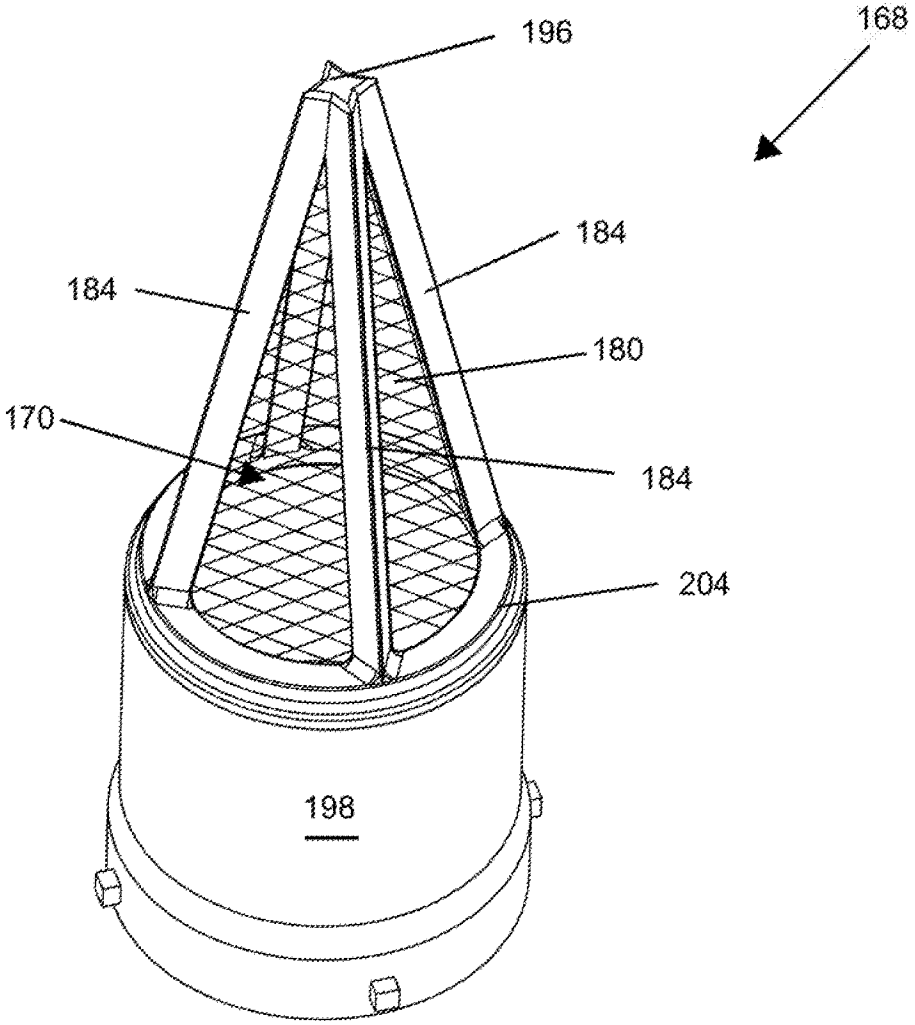
FIG. 30 is a bottom-side perspective view of the alternate screen of FIG. 28.
Figure 31:
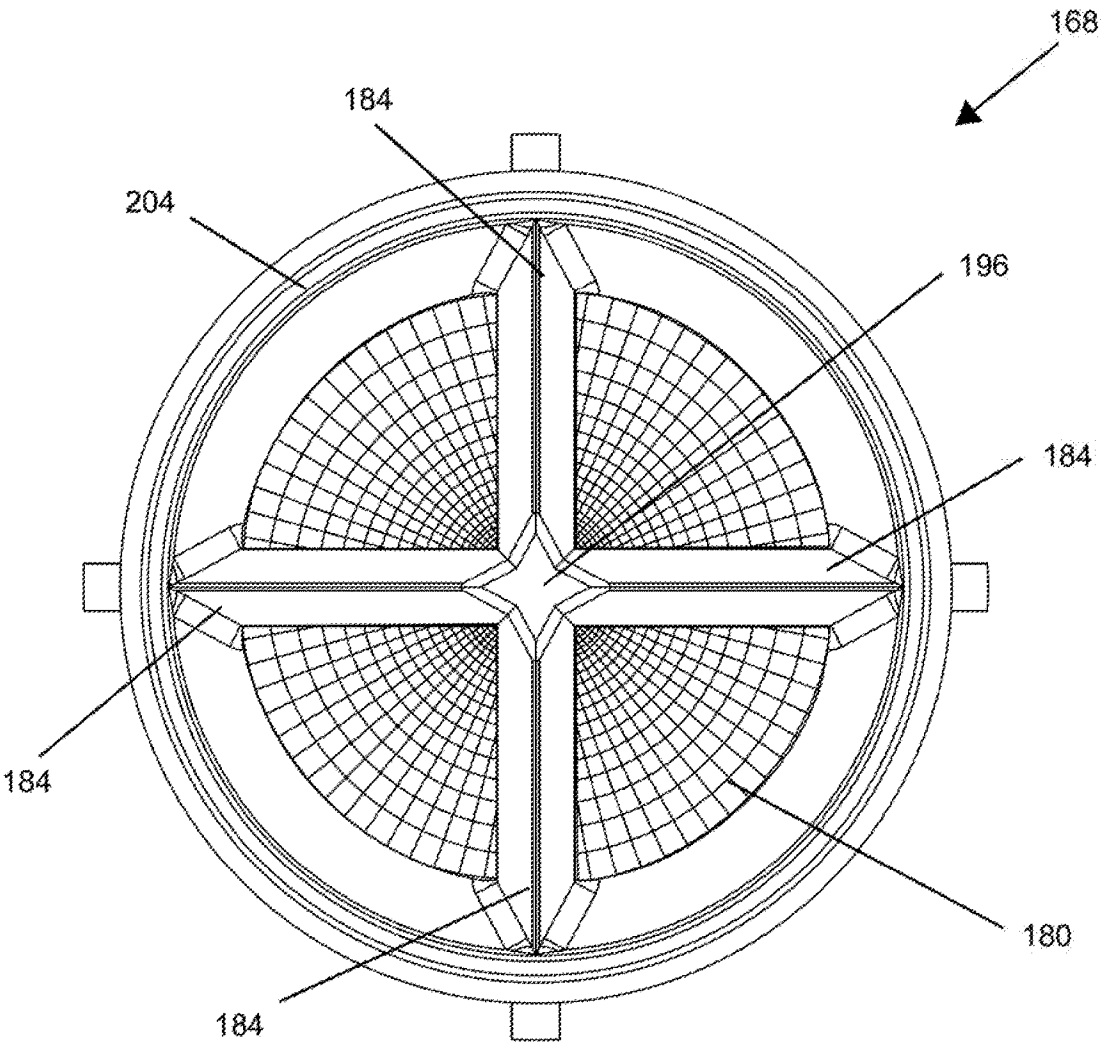
FIG. 31 is a bottom plan view of the alternate screen of FIG. 28.
Figure 32:
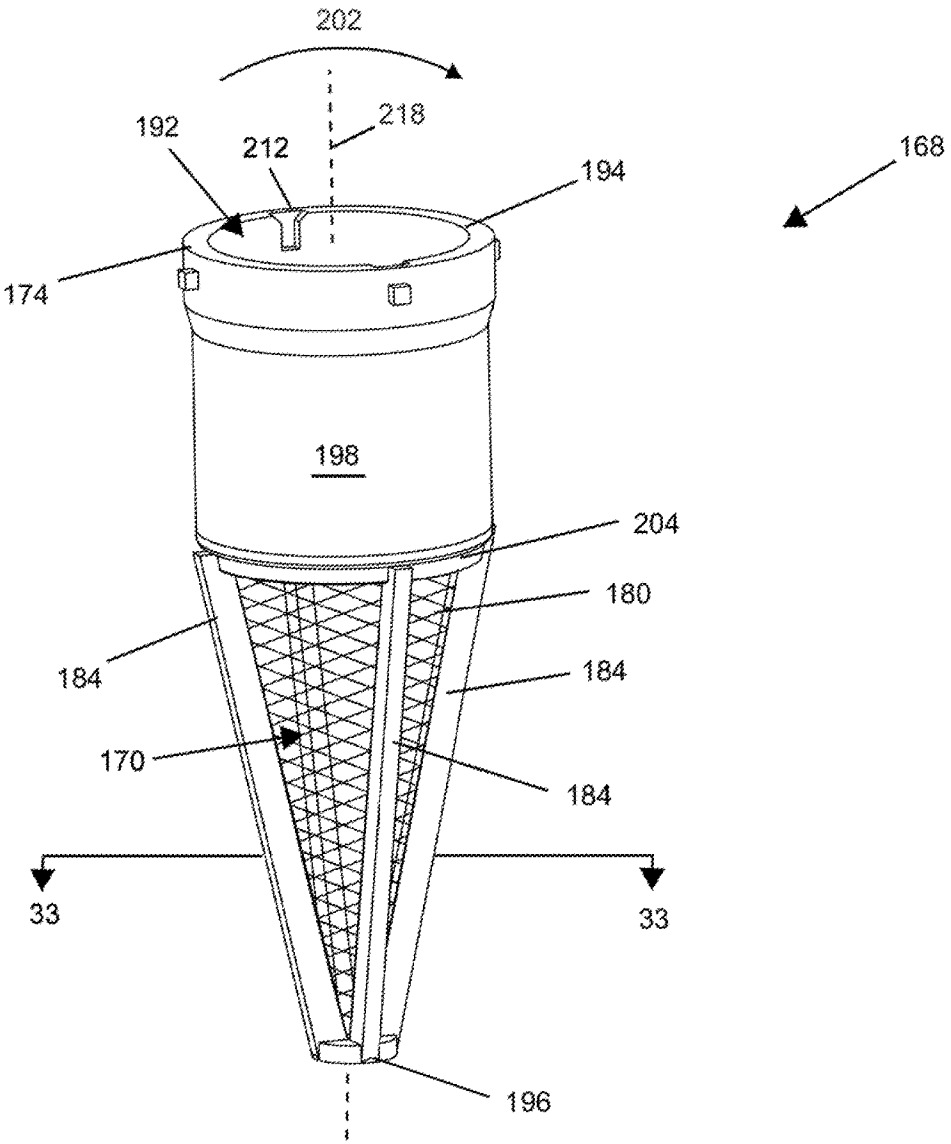
FIG. 32 is a perspective view of a further alternate screen having stationary hair wrap members.
Figure 33:
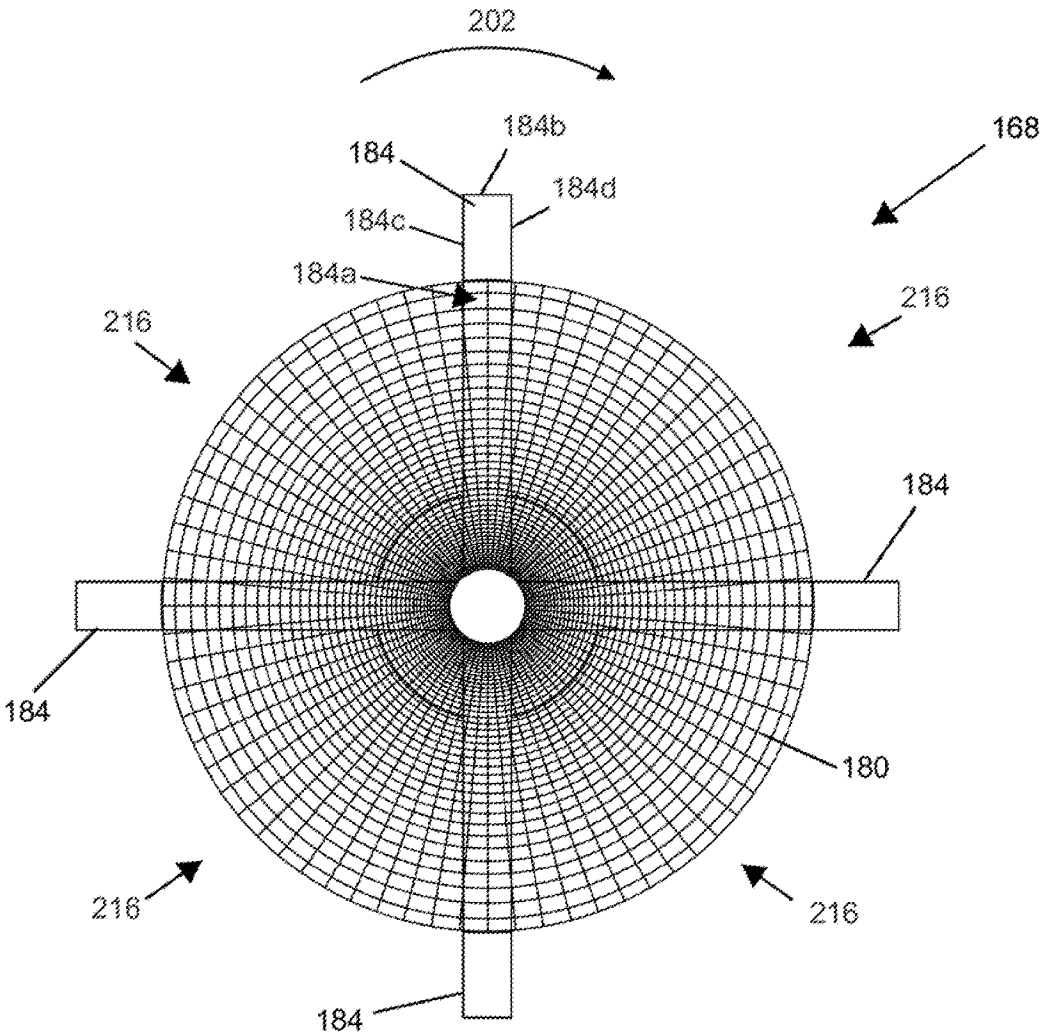
FIG. 33 is a section view of the alternate screen of FIG. 32, taken along line 33-33 in FIG. 32.

FIGS. 24 and 25 exemplify an alternative embodiment of the static rib configuration. In this embodiment, the ribs are narrower. In addition, the upper end of the ribs 184 are angularly spaced around filtration member 168 in the direction of air flow 202 from the lower end of the ribs 184. In addition, the downstream sides 184*d* of ribs 184 extend in the direction of air rotation 202, while the upstream sides 184*c* are planar and extend radially outwardly (e.g., from the radial inner side 184*a* to the radial outer side 184*b*). While in the exemplified embodiment, the downstream side 184*d* is curved in the direction of air rotation, in other cases, the downstream side 184*d* may again extend in any other manner in the direction of air rotation (e.g., the downstream side may be planar as exemplified in FIG. 33).

An advantage of this configuration is that by configuring the downstream side 184*d* to extend in the direction of air rotation, the downstream side may effectively divert air flow into region 216. A further advantage of this configuration is that air flow, which is diverted into region 216, may be obstructed (e.g., prevented) from further rotational flow by the planar upstream side 184*c* of an adjacent downstream rib 184 (see e.g., FIG. 25). The obstruction of air flow may accordingly facilitate distrainment of dirt and debris entrained in the flow of air.

FIGS. 26 to 29 exemplify another alternative embodiment of the stationary rib configuration wherein each of the upstream side 184*c* and the downstream side 184*d* of ribs 184 extend in the direction of air rotation 202. For example, in the embodiment of FIGS. 26 and 27, the upstream and downstream sides are curved in the direction of air rotation, while in the embodiment of FIGS. 28 to 31 each side extends in planar-form in the direction of air rotation so as to form a generally triangular rib 184.

FIGS. 30 to 33 exemplify still yet another alternative embodiment of the static rib configuration. In this embodiment, each of the upstream side 184*c* and the downstream side 184*d* are planar, and extend radially outwardly from the outer wall 198. As stated previously, an advantage of this configuration is that the ribs 184 are narrower and cover (e.g., overlay) a smaller area of the porous section of the outer wall 198. In this manner, a larger area of the porous section is accessible for air flow.

While the embodiments of FIGS. 20 to 33 illustrated the entirety of the downstream or upstream side of each rib 184 as extending in the direction of air rotation or being otherwise planar, it will be appreciated that in other embodiments, only a portion of each side may extend in the direction of air rotation or may be in planar-form. For instance, in various cases, only a radial outer portion 214 of each rib 184 may be configured with the desired shape.

Optionally, in at least some example embodiments, the hair wrap members may alternatively comprise stationary ribs 184 which have a portion that is spaced from, and facing the outer wall 198 (see e.g., FIGS. 34, 35, 38, 39, 42, 43). These spaced portion may be spaced from, and face the porous section of outer wall 198. For example, the hair wrap members may be shaped such that the downstream side 184*d* is spaced from the porous section. An advantage of this design is that a larger porous section may be provided and, optionally, essentially all of the perimeter of the filtration member 168 may be made of a porous material.

FIGS. 34, 35, 38, and 39 exemplify embodiments wherein the downstream side 184*d* of the hair wrap members are spaced outwardly from the outer surface of the filtration member. In these embodiments, the hair wrap members may also define frame members 172

Figure 34:
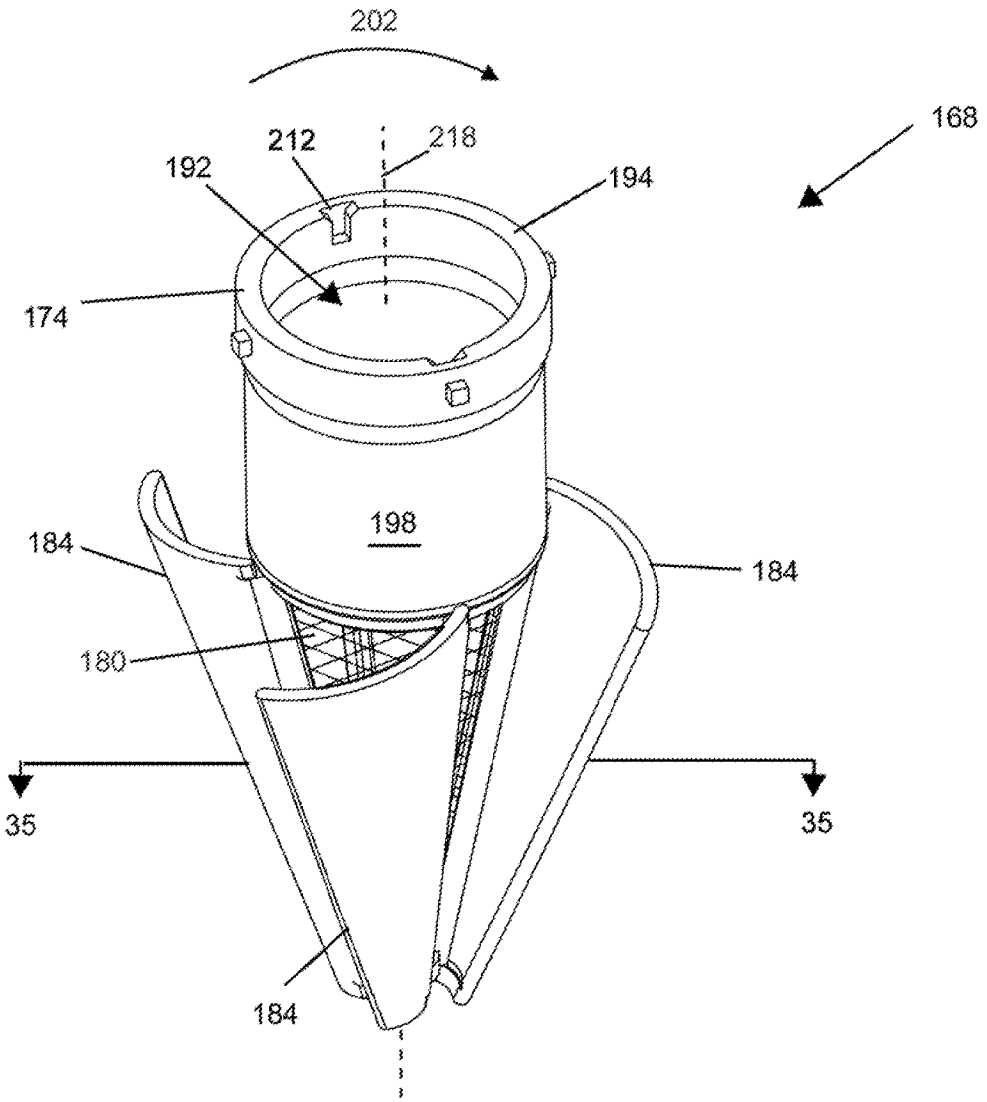
FIG. 34 is a perspective view of a further alternate screen having moveable hair wrap members, and showing the moveable hair wrap members in an expanded configuration.
Figure 45:
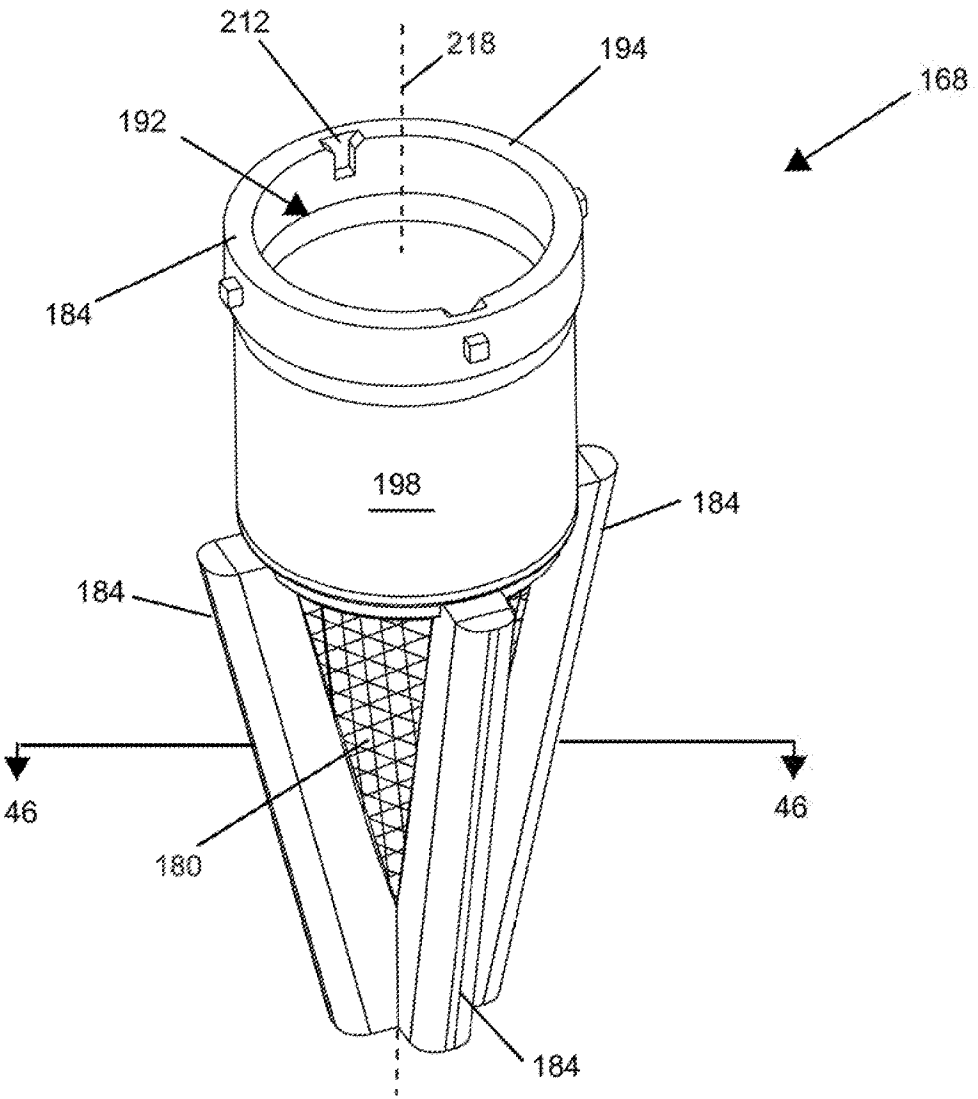
FIG. 45 is a perspective view of the alternate screen of FIG. 42, and showing the moveable hair wrap members in a retracted configuration.

As exemplified, in some cases, the elongate members may be configured such that a majority of the downstream side 184*d* faces the outer wall 198 (see e.g., FIGS. 34 and 45). Alternatively, in other cases, only a portion of the downstream side 184*d* may face outer wall 198 (see e.g., FIGS. 38 and 39, where only a radial outer portion 214 of the downstream side 184*d* faces outer wall 198).

The hair wrap members may be considered as elongate rib members that extend outwardly to overlie part or all of the mesh material 180, and they may be configured to have any one of a number of shapes. For instance, in the embodiment of FIGS. 34 and 35, the ribs 184 curve in the direction of air rotation 202. Alternatively, in other cases (not shown), the ribs 184 may extend in any other manner in the direction of air rotation (e.g., they may be planar). In still other cases, as exemplified in FIGS. 38 and 39, the ribs 184 may include a first radial inner portion 220 and a second radial outer portion 214. The radial inner portion 220 may extend radially outwardly, and only the second radially outer portion 214 may extend in the direction of air rotation 202. Accordingly, in this configuration, only a portion of the ribs 184 may extend in the direction of air rotation. It will be appreciated that the first radial inner portion 220 may be angled or curved in the direction of rotation 202. Alternately, or in addition, the second radial outer portion 214 need not be planer. For example, it may be curved.

Figure 42:
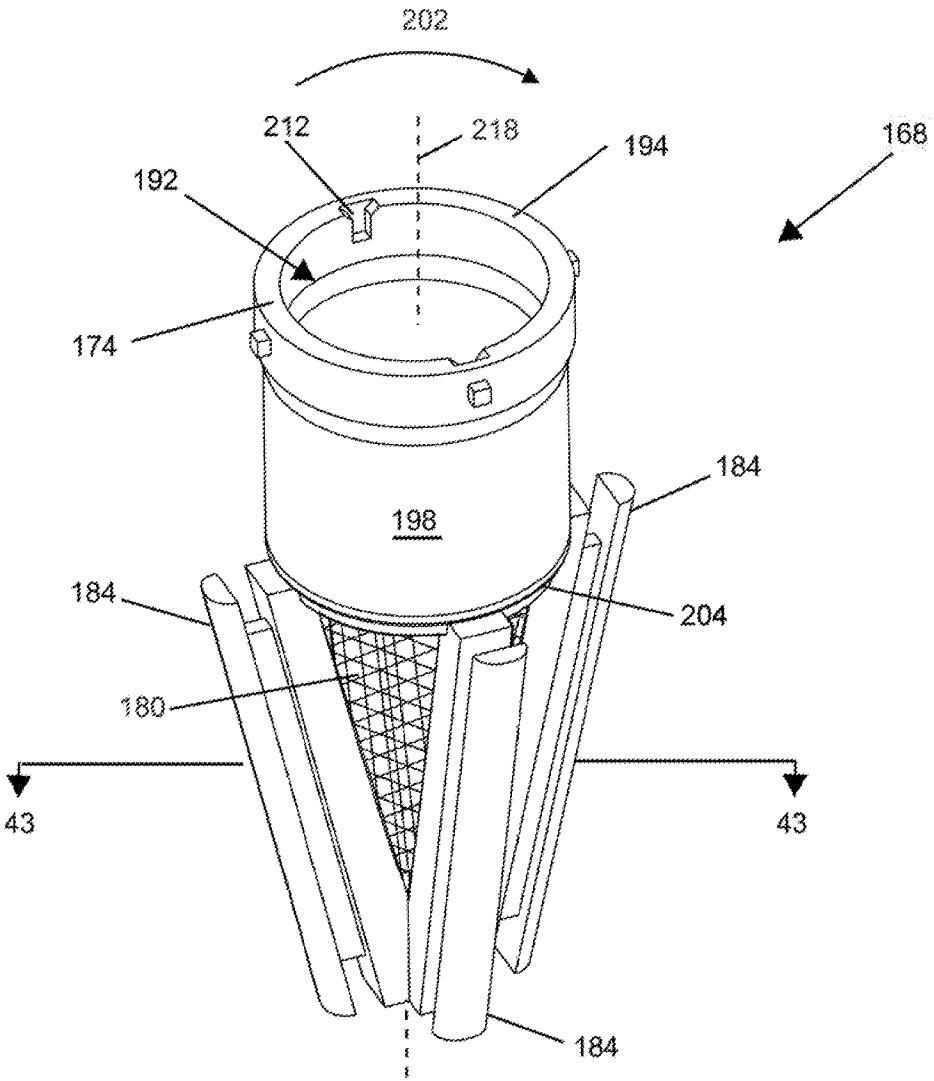
FIG. 42 is a perspective view of a further alternate screen having moveable hair wrap members, and showing the moveable hair wrap members in an expanded configuration.
Figure 43:
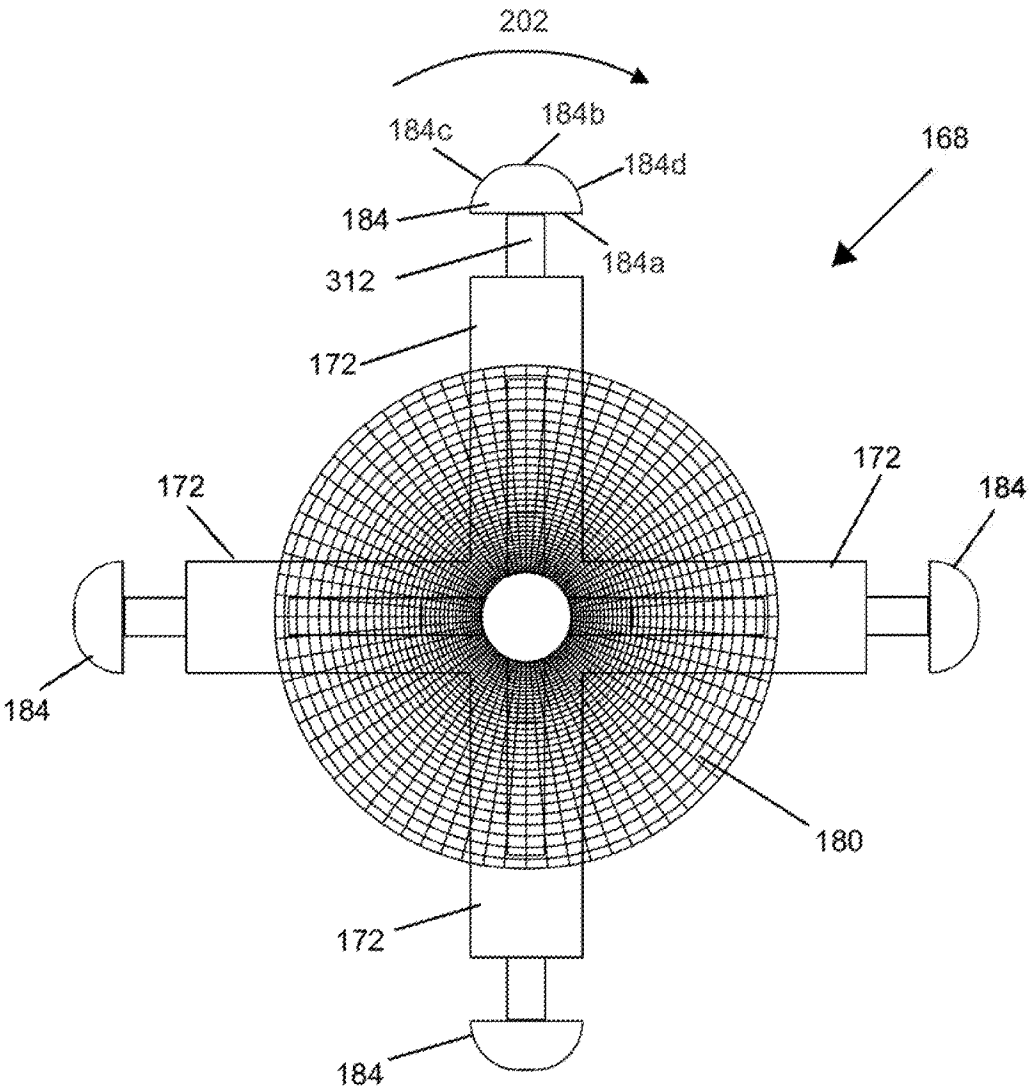
FIG. 43 is a section view of the alternate screen of FIG. 42, taken along line 43-43 in FIG. 42.
Figure 44:
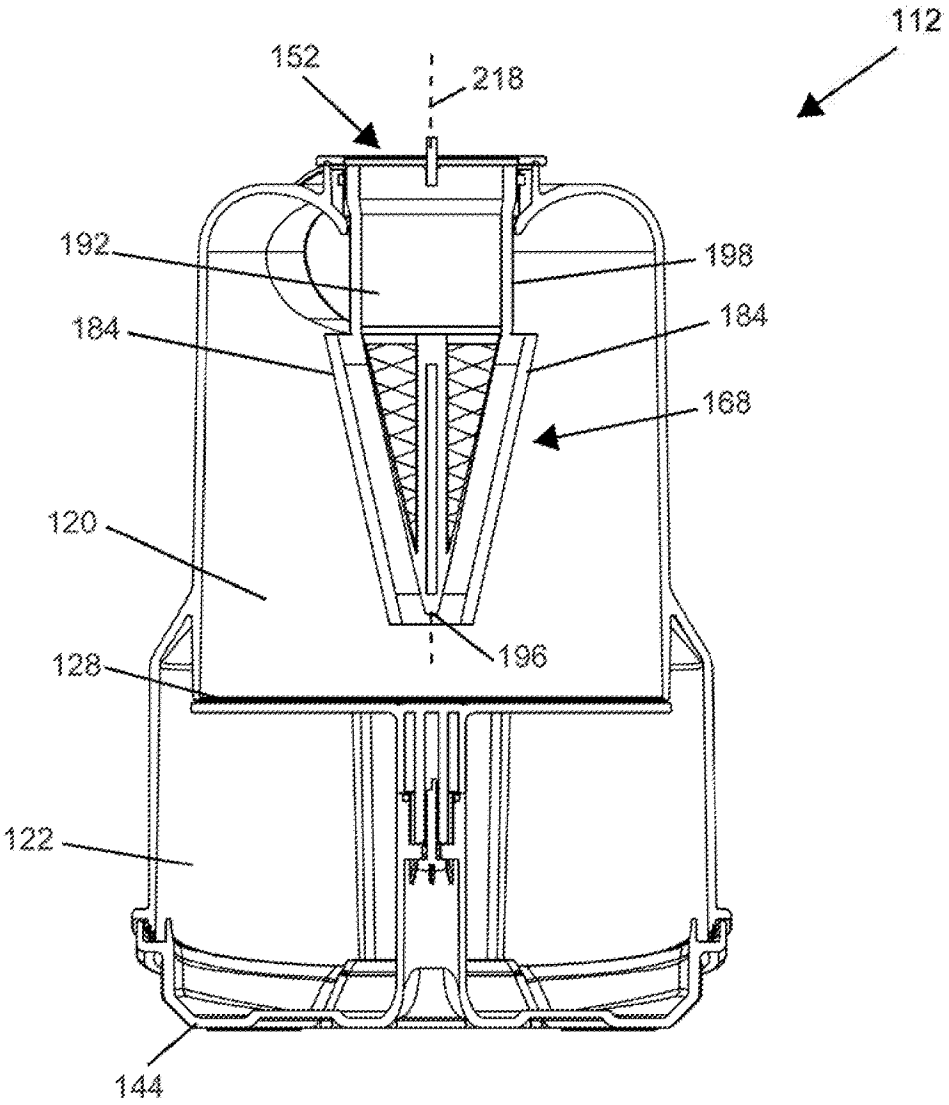
FIG. 44 is a section view of the cyclone bin assembly of FIG. 22 taken along section line 23-23 of FIG. 22, and incorporating the screen of FIG. 42.

FIGS. 42 and 43 exemplify an alternative embodiment of hair wrap members or ribs having a spaced portion. In this configuration, the portion that is spaced from, and faces, the outer wall 198 is the radial inner side 184*a* of the ribs 184. For example, as shown in FIG. 43, the radial inner side 184*a* may be positioned outwardly from the outer wall 198. In this case, the hair wrap member is exemplified as a separate element to frame member 172.

In the configuration of FIGS. 42 and 43, the rib 184 may be optionally supported away (e.g., outwardly) from the outer wall 198 by an extension member 312. For example, a radial outer end of the extension member 312 may be attached to the radial inner side 184*a* of ribs 184, and a radial inner end of extension member 312 may be attached to non-permeable frame members 172 of the filtration member.

In various cases, the width of the radial inner side 184*a* may be varied such that the ribs 184 may cover more, or less, of the outer wall (e.g., the porous section 170).

Additionally, or in the alternative, the stationary hair wrap members may be optionally provided as a discrete member or construction to the filtration member 168 (e.g., disconnected or separate from the filtration member). This is in contrast to the prior embodiments where the stationary hair wrap members extend outwardly from the filtration member, or are otherwise connected to the outer wall 198, e.g., they may be defined by the shaping of the frame members 172.

An advantage of the discrete hair wrap member configuration is that the filtration member may be removed from the cyclone chamber independently of the hair wrap members. In this manner, debris that is wrapped around the hair wrap members is contained within the air treatment member when the filtration member is removed.

The external hair wrap members may be supported around, and externally to, the hair filtration member 168 in any manner known in the art. For instance, the hair wrap members may be connected (e.g., supported) to the end wall 126 of the cyclone chamber 120.

Figure 48:
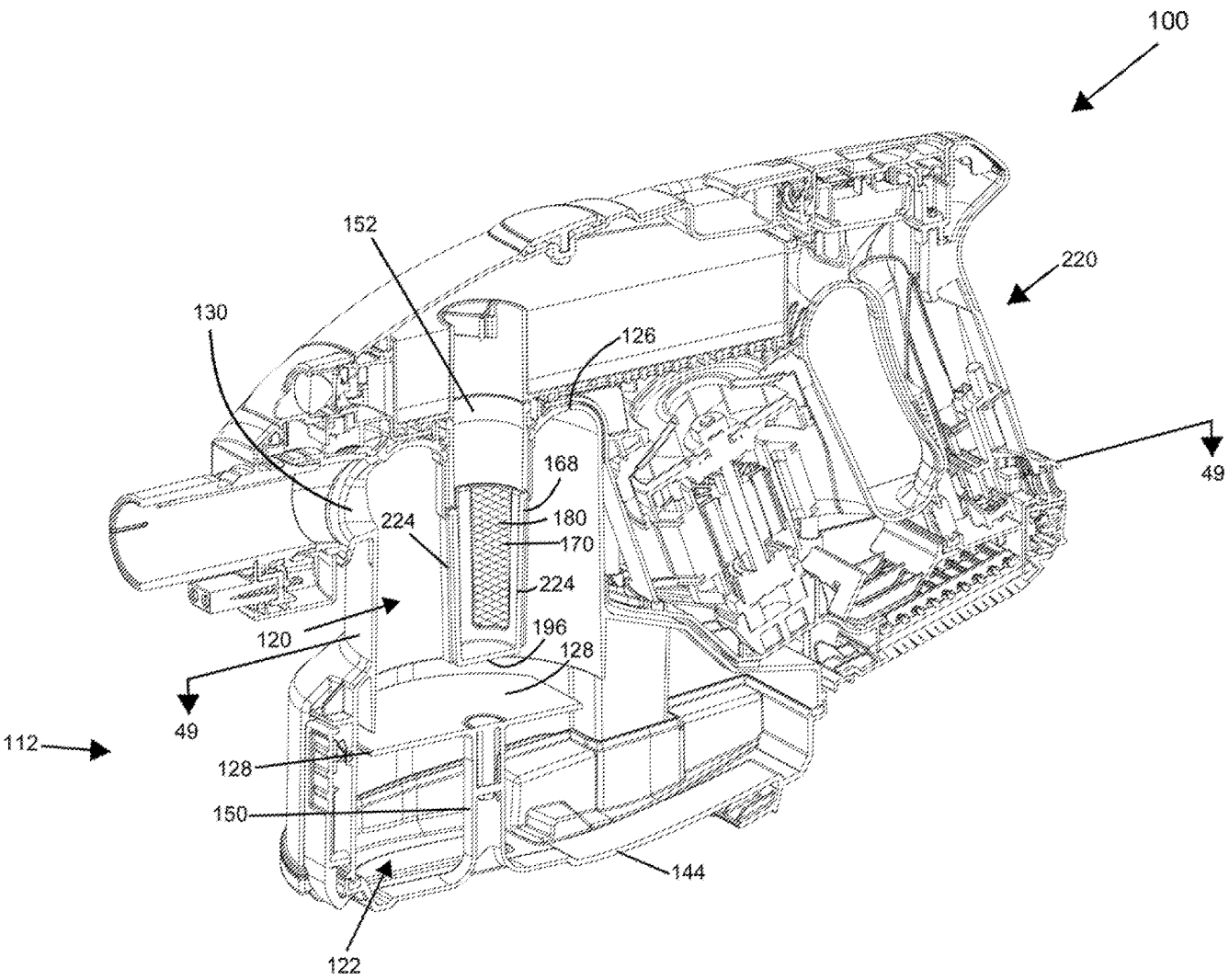
FIG. 48 is a section view of the surface cleaning apparatus of FIG. 1B, taken along the section line 48-48 of FIG. 1B and incorporating a screen surrounded by external hair wrap members.
Figure 49:
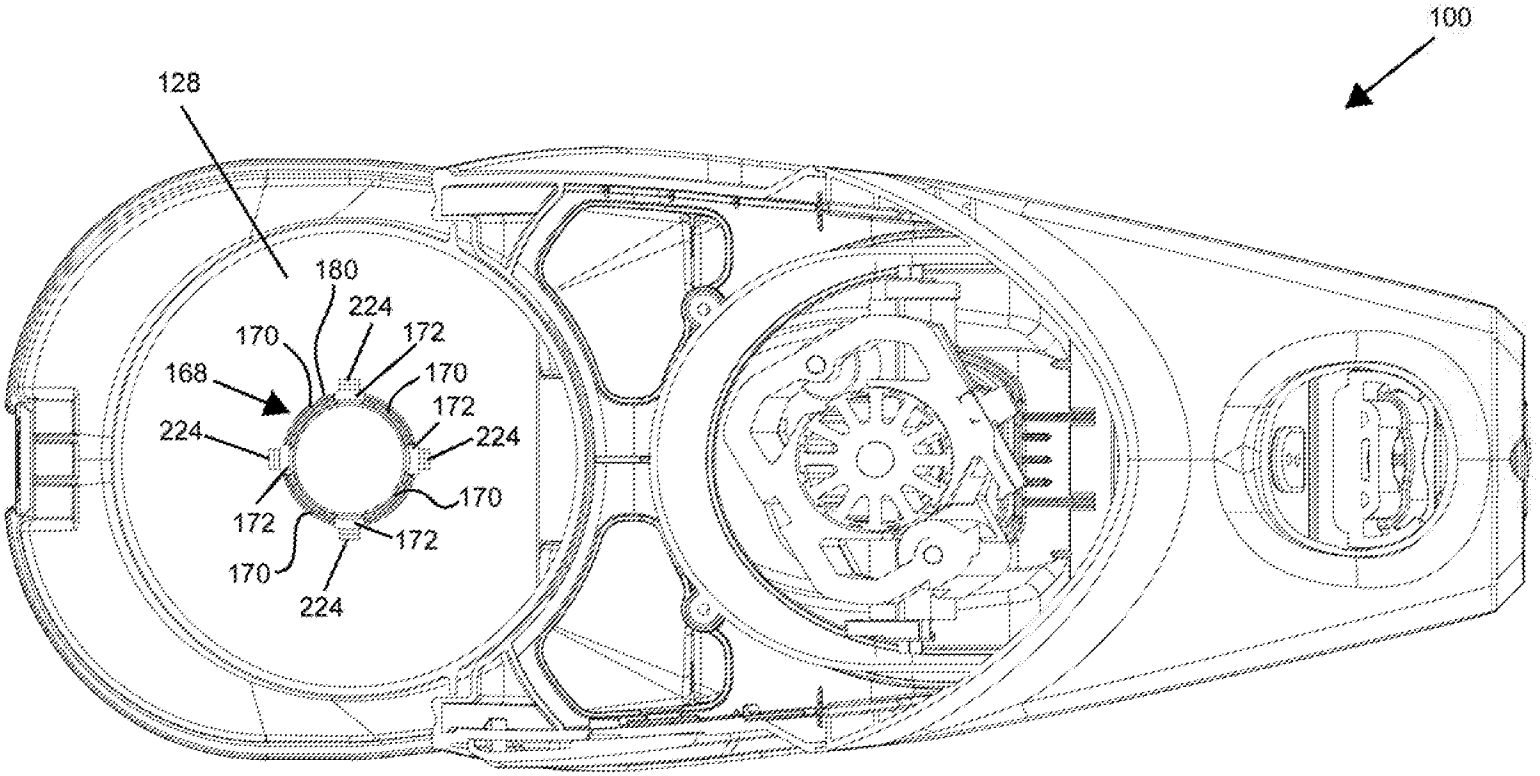
FIG. 49 is a section view of the surface cleaning apparatus of FIG. 48, taken along the section line 49-49 of FIG. 48.

FIGS. 48 and 49 exemplify one embodiment of a discrete hair wrap member configuration. As exemplified, the external hair wrap members may comprise elongate members 224 connected at a distal end to the end wall 126 of the cyclone chamber.

The elongate members 224 may have any suitable shape discussed herein with respect to the shaping or configuration of hair wrap members. For instance, in the exemplified embodiments, the elongate members are generally planar. However, in other embodiments, the elongate members 224 may be configured similar to any of the rib configurations previously exemplified in FIGS. 20 to 35, 38, 39, 42 and 43 (e.g., with the exception that the elongate members would not otherwise be attached or connected at a radial inner side to the filtration member as is the case with the prior described static rib configurations). For instance, the external hair wrap members may be configured with variable shaped upstream and downstream sides as previously exemplified.

Still in yet other further embodiments, the hair wrap members may be optionally configured to be positioned in moveable relationship to the outer wall 198 of the filtration member. For instance, the hair wrap members may be moveable between an expanded position, and a retracted position. In the expanded position, the hair wrap members may be configured to collect debris entrained in the air flow. The hair wrap members may then be moved into the retracted position to allow the wrapped debris to collapse or be removed from the hair wrap members (e.g., into a dirt collection chamber). Accordingly, this configuration may alleviate the requirement of using an object to manually clean the filtration member.

The hair wrap members may be configured to moveably expand and retract by any suitable distance. For instance, the farther the hair wrap members are able to retract, the more effective the hair wrap members may be in allowing the debris to collapse.

In various cases, the hair wrap members may be biased in one of the expanded and retracted positions. For instance, the hair wrap members may be biased in the expanded position and may be moveable into a retracted position by application of force. Accordingly, in this configuration, the default position for the hair wrap members may be in the expanded position.

The moveable hair wrap member structure may be implemented using any one of a number of configurations. The movement of, and the biasing of, the hair wrap members may be caused by the insertion or removal of the filtration member 168 and/or the opening and closing of the cyclone bin assembly.

FIGS. 34 to 47 exemplify several embodiments of the movable hair wrap member configuration. As exemplified, the hair wrap members or ribs 184 may be moveable between a radially expanded position (see e.g., FIGS. 34, 35, 38, 39, 42 and 43) and a radially retracted position (see e.g., FIGS. 36, 37, 40, 41, 45 and 46). The hair wrap members may be manually moveable by a user between the expanded and retracted positions or, alternately, the hair wrap members may be automatically moved by, e.g., removing the filtration member 168 from the cyclone chamber and/or opening a door to empty the cyclone chamber and/or a dirt collection chamber. In the latter case, an actuation member may be drivingly connected between the filtration members and/or the openable door and the hair wrap members.

The ribs 184 may be configured in any manner to be movable between the expanded and retracted positions. For instance, FIGS. 34 to 41 exemplify an embodiment where the ribs 184 are rotatably moveable. Alternatively, FIGS. 42 to 47 exemplify an embodiment where the ribs 184 are slidably (e.g., radially or longitudinally) moveable.

Figure 35:
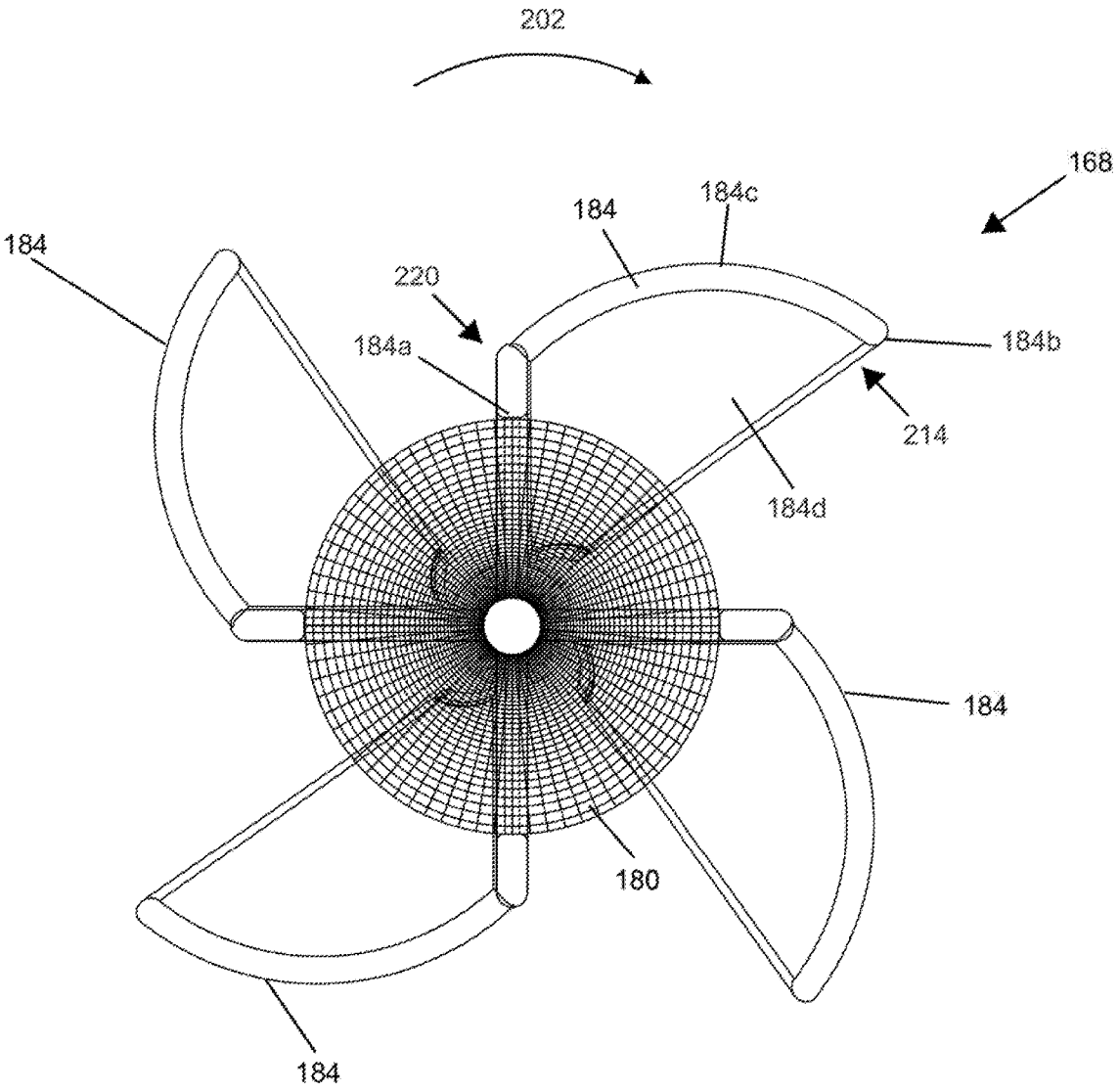
FIG. 35 is a section view of the alternate screen of FIG. 34, taken along line 35-35 in FIG. 34.
Figure 36:
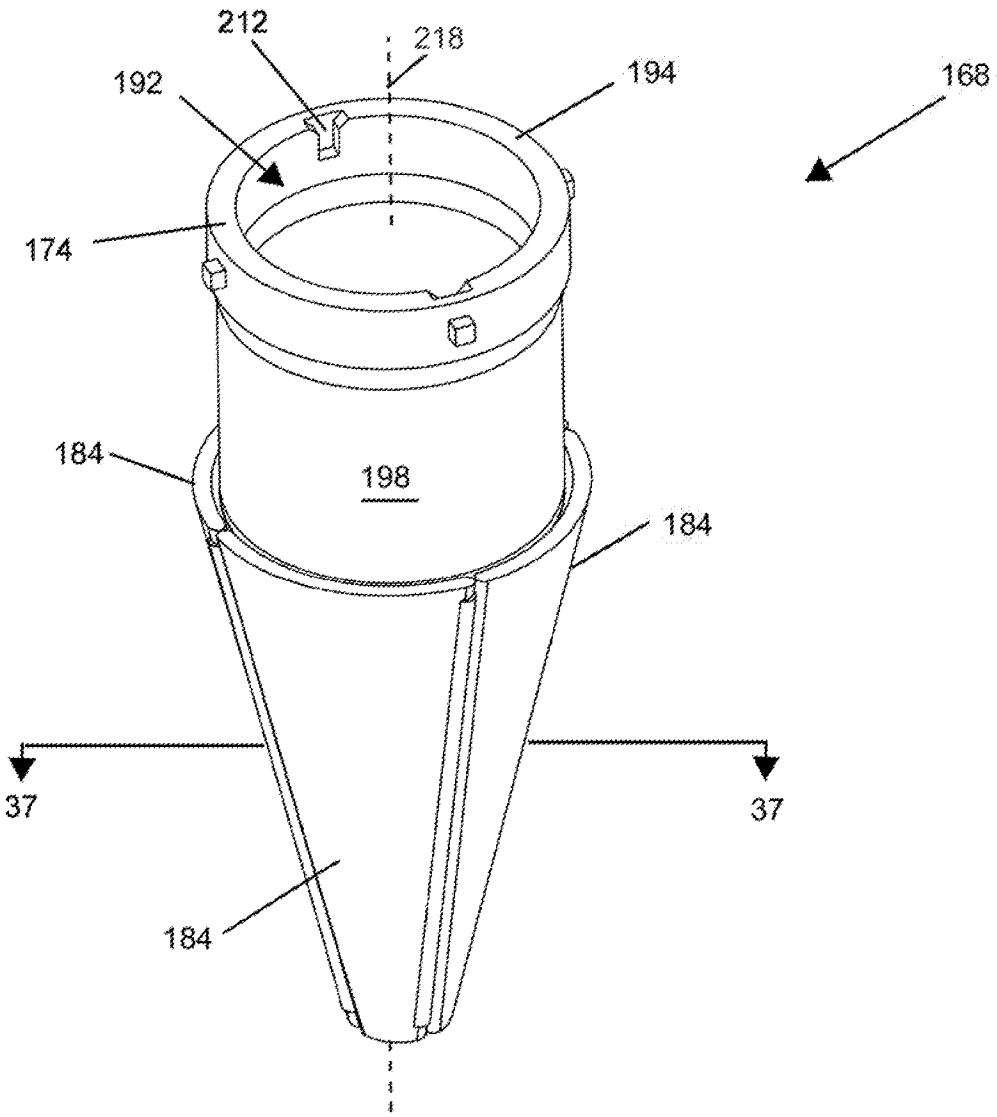
FIG. 36 is a perspective view of the alternate screen of FIG. 34, and showing the moveable hair wrap members in a retracted configuration.
Figure 37:
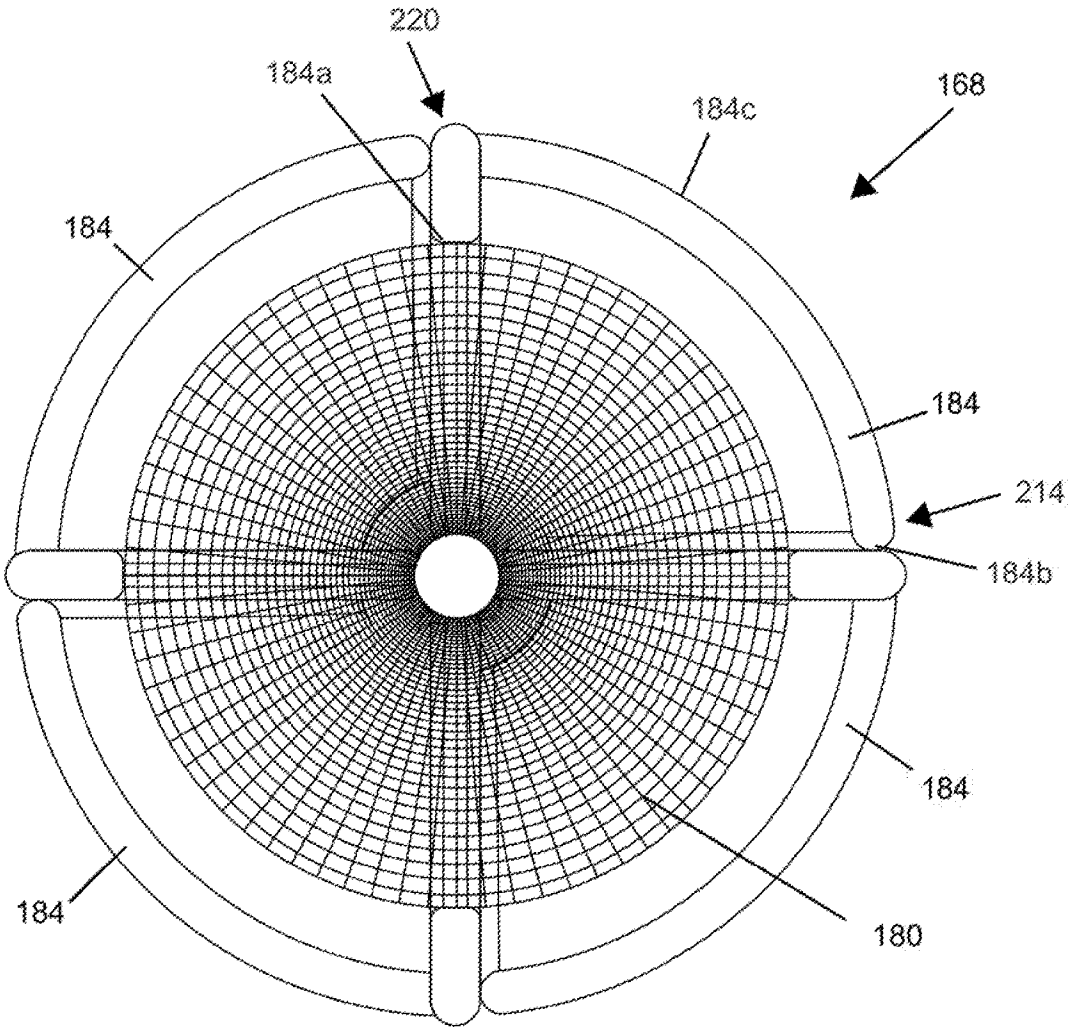
FIG. 37 is a section view of the alternate screen of FIG. 36, taken along line 37-37 in FIG. 36.
Figure 38:
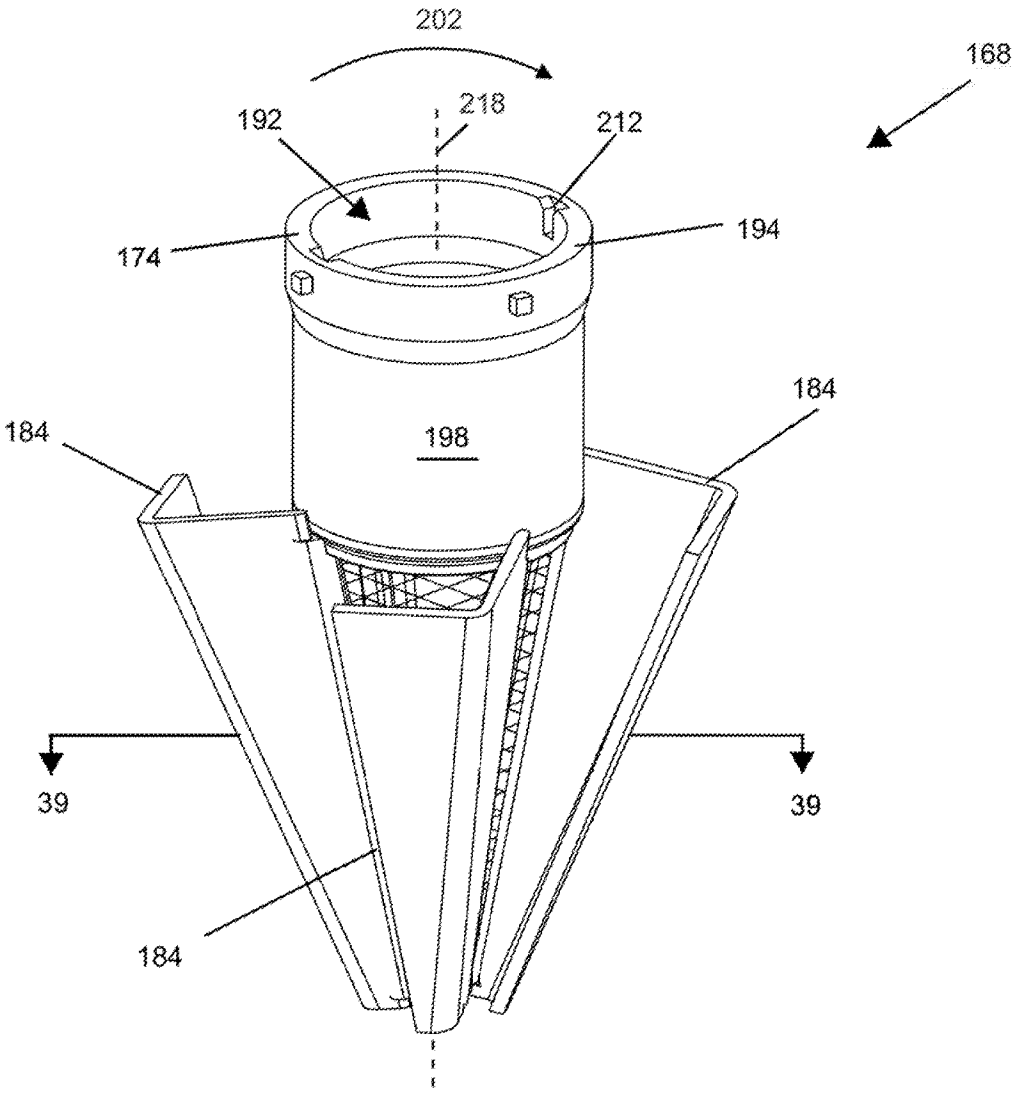
FIG. 38 is a perspective view of a further alternate screen having moveable hair wrap members, and showing the moveable hair wrap members in an expanded configuration.
Figure 39:
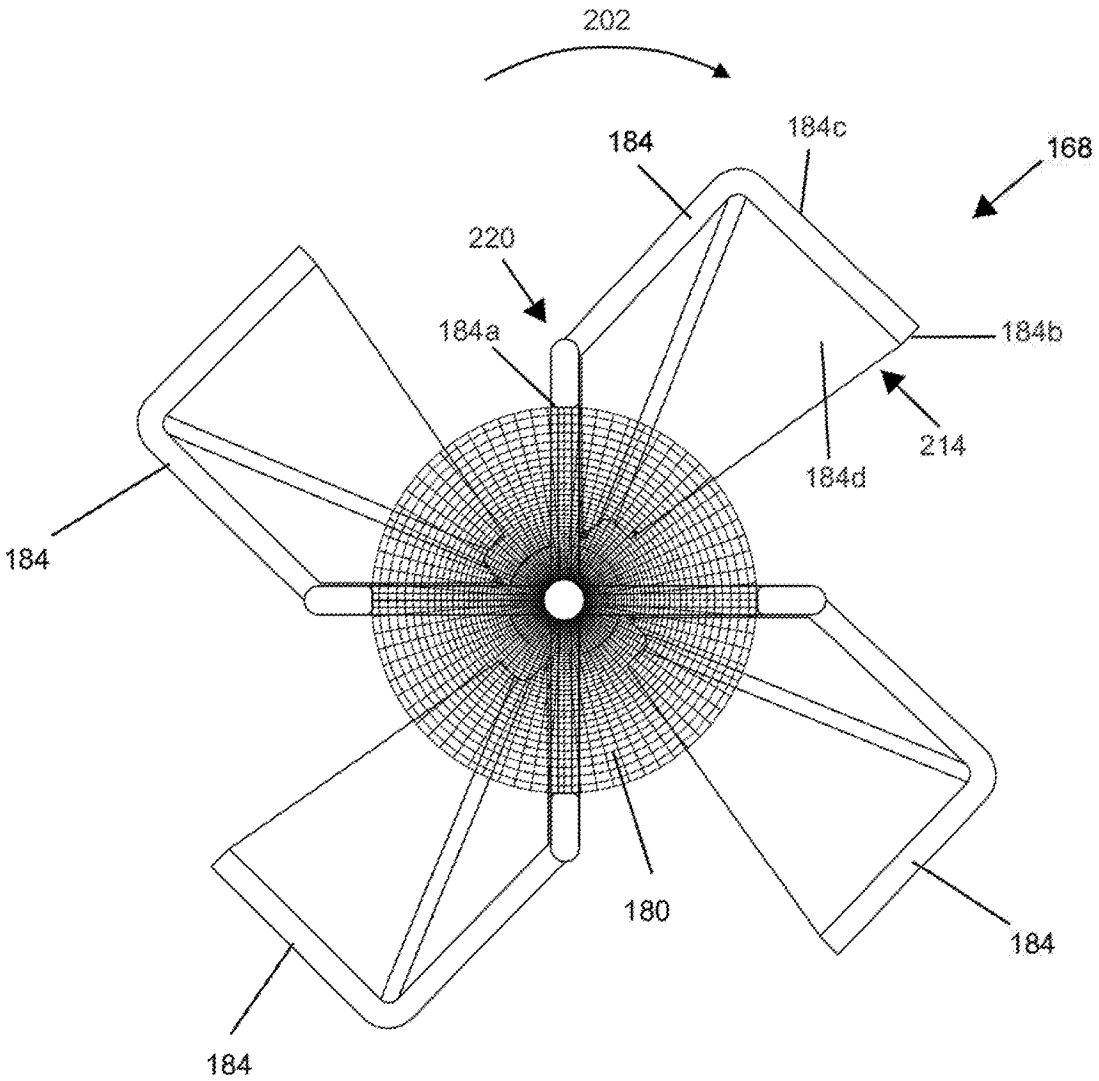
FIG. 39 is a section view of the alternate screen of FIG. 38, taken along line 39-39 in FIG. 38.
Figure 40:
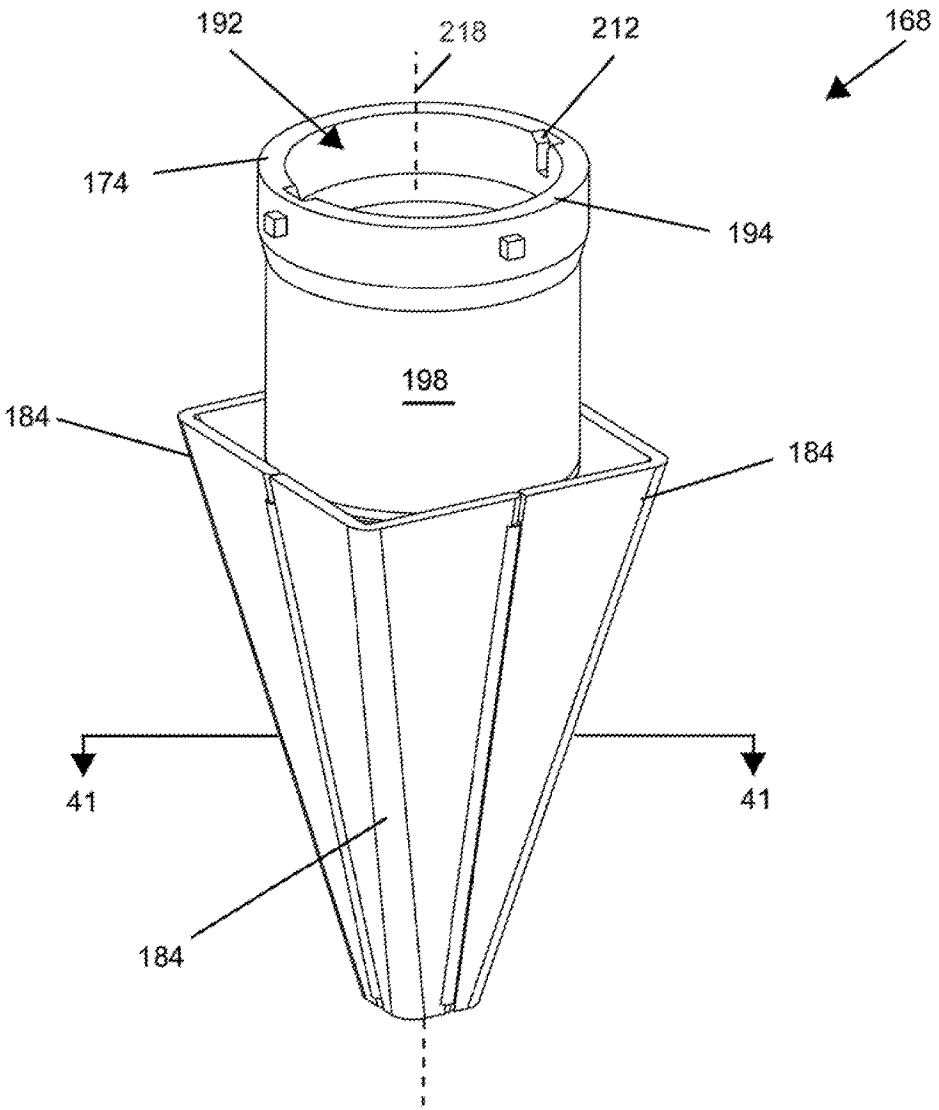
FIG. 40 is a perspective view of the alternate screen of FIG. 38, and showing the moveable hair wraps members are in a retracted configuration.
Figure 41:
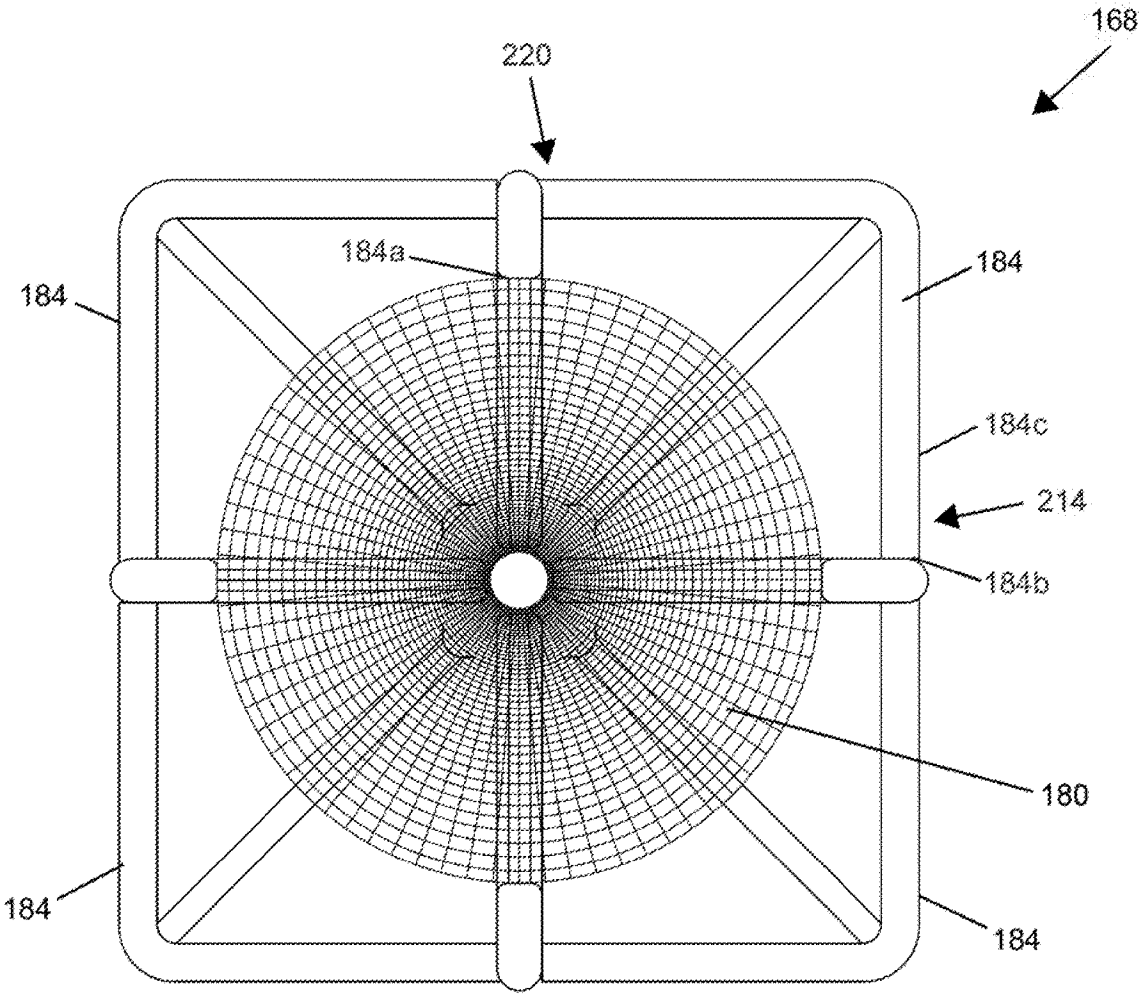
FIG. 41 is a section view of the alternate screen of FIG. 40, taken along line 41-41 in FIG. 40.

In embodiment wherein the ribs are rotatably moveable (e.g., as exemplified in FIGS. 34 to 41) the ribs 184 may be rotatable between the expanded position shown in FIGS. 35 and 39, and the retracted position shown in FIGS. 37 and 41. In the expanded position, the radial outer side 184*b* of each rib may be distally located from the outer wall 198. In the retracted position, the radial outer side 184*b* may be more proximally located relative to the outer wall 198.

In embodiment wherein the ribs are rotatably moveable, the ribs may rotate using any structural rotational mechanism. For instance, ribs 184 may be pivotally moveable using a pivotal connection located at a radial inner portion 220 of ribs 184. Alternatively, the ribs may be flexibly moveable using a flexible connection located at the radial inner portion 220 of rib 184 (e.g., using flexible elastomeric material).

Figure 46:
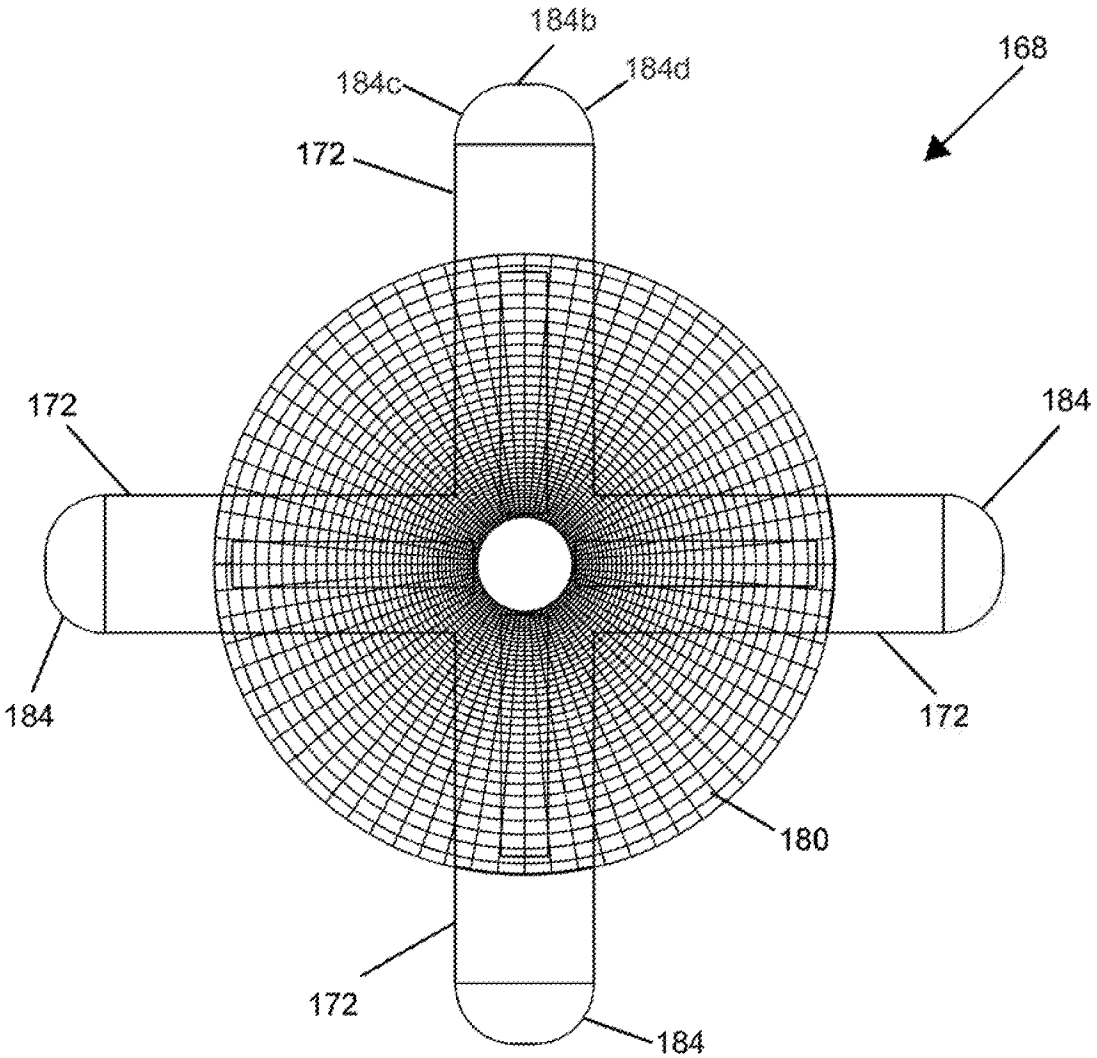
FIG. 46 is a section view of the alternate screen of FIG. 45, taken along line 46-46 in FIG. 45.
Figure 47:
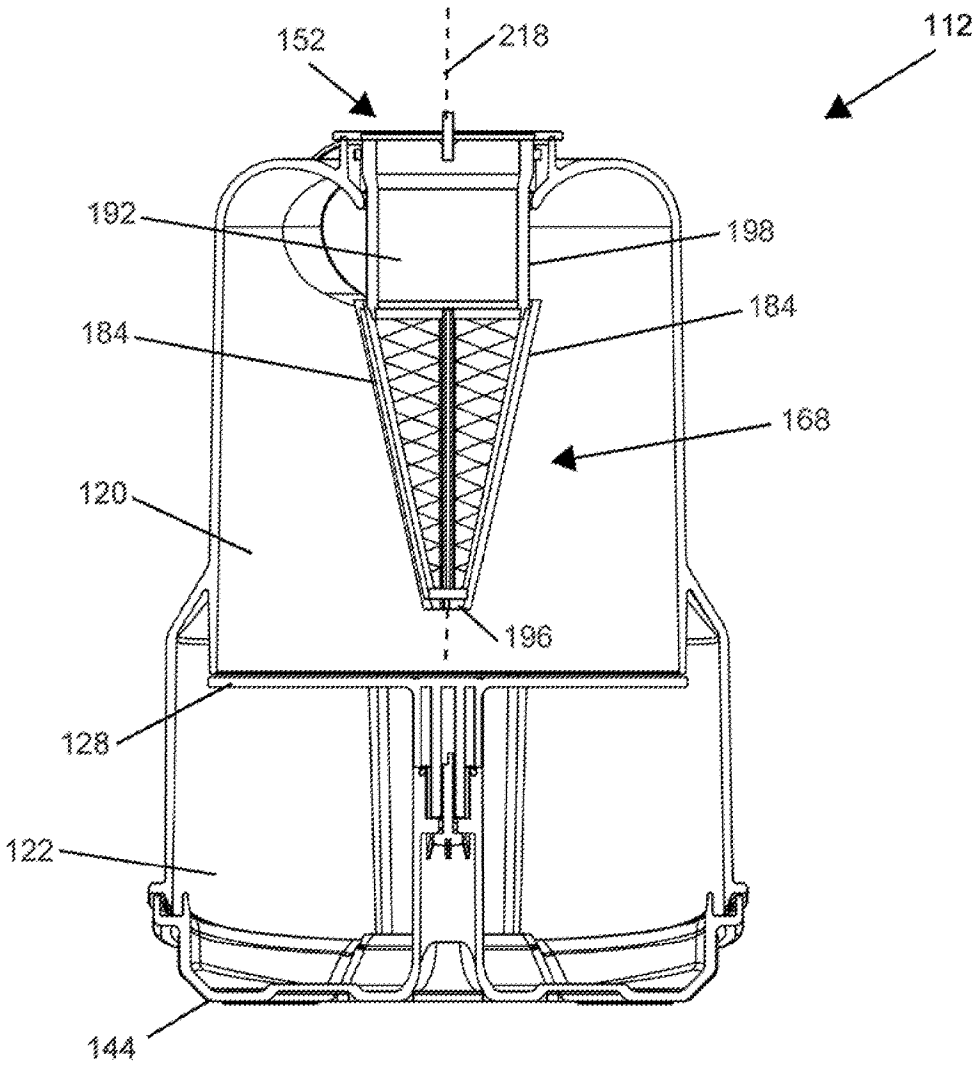
FIG. 47 is a perspective view of the cyclone bin assembly of FIG. 22 taken along section line 23-23 of FIG. 22, and incorporating the screen of FIG. 45.

FIGS. 42 to 47 exemplify an embodiment wherein the ribs 184 are slidably moveable between a radially expanded position (FIGS. 42 to 44) and a radially retracted position (FIGS. 45 to 47). In the expanded position, the radial inner side 184*a* of each rib is distally located from the outer wall 198. In the retracted position, the radial inner side 184*a* is more proximally located relative to the outer wall 198.

Ribs 184 may be slidably moved using any slidable configuration. For instance, in the exemplified embodiment, the ribs 184 are located at distal ends of extension members 312, which may be slidably received within non-permeable frame members 172.

Alternatively, rather than being radially slidable, the ribs 184 may also be longitudinally slidable. For instance, ribs 184 may be configured to slide in a longitudinal direction (e.g., in the direction of axis 218). For example, where the filtration member includes a lower frusto-conical (or conical) portion and the outlet end 152 is positioned above the distal end 196, the ribs 184 may slide upwardly and downwardly. For example, the ribs 184 may slide upwardly to assume an expanded configuration. The ribs 184 may then slide downwardly (e.g., in parallel to the slanted frusto-conical or conical outer wall 198) to retract inwardly. Accordingly, this may facilitate the collapsing of wrapped debris from around the ribs. In particular, hair may be tightly wrapped around the hair wrap members in the expanded configuration whereas, in the retracted configuration, the hair may sit loosely on, or may fall of, the hair wrap members.

While the embodiments of FIGS. 34 to 47 have exemplified the moveable hair wrap member configuration in embodiments wherein the hair wrap members are part of the filtration member 168, it will be appreciated that the same configurations can be applied to the discrete hair wrap member structure (for example, the external hair wrap members may comprise elongate ribs which are rotatably or slidable moveable).

Figure 50:
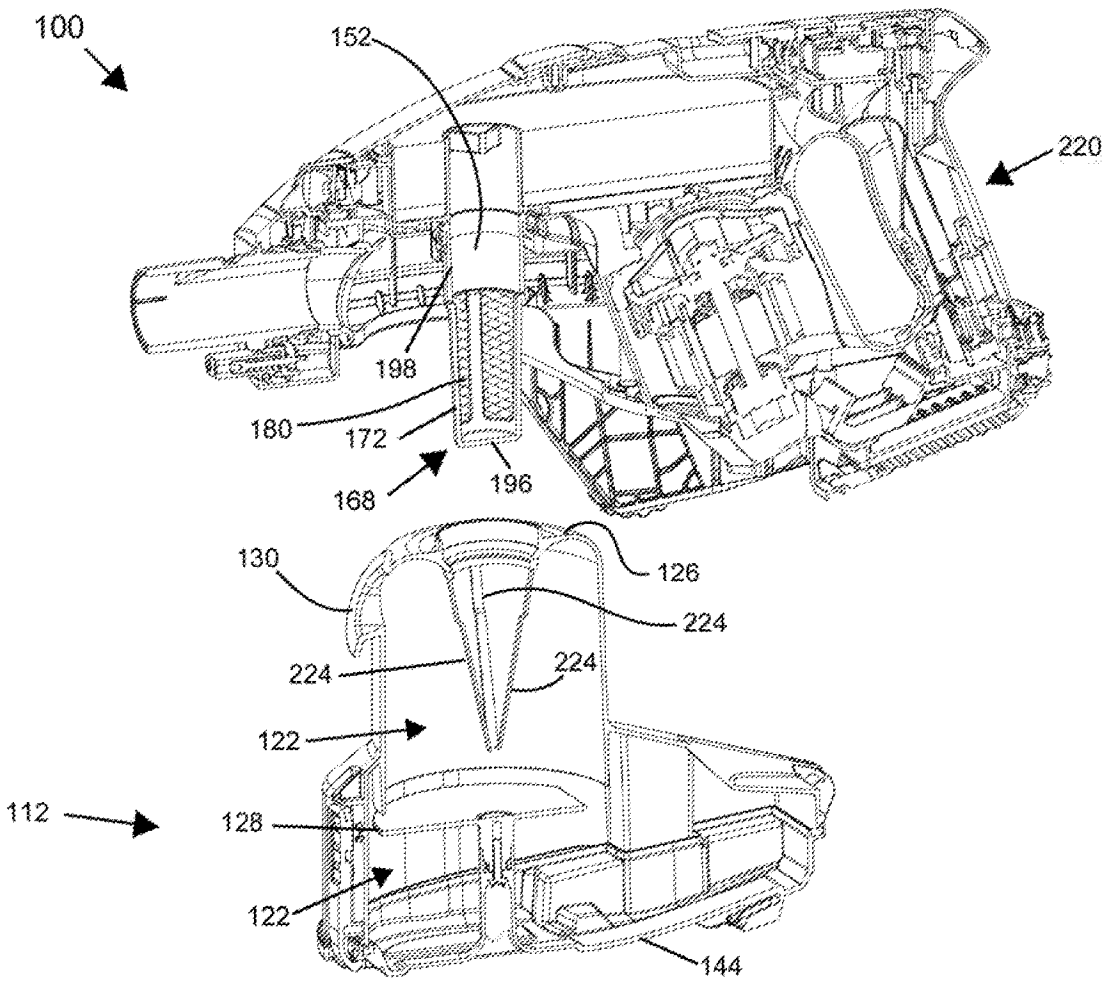
FIG. 50 is the section view of the surface cleaning apparatus of FIG. 48, and showing a screen and a main body of the surface cleaning apparatus in a lifted-away position.
Figure 51:
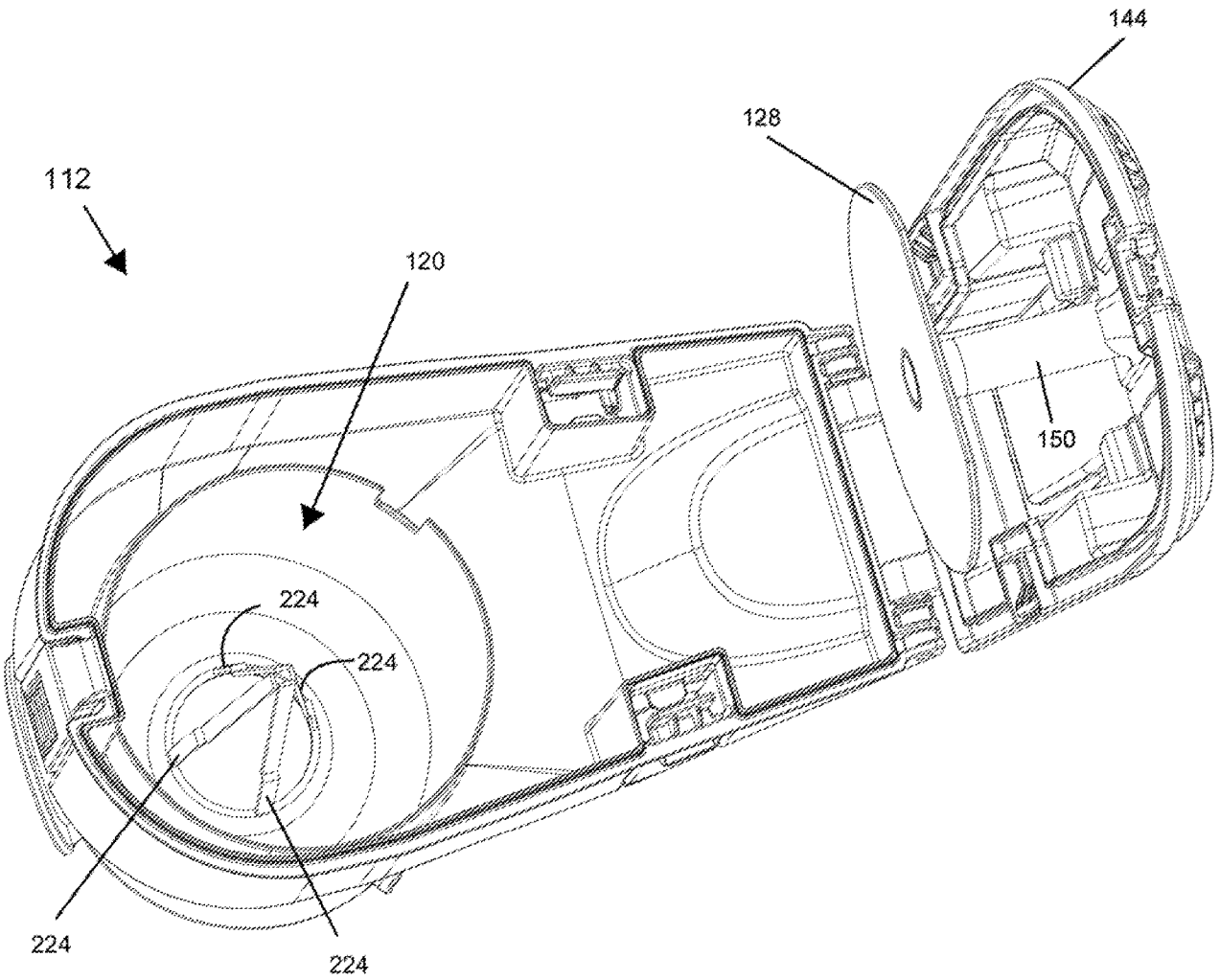
FIG. 51 is a bottom perspective view of the cyclone bin assembly of FIG. 50, with a bottom wall moved into an open position.

FIGS. 48 and 49 exemplify an embodiment wherein the external or discrete hair wrap members (e.g., elongate members 224) are configured to be in the expanded position when the filtration member 168 is inserted inside of the cyclone chamber 120. Alternatively, as exemplified in FIGS. 50 and 51, when the filtration member is removed from the cyclone chamber 120 (e.g., by lifting-away the main body 220 of the cleaning apparatus 100), a free end of the elongate member 224—opposite the end supported to end wall 126—may retract radially inwardly. Accordingly, debris may automatically collapse from the hair wrap members when the filtration member 168 is removed. An advantage of this configuration is that debris may be loosened or may fall off automatically by lifting away the filtration member. A further advantage of this configuration is that debris is always contained within the cyclone chamber 120 (or dirt collection chamber), and is not otherwise removed (e.g. until the cyclone chamber is opened by an openable bottom door) when the filtration member is removed.

The external hair wrap members 224, in the embodiment of FIGS. 48 and 49, may be moveable between the expanded and retracted position in any manner. The filtration member 168 may itself be the actuation member that causes the hair wrap members to move between the expanded and/or retracted positions by engagement between the filtration member and the hair wrap members as the filtration member is inserted and/or removed from the cyclone chamber. If a biasing member is provided, then the filtration member need only drive the hair wrap members I one direction to counter the biasing member. For instance, the elongate members 224 may be pivotally connected at one end to the end wall 126. Alternatively, the elongate members 224 may be flexibly attached at one end to the end wall 126 (e.g., using flexible elastomeric material).

Optionally, an actuating member may be provided to cause the hair wrap members to move between the expanded and/or retracted positions. The actuating member may be configured to engage and dis-engage the hair wrap members. In the engaged position, the actuation member may urge the hair wrap members into the expanded position. In the dis-engaged position, the un-engaged hair wrap members may move back into the retracted position (or vice-versa) by a biasing member or by a driving force applied by the actuating member.

Optionally, the actuation member is moveable with a floor or door 144 of the air treatment housing 112. For instance, when the openable floor 144 is in the closed position, the actuation member may engage the hair wrap members and drive them into the expanded configuration. Alternatively, when the floor 144 is in the open position, the actuation member may dis-engage from the hair wrap members to allow the members to retract, e.g., by a biasing member. Alternately, the actuation member may remain connected to the hair wrap members and draw the members into the retracted configuration. In this manner, the dirt collection chamber 122 and the hair wrap members may be concurrently cleaned by opening the floor 144.

FIGS. 53 to 58 exemplify such an embodiment. As shown, the hair wrap members (e.g., elongate members 224) are moveably connected at a distal end to upper wall 126 (e.g., using pivot hinges 226).

Each member 224 includes a driving portion 228, which extends radially inwardly, into the volume of the filtration member (e.g., via an aperture 232 along the outer wall 198).

An actuation member 230 is located inside of the filtration member 168. In the exemplified embodiment, the actuation member 230 is configurable to move along the filtration member axis 218 to engage and dis-engage the driving members 228.

Figure 52:
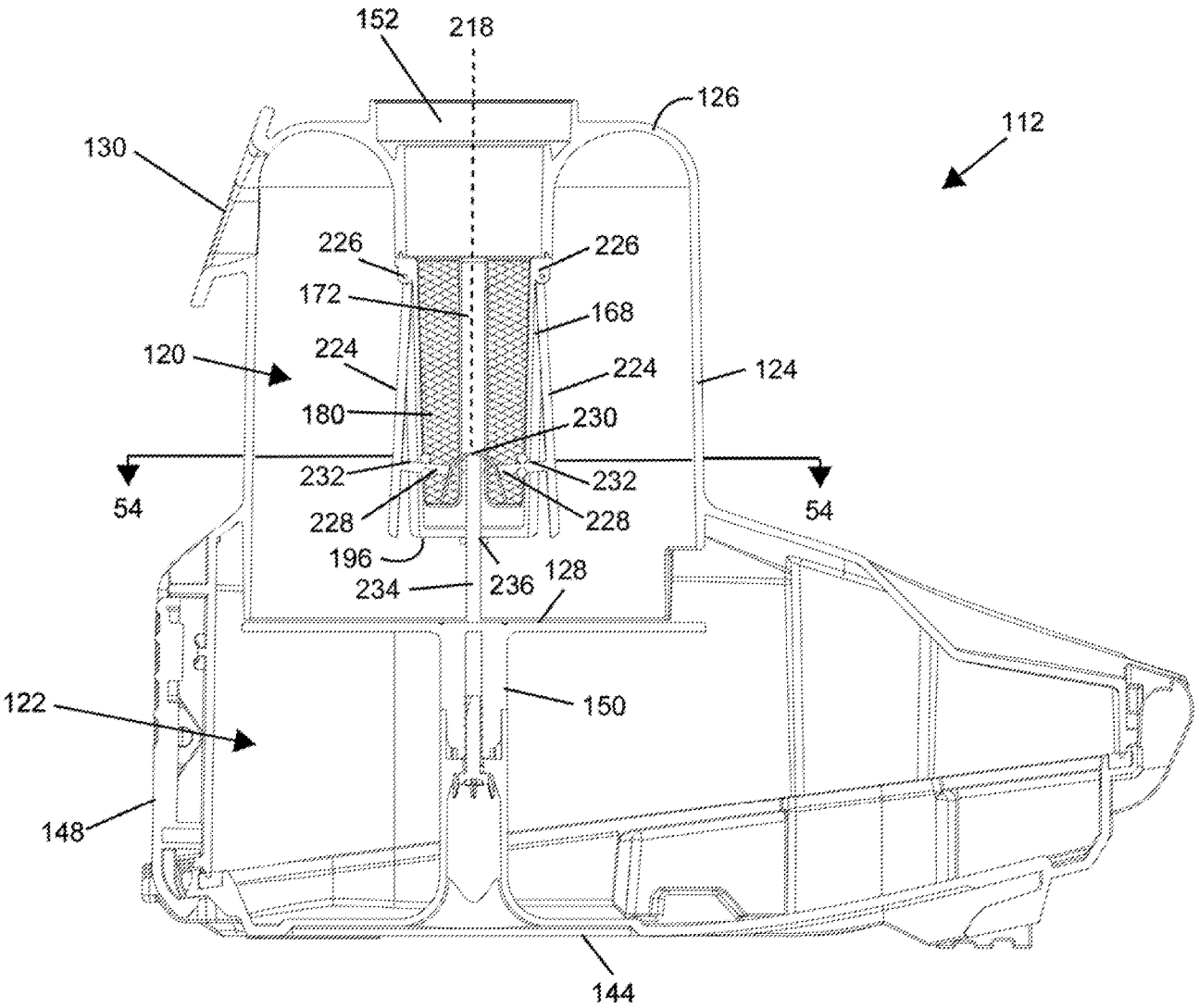
FIG. 52 is a section view of the cyclone bin assembly in FIG. 1B taken along the line 48-48 of FIG. 1B, and showing a screen, moveable external hair wrap members and an actuation member, wherein the moveable external hair wrap members are shown in an expanded configuration.
Figure 53:
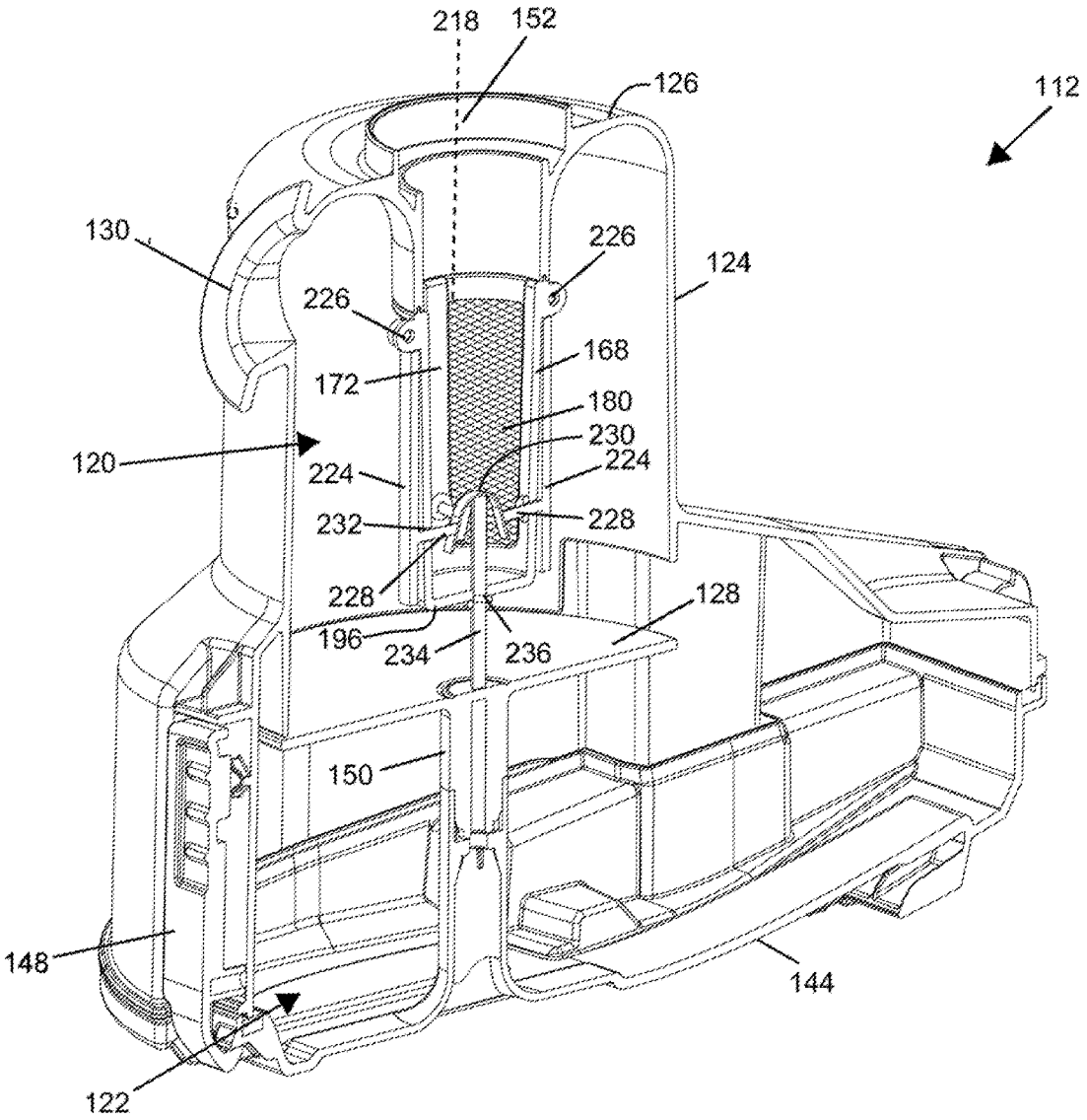
FIG. 53 is a perspective view of the section view of FIG. 52.
Figure 54:
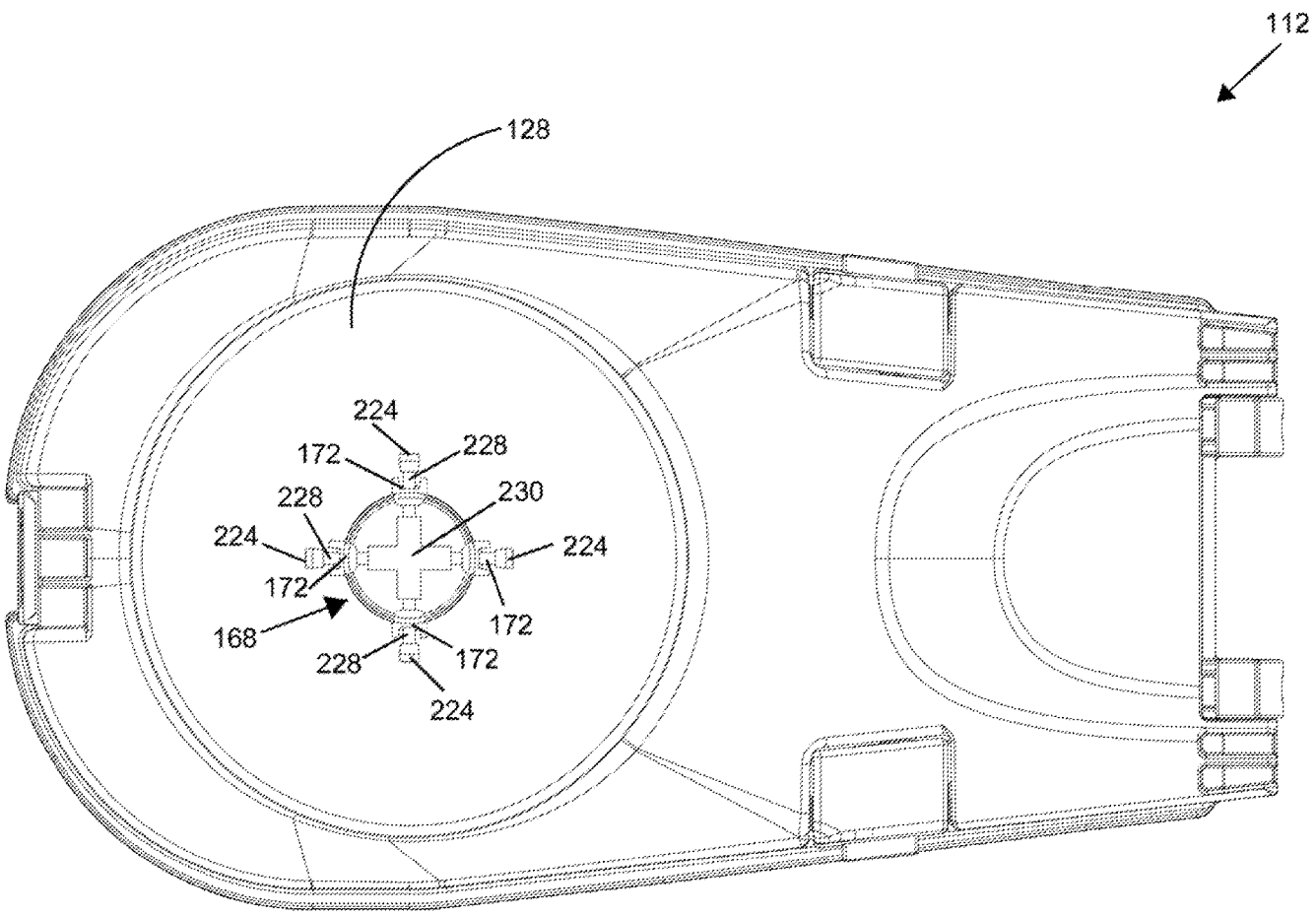
FIG. 54 is a section view of the cyclone bin assembly of FIG. 52, taken along the line 54-54 of FIG. 52.

In the configuration of FIGS. 52 to 54, the actuation member 230 is shown in the engaged position, whereby the actuation member 230 engages driving members 228. In this position, the actuation member 230 pushes (e.g., urges) the hair wrap members radially outwardly into the expanded position. Accordingly, in the expanded configuration, the hair wrap members are configured to collect debris entrained in the cyclonic air flow.

Figure 55:
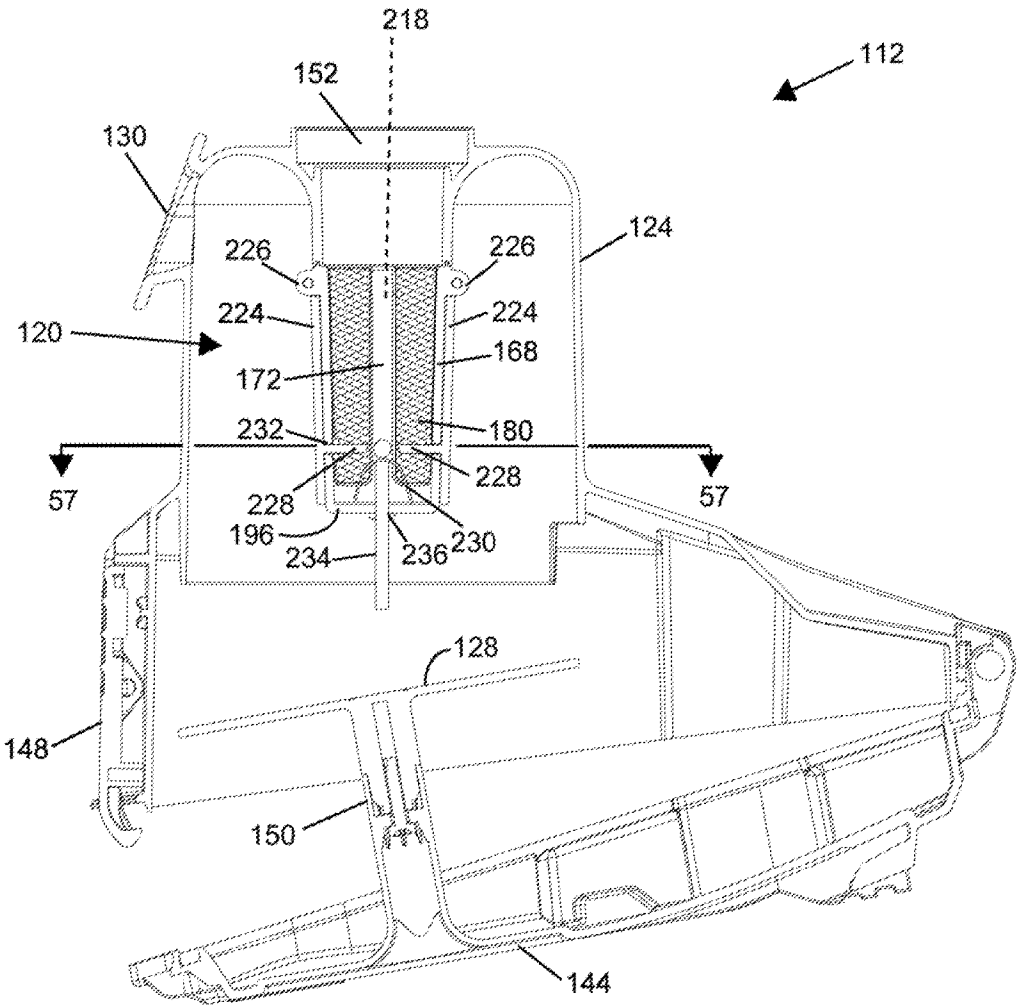
FIG. 55 is a section view of the cyclone bin assembly of FIG. 52, and showing the moveable external hair wrap members in a retracted configuration.
Figure 56:
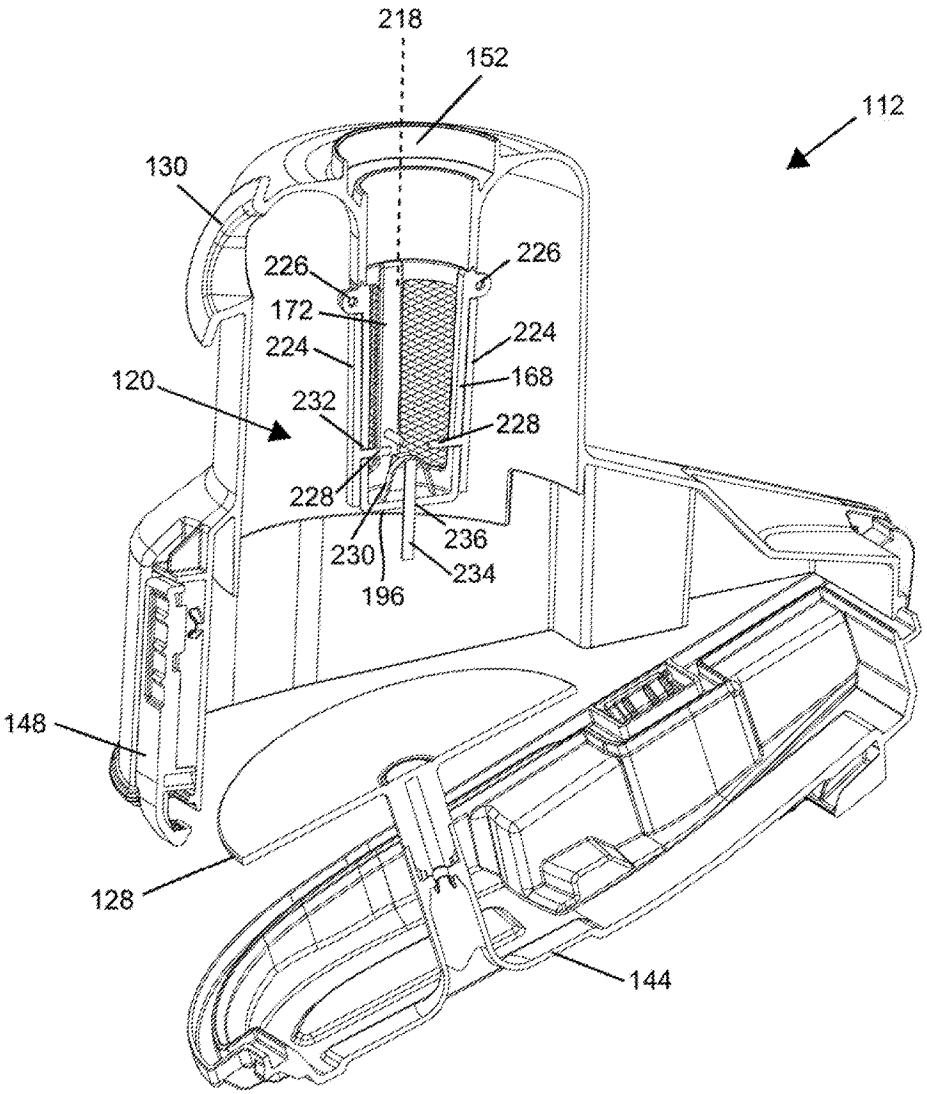
FIG. 56 is a perspective view of the section view of FIG. 55.
Figure 57:
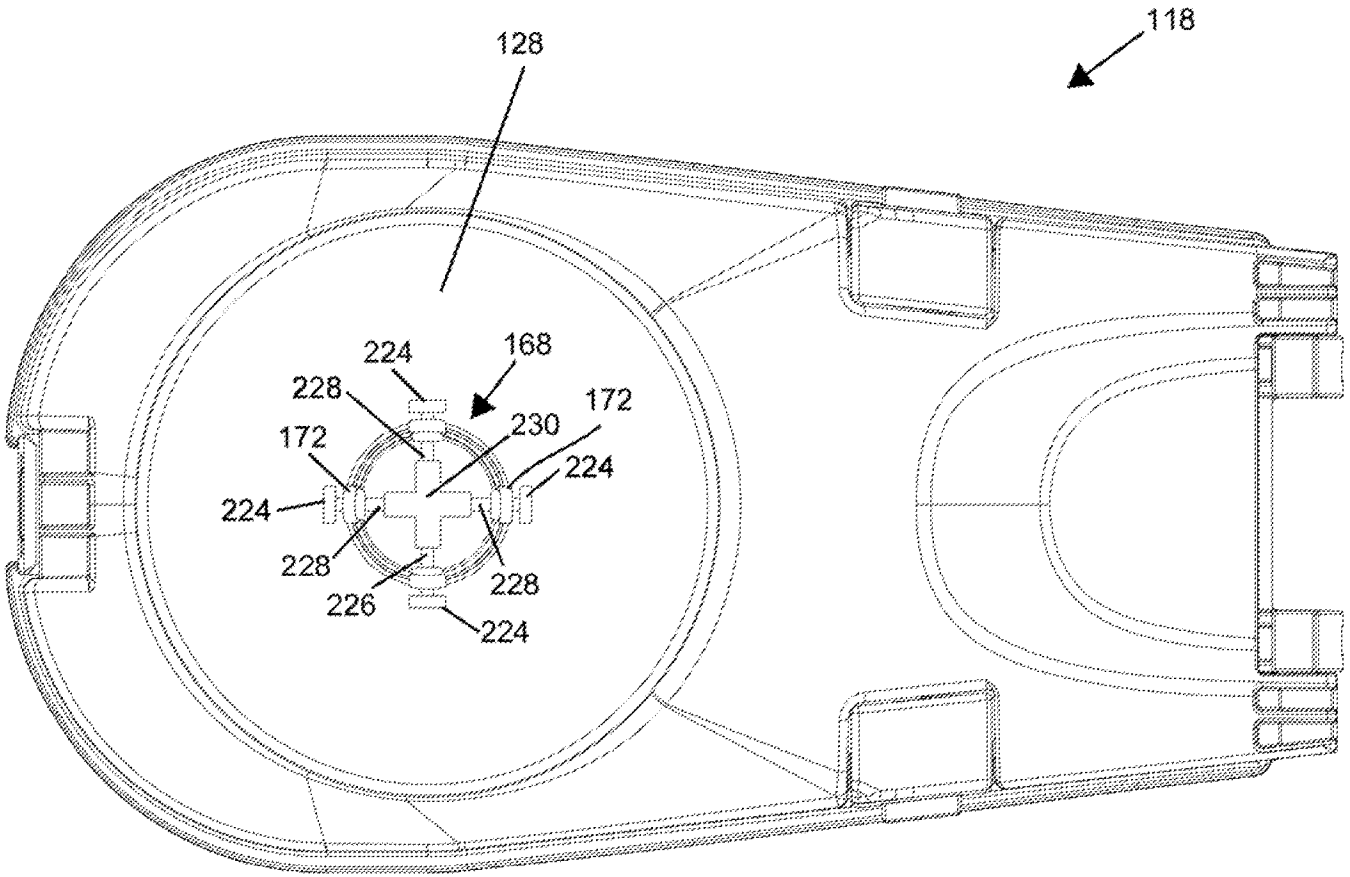
FIG. 57 is a section view of the cyclone bin assembly of FIG. 55, taken along the line 57-57 of FIG. 55.

In the configuration of FIGS. 55 to 57, the actuation member 230 is moved along axis 218 to dis-engage from the driving members 228 due to door 144 being opened. In this position, the hair wrap members retract radially inwardly such that the wrapped debris may now collapse from around the hair wrap members.

The actuation member may be configured to move between the engaged and dis-engaged position in any manner known in the art. In the exemplified embodiments, the actuation member comprises an engagement end 230 and a support member 234. Support member 234 extends into the filtration member 168 via opening 236 (e.g., located at the distal end 196 of the filtration member). When the door 144 is in the closed position (FIGS. 52 and 53), a free end of the support member 234 engages plate 128, and is urged upwardly (e.g., along axis 218) to move the engagement end 230 of the actuation member into the engaged position. Conversely, when the door 144 is moved into the open position (FIGS. 55 and 56), the plate 128 is moved away from the support member 234, which allows the support member 236 to collapse downwardly (e.g. along axis 218) and move the actuation member into the dis-engaged position. Actuation member 230 may be driven downwardly if elongate members 224 are biased to the retracted position by a biasing member (e.g., a spring provided at or as part of pivot hinge 226).

Figure 61:
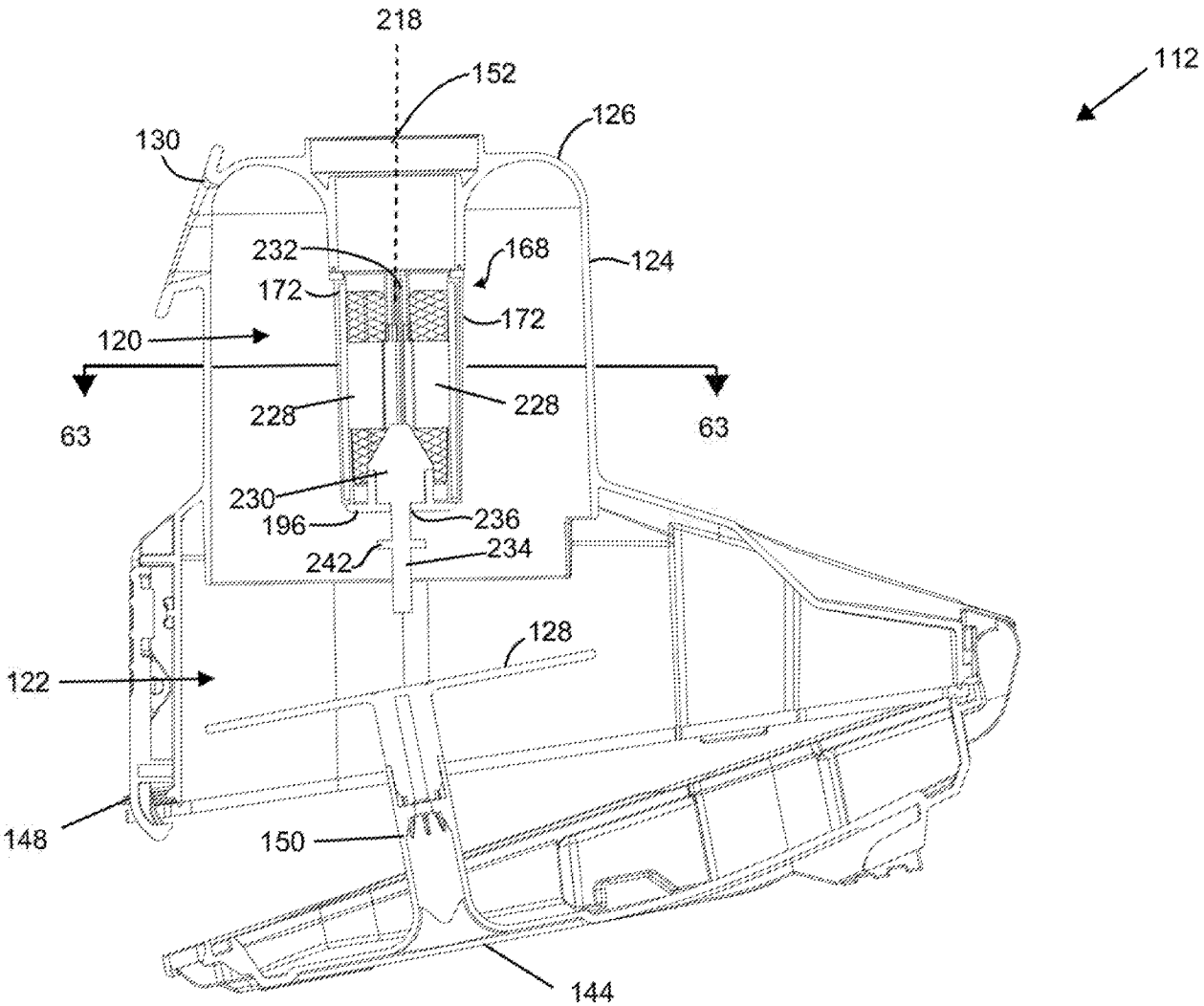
FIG. 61 is a section view of the cyclone bin assembly in FIG. 58, and showing the moveable hair wraps members in a retracted configuration.
Figure 62:
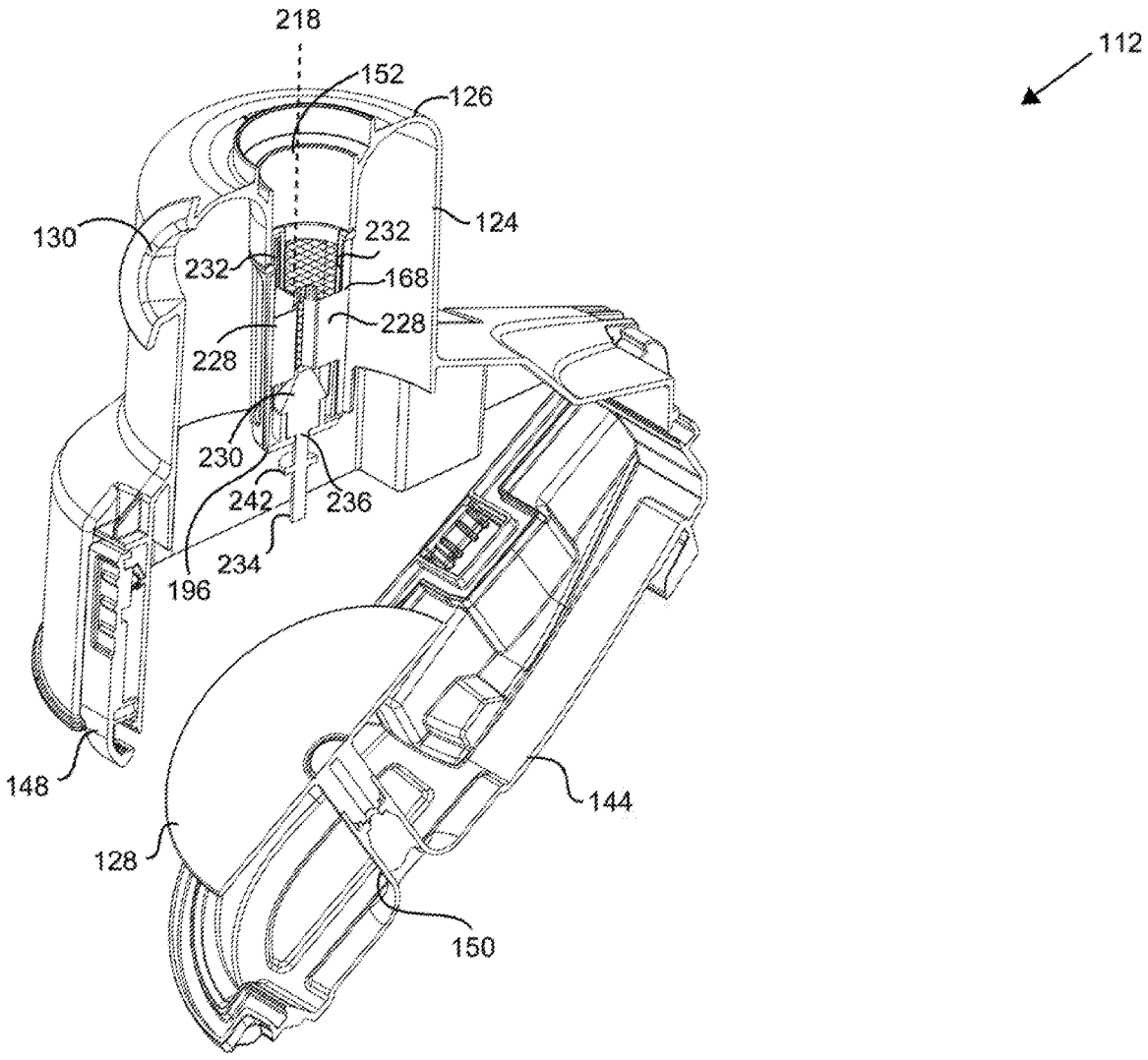
FIG. 62 is a perspective view of the section view of FIG. 61.
Figure 63:
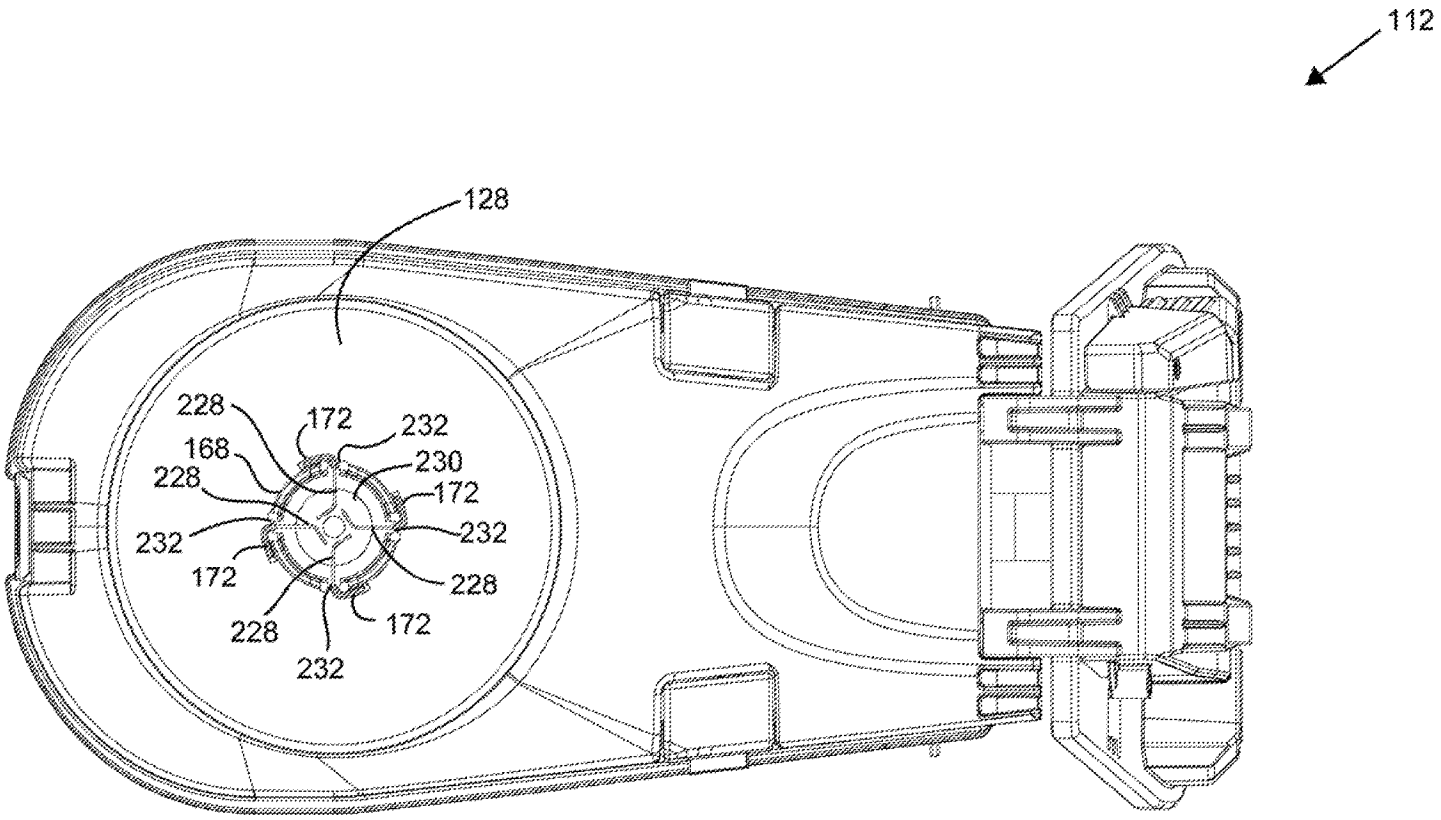
FIG. 63 is a section view of the cyclone bin assembly of FIG. 61, taken along the line 63-63 of FIG. 61.

FIGS. 58 to 63 exemplify an alternative embodiment for the actuation member. In this embodiment, the ribs 184 may be rotatable between a radially expanded position (FIGS. 58 to 60) and a radially retracted position (FIGS. 61 to 63).

As exemplified, when the actuation member is in the elevated position (FIGS. 58 to 60), the engagement end 230 engages the driving portion 228 in order to rotate the ribs 184 into the radially expanded position. In this configuration, the expanded ribs 184 are configured to collect debris that is entrained in air flow inside of the cyclone chamber. Alternatively, when the actuation member is moved into the lowered position (FIGS. 60 to 63), the engagement end dis-engages from the driving portion 228. Accordingly, in this position, the ribs 184 may rotate back into a radially retracted position, e.g., which induces dirt to collapse from around the ribs 184, by e.g., a biasing member biasing the ribs to the retraced position.

Figure 58:
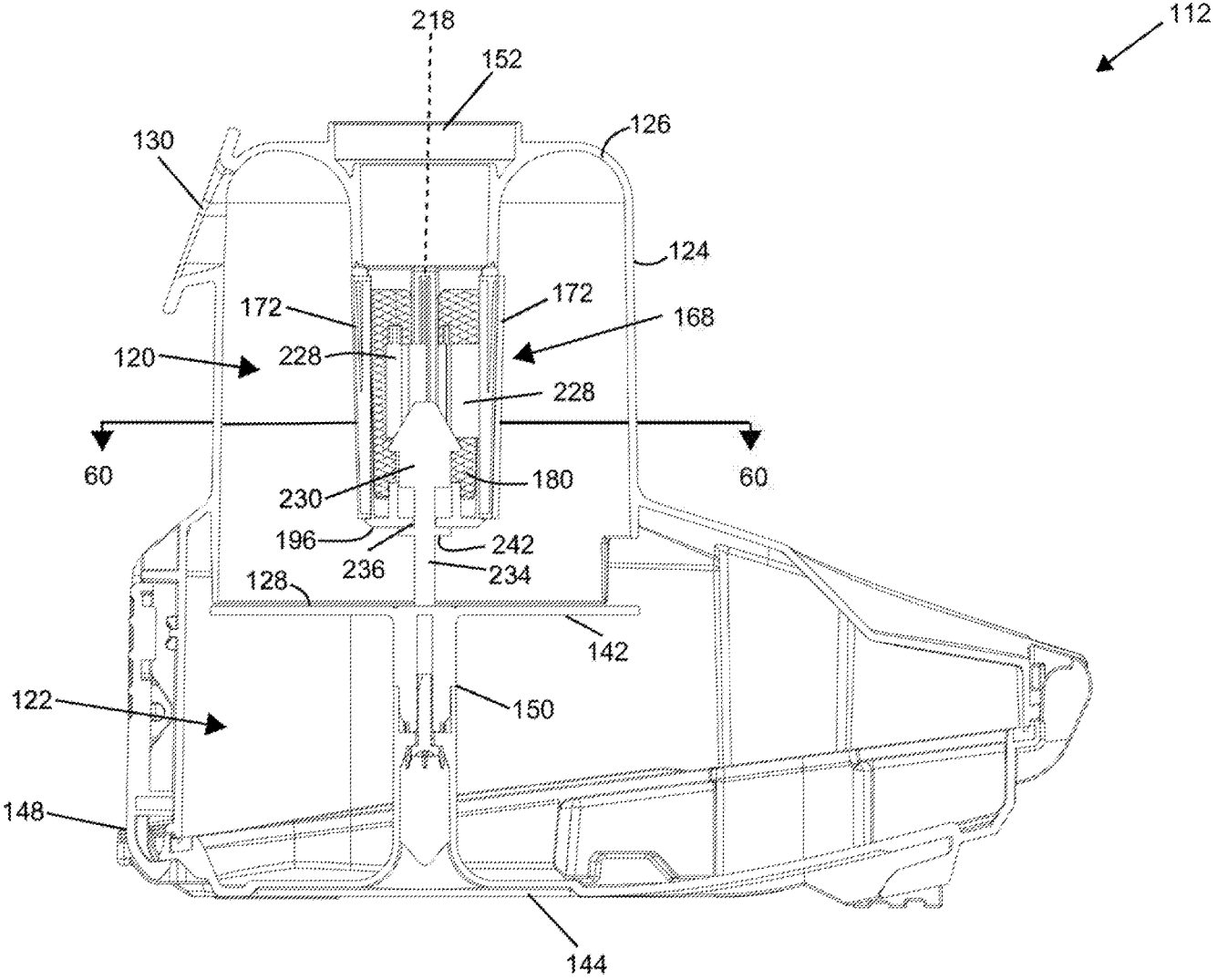
FIG. 58 is a section view of the cyclone bin assembly of the surface cleaning apparatus of FIG. 1B taken along the line 48-48, and showing a screen with moveable hair wrap members and an alternate hair debirding mechanism, wherein the moveable hair wrap members are shown in an expanded configuration.
Figure 59:
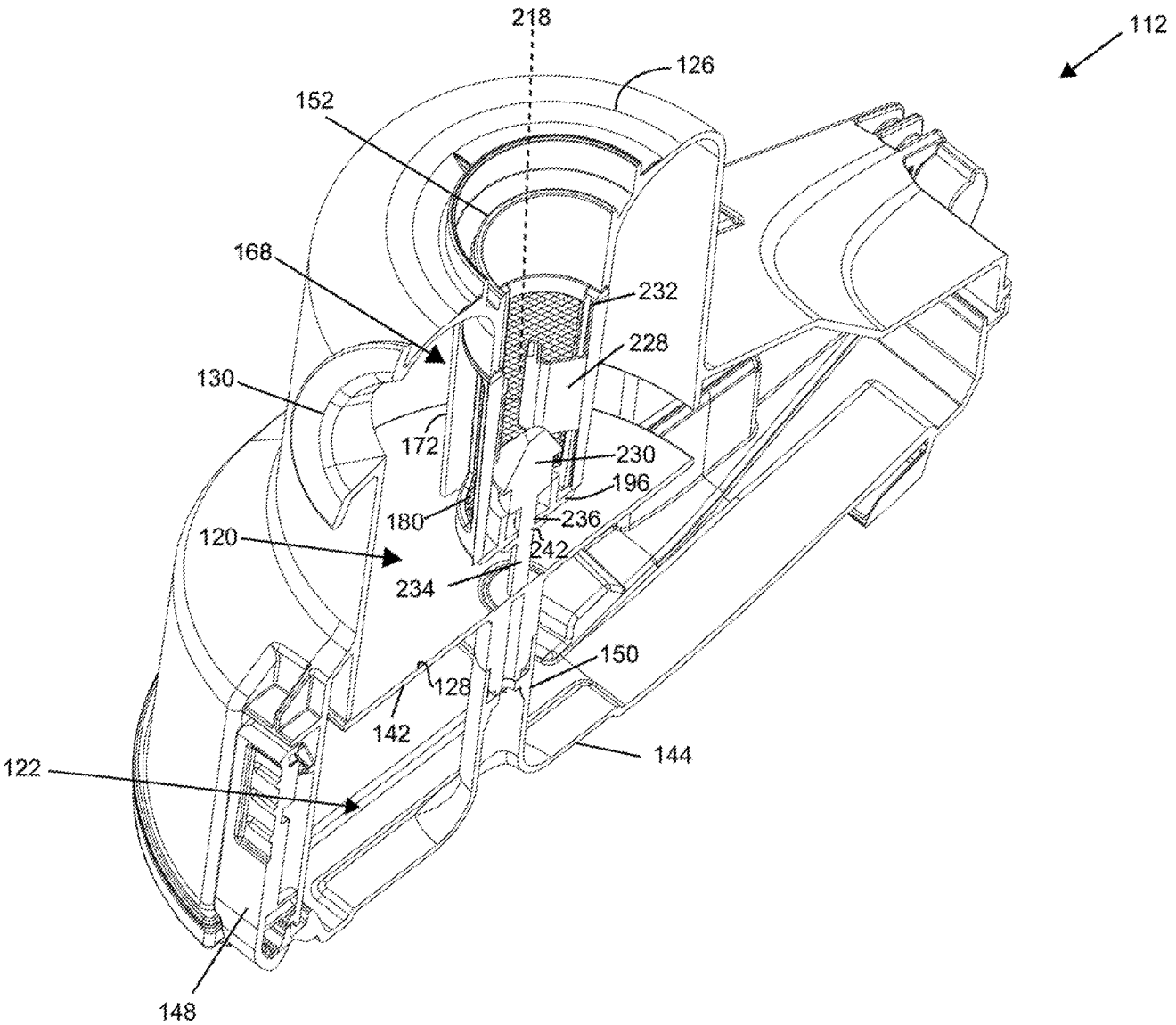
FIG. 59 is a perspective view of the section view of FIG. 58.
Figure 60:
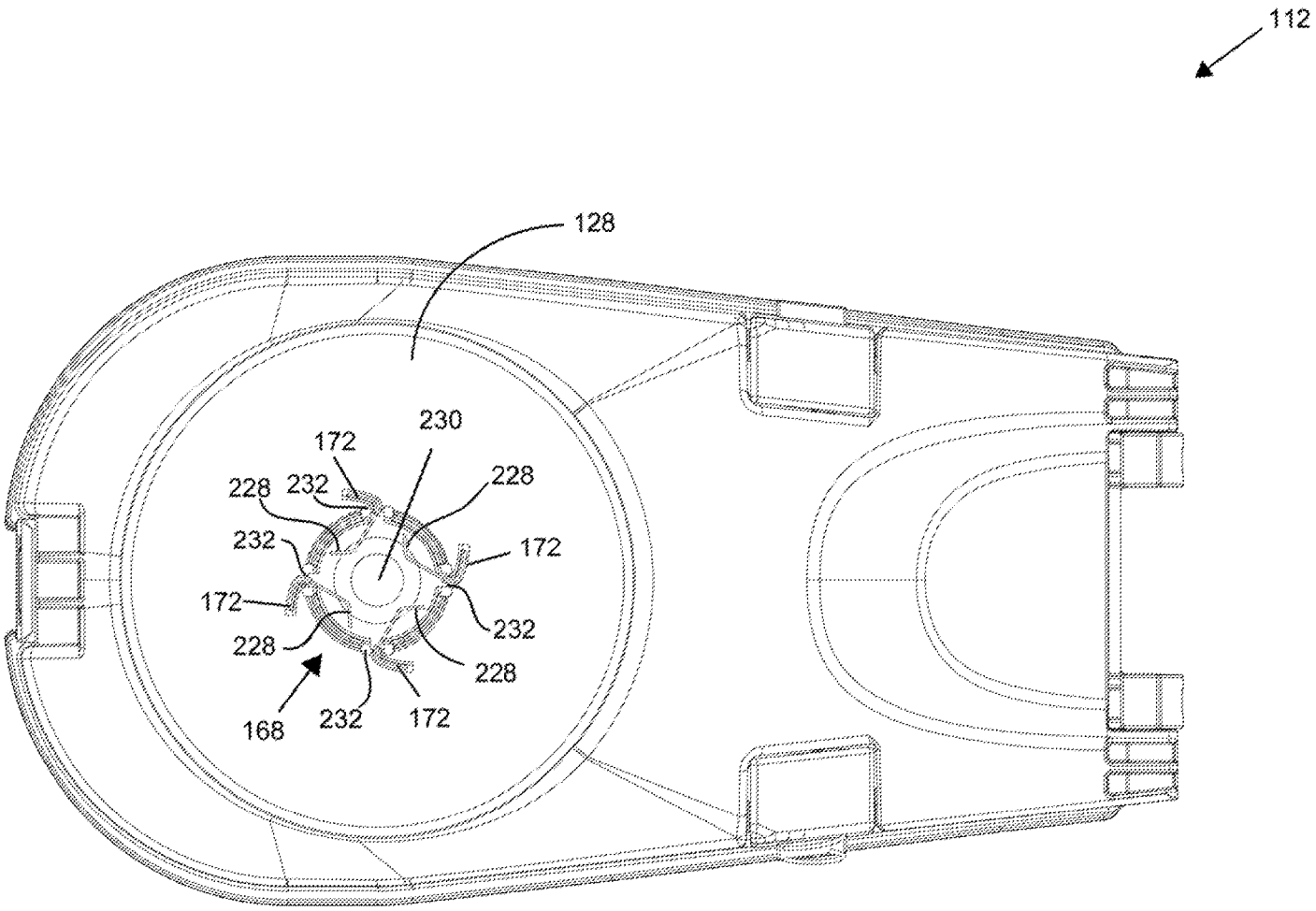
FIG. 60 is a section view of the cyclone bin assembly of FIG. 58, taken along the line 60-60 of FIG. 58.

In some embodiment, a limiting member 242 is provided around the support member 234 to limit the upward movement of the support member 234 (e.g., by engaging the distal end 196 as shown in FIG. 58).

The actuation member may have any shape or form. For example, in the embodiment of FIGS. 55 to 57, the engagement end 230 of the actuation member comprises one or more inverted 'U-shaped' strips, which engage each of the driving portions 228. As shown in FIG. 55, in the dis-engaged position, the bottom of the 'U-shape' delimits the extent to which actuation member 230 slides downwardly along axis 218 (e.g., the bottom of the 'U-shape' engages the inner bottom surface of the filtration member 168). Alternatively, in the embodiment of FIGS. 58 to 63, engagement end 230 of the actuation member comprises a frusto-conical member that slidably engages and dis-engages the driving portions 228.

What has been described above has been intended to be illustrative of the invention and non-limiting and it will be understood by persons skilled in the art that other variants and modifications may be made without departing from the scope of the invention as defined in the claims appended hereto.

The invention claimed is:

1. A surface cleaning apparatus comprising:

(a) an air flow passage extending from a dirty air inlet to a clean air outlet;

(b) a cyclone chamber positioned in the air flow passage, the cyclone chamber having a longitudinal axis defining a longitudinal direction, an air inlet at a cyclone air inlet end of the cyclone chamber, an opposed end longitudinally spaced from the air inlet end and a cyclone air outlet comprising a cyclone chamber outlet port, the cyclone having a direction of rotation of air in the cyclone chamber;

(c) a physical filtration member positioned in the cyclone chamber upstream from the cyclone chamber outlet port, the physical filtration member having a longitudinal axis, an outer wall wherein at least a portion of the outer wall is porous, and a plurality of ribs spaced around the outer wall, the ribs having a radial inner side, a radial outer side, an upstream side based on the direction of rotation, a downstream side based on the direction of rotation and first and second longitudinally spaced apart ends, wherein, when the surface cleaning apparatus is in use to clean a surface, the radial outer side is positioned radially outwardly of the outer wall; and, (d) a suction motor positioned in the air flow passage downstream from the cyclone chamber, wherein the ribs are slideably moveable in a radial direction.

2. The surface cleaning apparatus of claim 1 wherein at least a radial outer portion of the upstream side of the ribs extends in the direction of rotation.

3. The surface cleaning apparatus of claim 2 wherein the radial outer portion of the upstream side of the ribs is curved in the direction of rotation.

4. The surface cleaning apparatus of claim 2 wherein at least a radial outer portion of the downstream side of the ribs extends radially.

5. The surface cleaning apparatus of claim 1 wherein at least a radial outer portion of the downstream side of the ribs extends in the direction of rotation.

6. The surface cleaning apparatus of claim 5 wherein the radial outer portion of the downstream side of the ribs is curved in the direction of rotation.

7. The surface cleaning apparatus of claim 1 wherein the first end of the ribs is positioned closer to inlet end and second end of the ribs is positioned closer to the opposed end.

8. The surface cleaning apparatus of claim 1 wherein the at least a portion of the outer wall that is porous comprises a screen.

9. The surface cleaning apparatus of claim 1 wherein the outer wall comprises a screen.

10. The surface cleaning apparatus of claim 1 wherein the physical filtration member comprises a conical section and the ribs are provided on the conical section.

11. The surface cleaning apparatus of claim 10 wherein the cyclone air outlet comprises the physical filtration member.

12. The surface cleaning apparatus of claim 1 wherein the physical filtration member extends from the cyclone air inlet end of the cyclone chamber towards the opposed end of the cyclone chamber.

13. The surface cleaning apparatus of claim 12 wherein the opposed end is openable.

14. The surface cleaning apparatus of claim 1 wherein the radial inner side of the ribs is positioned outwardly from the outer wall.

15. A surface cleaning apparatus comprising:

(a) an air flow passage extending from a dirty air inlet to a clean air outlet;

(b) a cyclone chamber positioned in the air flow passage, the cyclone chamber having a longitudinal axis defining a longitudinal direction, an air inlet at a cyclone air inlet end of the cyclone chamber, an opposed end longitudinally spaced from the air inlet end and a cyclone air outlet comprising a cyclone chamber outlet port, the cyclone having a direction of rotation of air in the cyclone chamber;

(c) a physical filtration member positioned in the cyclone chamber upstream from the cyclone chamber outlet port, the physical filtration member having a longitudinal axis, an outer wall wherein at least a portion of the outer wall is porous, and a plurality of ribs spaced around the outer wall, each rib of the plurality of ribs extending between a first terminal end and a second terminal end, wherein the first terminal end and the second terminal end of the ribs are moveable outwardly with respect to the outer wall; and, (d) a suction motor positioned in the air flow passage downstream from the cyclone chamber.

16. The surface cleaning apparatus of claim 15 wherein the ribs are retractable.

17. A surface cleaning apparatus comprising:

(a) an air flow passage extending from a dirty air inlet to a clean air outlet;

(b) a cyclone chamber positioned in the air flow passage, the cyclone chamber having a longitudinal axis defining a longitudinal direction, an air inlet at a cyclone air inlet end of the cyclone chamber, an opposed end longitudinally spaced from the air inlet end and a cyclone air outlet comprising a cyclone chamber outlet port, the cyclone having a direction of rotation of air in the cyclone chamber;

(c) a physical filtration member positioned in the cyclone chamber upstream from the cyclone chamber outlet port, the physical filtration member having a longitudinal axis, an outer wall wherein at least a portion of the outer wall is porous, and a plurality of ribs spaced around the outer wall, each rib of the plurality of ribs having a length, wherein the ribs, along their entire length, are moveable between a radially expanded position and a radially retracted position; and, (d) a suction motor positioned in the air flow passage downstream from the cyclone chamber.

* * * * *